US008786535B2

(12) United States Patent
Shiomi et al.

(10) Patent No.: US 8,786,535 B2
(45) Date of Patent: Jul. 22, 2014

(54) LIQUID CRYSTAL DISPLAY DEVICE AND DRIVING METHOD THEREOF, TELEVISION RECEIVER, LIQUID CRYSTAL DISPLAY PROGRAM COMPUTER-READABLE STORAGE MEDIUM STORING THE LIQUID CRYSTAL DISPLAY PROGRAM, AND DRIVE CIRCUIT

(75) Inventors: Makoto Shiomi, Tenri (JP); Toshihisa Uchida, Suzuka (JP); Toshihide Tsubata, Tsu (JP); Junichi Sawahata, Tsu (JP); Naoshi Yamada, Tsu (JP)

(73) Assignee: Sharp Kabushiki Kaisha, Osaka (JP)

( * ) Notice: Subject to any disclaimer, the term of this patent is extended or adjusted under 35 U.S.C. 154(b) by 1692 days.

(21) Appl. No.: 12/225,763

(22) PCT Filed: Dec. 19, 2006

(86) PCT No.: PCT/JP2006/325279

§ 371 (c)(1),
(2), (4) Date: Sep. 29, 2008

(87) PCT Pub. No.: WO2007/122777

PCT Pub. Date: Nov. 1, 2007

(65) Prior Publication Data

US 2009/0115772 A1 May 7, 2009

(30) Foreign Application Priority Data

Apr. 19, 2006 (JP) ..... 2006-116197
Sep. 12, 2006 (JP) ..... 2006-247305

(51) Int. Cl.
*G09G 3/36* (2006.01)
*G09G 3/34* (2006.01)

(52) U.S. Cl.
CPC ..... *G09G 3/3677* (2013.01); *G09G 2340/16* (2013.01); *G09G 3/342* (2013.01); *G09G 3/3614* (2013.01); *G09G 3/3688* (2013.01); *G09G 3/3648* (2013.01); *G09G 2330/023* (2013.01); *G09G 2320/043* (2013.01); *G09G 2320/0252* (2013.01)
USPC ..... 345/96; 345/214

(58) Field of Classification Search
USPC ..... 345/214, 96
See application file for complete search history.

(56) References Cited

U.S. PATENT DOCUMENTS 6,642,916 B1 * 11/2003 Kodama et al. ..... 345/100

(Continued)

FOREIGN PATENT DOCUMENTS

JP 09-212137 8/1997
JP 09-243998 9/1997

(Continued)

OTHER PUBLICATIONS

Sang Soo Kim, Super PVA Sets New State-of-the-Art for LCD-TV, SID Symposium Digest of Technical Papers, vol. 35, Issue 1, May 2004, pp. 760-763.

(Continued)

*Primary Examiner* — Sumati Lefkowitz
*Assistant Examiner* — Jose Soto Lopez
(74) *Attorney, Agent, or Firm* — Harness, Dickey & Pierce, P.L.C.

(57) ABSTRACT

In one embodiment of the present invention, a driving method of a liquid crystal display device is disclosed. According to one embodiment of the present invention a driving method of an active matrix display device is disclosed including: a plurality of source lines; a plurality of gate lines that intersect the source lines; and a plurality of pixel formation sections being disposed in a matrix manner at the respective intersections of the source lines and the gate lines, each of the pixel formation sections receiving as a pixel value a voltage applied to the source line that passes through the corresponding intersection when the gate line that passes through the corresponding intersection is selected, wherein non-image signals are applied to the source lines in each horizontal scanning period, and the gate lines are selected in an effective scanning period, and thereafter the gate lines are selected, in sync with a timing of application of the non-image signals to the source lines, before the subsequent effective scanning period comes after a point in time when the gate lines have been brought into non-selected state.

52 Claims, 43 Drawing Sheets

(56) References Cited

U.S. PATENT DOCUMENTS

| | | | | |
|---|---|---|---|---|
| 2001/0024199 | A1* | 9/2001 | Hughes et al. | 345/204 |
| 2002/0154088 | A1* | 10/2002 | Nishimura | 345/102 |
| 2003/0058229 | A1 | 3/2003 | Kawabe et al. | |
| 2004/0041763 | A1 | 3/2004 | Kodama et al. | |
| 2004/0178981 | A1 | 9/2004 | Asada et al. | |
| 2004/0196274 | A1 | 10/2004 | Song et al. | |
| 2005/0083278 | A1 | 4/2005 | Teraishi | |
| 2005/0093803 | A1 | 5/2005 | Cheon et al. | |
| 2006/0071927 | A1* | 4/2006 | Chang et al. | 345/211 |
| 2006/0125748 | A1* | 6/2006 | Yang et al. | 345/88 |
| 2006/0145992 | A1* | 7/2006 | Hsieh et al. | 345/94 |
| 2006/0290636 | A1* | 12/2006 | Hong | 345/98 |
| 2007/0085794 | A1 | 4/2007 | Kawabe et al. | |
| 2007/0115242 | A1 | 5/2007 | Teraishi | |

FOREIGN PATENT DOCUMENTS

| | | | |
|---|---|---|---|
| JP | 11-085115 | | 3/1999 |
| JP | 2002-175057 | | 6/2002 |
| JP | 2002-323876 | | 11/2002 |
| JP | 2002323876 | | 11/2002 |
| JP | 2005-141216 | A | 6/2005 |
| WO | WO 2007/015347 | | 2/2007 |
| WO | WO 2007/015348 | | 2/2007 |

OTHER PUBLICATIONS

Jnag-Kun Song et al., Novel Method for Fast Response Time in PVA Mode, SID Symposium Digest of Technical papers, vol. 35, Issue 1, May 2004, pp. 1344-1347.

* cited by examiner

FIG. 28

| | | x | | | | | | |
|---|---|---|---|---|---|---|---|---|
| | | 1 | 2 | 3 | 4 | 5 | 6 | 7 |
| y | 1 | + | − | + | − | | | |
| | 2 | − | + | − | + | | | |
| | 3 | + | − | + | − | | | |
| | 4 | − | + | − | + | | | |
| | 5 | | | | | | | |

FIG. 29

| VIDEO SIGNAL | + | − |
|---|---|---|
| 0 | 0 | 0 |
| 1 | 1 | 1 |
| 2 | 3 | 2 |
| 3 | 5 | 2 |
| 4 | 6 | 3 |
| 5 | 8 | 4 |
| — | | |
| — | | |
| — | | |
| 253 | 255 | 248 |
| 254 | 255 | 249 |
| 255 | 255 | 250 |

| VIDEO SIGNAL | + | − |
|---|---|---|
| 0 | 0 | 0 |
| 1 | 1 | 1 |
| 2 | 2 | 2 |
| 3 | 4 | 3 |
| 4 | 5 | 4 |
| 5 | 6 | 4 |
| − | | |
| − | | |
| − | | |
| 253 | 254 | 250 |
| 254 | 254 | 251 |
| 255 | 255 | 253 |

DOT INVERSION 1

METHOD NOT BASED ON CSI

FOLLOWING IS AN EXAMPLE OF NON-IMAGE SIGNALS WHICH ARE IDENTICAL WITH THOSE OUTPUTTED IN DOT INVERSION 2.

FIG. 49 (a) 2H DOT INVERSION

| | | | | | | | | |
|---|---|---|---|---|---|---|---|---|
| + | − | + | − | + | − | + | − | + |
| + | − | + | − | + | − | + | − | + |
| − | + | − | + | − | + | − | + | − |
| − | + | − | + | − | + | − | + | − |
| + | − | + | − | + | − | + | − | + |
| + | − | + | − | + | − | + | − | + |
| − | + | − | + | − | + | − | + | − |
| − | + | − | + | − | + | − | + | − |

FIG. 49 (b) 2H LINE INVERSION

| | | | | | | | | |
|---|---|---|---|---|---|---|---|---|
| + | + | + | + | + | + | + | + | + |
| + | + | + | + | + | + | + | + | + |
| − | − | − | − | − | − | − | − | − |
| − | − | − | − | − | − | − | − | − |
| + | + | + | + | + | + | + | + | + |
| + | + | + | + | + | + | + | + | + |
| − | − | − | − | − | − | − | − | − |
| − | − | − | − | − | − | − | − | − |

FIG. 49 (c) 4H INVERSION

| | | | | | | | | |
|---|---|---|---|---|---|---|---|---|
| + | − | + | − | + | − | + | − | + |
| + | − | + | − | + | − | + | − | + |
| + | − | + | − | + | − | + | − | + |
| + | − | + | − | + | − | + | − | + |
| − | + | − | + | − | + | − | + | − |
| − | + | − | + | − | + | − | + | − |
| − | + | − | + | − | + | − | + | − |
| − | + | − | + | − | + | − | + | − |

LIQUID CRYSTAL DISPLAY DEVICE AND DRIVING METHOD THEREOF, TELEVISION RECEIVER, LIQUID CRYSTAL DISPLAY PROGRAM COMPUTER-READABLE STORAGE MEDIUM STORING THE LIQUID CRYSTAL DISPLAY PROGRAM, AND DRIVE CIRCUIT

TECHNICAL FIELD

The present invention relates to an active matrix type liquid crystal display device including a switching element such as a thin-film transistor, and a driving method of the liquid crystal display device. More specifically, the present invention relates to improvement in moving image display capability of the liquid crystal display device.

BACKGROUND ART

As a thin, lightweight, display device capable of high-quality image display with low power consumption, a liquid crystal display device including TFTs (Thin Film Transistors) has been used in a wide range of applications, including a personal computer, a mobile telephone, and a television set. Such a liquid crystal display device is constituted by an array substrate on which TFT elements are disposed, a counter substrate on which counter electrodes are disposed, and liquid crystal which is contained in between the array substrate and the counter substrate. In recent years, various kinds of liquid crystal display devices that realize improvement in image quality and reduction in power consumption have been proposed.

For example, the liquid crystal display device disclosed in Patent document 1 has a short circuit and serially performs writing to pixels while making adjacent signal lines short-circuited by the short circuit. With this arrangement, an electric potential of each signal line immediately before writing operation becomes an intermediate potential to which electric potentials of a positive-polarity signal and a negative-polarity signal are leveled, so that power consumption of a signal line drive circuit is reduced by half.

The liquid crystal device disclosed in Patent document 2 supplies data signals whose polarities are opposite to each other respectively to adjacent data signal lines, and makes the adjacent data signal lines short-circuited. This causes the data signal lines to converge on an intermediate potential (pre-charge potential). A load at the pre-charging is only a load of a short circuit between the data signal lines. This decreases a parasitic resistance and a parasitic capacitance and thus enables pre-charging at a high speed.

The display device disclosed in Patent document 3 has electrical charge collecting means that is controlled to make at least two output terminals short-circuited for a predetermined period every n (n is an integer not less than 2) horizontal scanning periods. The display device collects electrical charges at the time of polarity change of the output terminals so that electrical charges are reallocated via the electrical charge collecting means. This realizes improvement in display quality and reduction in power consumption.

The display device disclosed in Patent document 4 has a grayscale voltage generating circuit which supplies a plurality of voltages (first voltages) that is higher than a predetermined potential and another plurality of voltages (second voltages) that is higher than the predetermined potential, and makes odd-numbered lines of source lines and even-numbered lines of the source lines short-circuited by switching between the first voltage and the second voltage at predetermined intervals. This effectively reduces power consumption.

The liquid crystal display device disclosed in Patent document 5 separates digital/analogue converting means and output terminals by means of a separation switch in a blanking period, and makes the output terminals short-circuited by shorting means. This reduces power consumption at the reversal of a drive signal.

The drive circuit disclosed in Patent document 6 separates outputs of a source line driving section from source lines at the initial stage of writing to liquid crystal capacity, and makes the source lines short-circuited at a predetermined potential. This reduces current consumption and shortens the length of time the source lines are charged/discharged to a predetermined level.

In impulse-type display devices such as CRTs (Cathode Ray Tubes), a turn-on period in which an image is displayed and a turn-off period in which no image is displayed are alternated in each pixel. In the case of moving images, for example, human eyes do not perceive afterimage of an object because a turn-off period is provided each time an image for one screen is updated. Because of this, a background and an object are clearly distinguished and a moving image is perceived without discomfort.

On the other hand, Patent documents 1 through 6 give rise to the following problem. That is, in hold-type display devices such as liquid crystal display devices including TFTs (Thin Film Transistors), the luminance of each pixel is determined by a voltage held by each pixel capacity, and the voltage held by the pixel capacity is maintained for one frame period after update. As such, in a hold-type display device, a voltage held as pixel data by a pixel capacity is maintained until the next update. Therefore an image of each frame is temporally close to the image of the directly preceding frame. This allows human eyes to perceive an afterimage of a moving object, when a moving image is displayed. As illustrated in FIG. 59, for example, in a case an image OI indicative of an object moves in A direction (pattern movement direction), an afterimage (trailing afterimage) AI appears as if the object leaves trails.

Hold-type display devices such as active matrix type liquid crystal display device involve such a trailing afterimage AI when displaying a moving image. For this reason displays such as television receivers, which predominantly display moving images, have typically been impulse-type display devices. However, because of recent strong demands for reduction in weight and thickness of displays such as television receivers, hold-type liquid crystal display devices such as liquid crystal display devices, which allow for reduction in weight and thickness, have rapidly been used as the aforesaid displays.

As such, there has been demand for non-hold-type liquid crystal display devices that is free from the trailing image AI. As such a liquid crystal display device, Patent document 7 discloses a method for realizing impulse display in a liquid crystal display device by inserting (black insertion) a black display period in each frame period, or other means.

[Patent Document 1]

Japanese Unexamined Patent Publication No. 243998/1997 (Tokukaihei 9-243998; published on Sep. 19, 1997)

[Patent Document 2]

Japanese Unexamined Patent Publication No. 85115/1999 (Tokukaihei 11-85115; published on Mar. 30, 1999)

[Patent Document 3]

Japanese Unexamined Patent Publication No. 279626/2004 (Tokukai 2004-279626; published on Oct. 7, 2004)

[Patent Document 4]
Japanese Unexamined Patent Publication No. 121911/2005 (Tokukai 2005-121911; published on May 12, 2005)
[Patent Document 5]
Japanese Unexamined Patent Publication No. 212137/1997 (Tokukaihei 9-212137; published on Aug. 15, 1997)
[Patent Document 6]
Japanese Unexamined Patent Publication No. 30975/1999 (Tokukaihei 11-30975; published on Feb. 2, 1999)
[Patent Document 7]
Japanese Unexamined Patent Publication No. 66918/2003 (Tokukai 2003-66918; published on Mar. 5, 2003)
[Patent Document 8]
Japanese Unexamined Patent Publication No. 310113/2004 (Tokukai 2004-310113; published on Nov. 4, 2004)
[Patent Document 9]
Japanese Unexamined Patent Publication No. 175057/2002 (Tokukai 2002-175057; published on Jun. 21, 2002)

DISCLOSURE OF INVENTION

However, realization of impulse display by the method disclosed in Patent document 7 with an active matrix type liquid crystal display device as a hold-type display device give rise to the following problems: complication of a drive circuit and other components for black insertion, increase of operating frequency of a drive circuit, and shortening of a time for charging of a pixel capacity.

The present invention has been attained in view of the above problems, and an object of the present invention is to provide a liquid crystal display device which achieves impulse display while suppressing complication of a drive circuit and other components, increase of operating frequency, and reduction in charging efficiency, and a driving method of the liquid crystal display device.

In order to solve the above problems, a driving method of a liquid crystal display device according to the present invention is a driving method of an active matrix type liquid crystal display device including: a plurality of data signal lines; a plurality of scanning signal lines that intersect the data signal lines; and a plurality of pixel sections being disposed in a matrix manner at the respective intersections of the data signal lines and the scanning signal lines, each of the pixel sections receiving as a pixel value a voltage applied to the data signal line that passes through the corresponding intersection when the scanning signal line that passes through the corresponding intersection is selected, wherein the scanning signal lines are selected in an effective scanning period, and thereafter the scanning signal lines are selected, in sync with a timing of application of the non-image signals to the data signal lines, before the subsequent effective scanning period comes after a point in time when the scanning signal lines have been brought into non-selected state.

A liquid crystal display device according to the present invention is an active matrix type liquid crystal display device including: a plurality of data signal lines; a plurality of scanning signal lines that intersect the data signal lines; and a plurality of pixel sections being disposed in a matrix manner at the respective intersections of the data signal lines and the scanning signal lines, each of the pixel sections receiving as a pixel value a voltage applied to the data signal line that passes through the corresponding intersection when the scanning signal line that passes through the corresponding intersection is selected, wherein non-image signals are applied to the data signal lines at a boundary point between the adjacent horizontal scanning periods, and the scanning signal lines are selected in an effective scanning period, and thereafter the scanning signal lines are selected, in sync with a timing of application of the non-image signals to the data signal lines, before the subsequent effective scanning period comes after a point in time when the scanning signal lines have been brought into non-selected state.

The "non-image signal" refers to a signal that performs low-grayscale display and low-luminance display, including a black display signal.

According to the above arrangement, the non-image signals are applied to the data signal lines at a boundary point between the adjacent horizontal scanning periods (i.e. in between one horizontal scanning period and one horizontal scanning period that are adjacent to each other), and the scanning signal lines are selected in an effective scanning period, and thereafter the scanning signal lines are selected, in sync with the timing of application of the non-image signals to the data signal lines, before the subsequent effective scanning period comes after a point in time when the scanning signal lines have been brought into non-selected state.

The wording "before the subsequent effective scanning period comes after a point in time when the scanning signal lines have been brought into non-selected state" refers to a period between an effective scanning period and an effective scanning period. That is, non-image display is performed by applying the non-image signals to the data signal lines in the period (non-effective scanning period) between effective scanning periods. The "effective scanning period" refers to a period corresponding to a display period of horizontal scanning periods. More specifically, the "effective scanning period" means a period in which a pixel data write pulse is in High level on the scanning signal line and an image signal corresponding to a pixel on the data signal line is selected. Therefore, it is unnecessary to provide a drive circuit for non-image display, and it is possible to realize impulse display without shortening a charging time of a pixel capacity for pixel value writing. As a result, it is possible to enhance moving image display capability of a liquid crystal display device. In addition, it is unnecessary to increase an operating speed of data line drive circuit and other circuits for non-image display.

As such, it is possible to provide a driving method of a liquid crystal display device which realizes impulse display while suppressing complication of a drive circuit and other components and increase of operating frequency of a drive circuit.

Further, a driving method of a liquid crystal display device according to the present invention is preferably a driving method of a liquid crystal display device of vertical alignment mode in which a direction where liquid crystal molecules are aligned is controlled by an electric field, and the non-image signal is a pre-tilt signal by which the liquid crystal molecules are pre-tilted.

Still further, a liquid crystal display device according to the present invention is preferably a liquid crystal display device of vertical alignment mode in which a direction where liquid crystal molecules are aligned is controlled by an electric field, and the non-image signal is a pre-tilt signal by which the liquid crystal molecules are pre-tilted.

According to the above arrangement, it is possible to easily generate a pre-tilt signal without the need for the grayscale signal driving section that generates a pre-tilt signal as disclosed in Patent document 8, and without performing a special calculation operation.

In writing the above non-image signal, lowering the potential of the non-image signal until liquid crystal molecules in the vertical alignment mode (VA mode) are vertically aligned can cause an abnormal response in several frames.

That is, the lower the voltage at the writing of low-grayscale display and low-luminance display including black display to the pixel section by using the non-image signal, the more vertically liquid crystal molecules tilt. In this vertically aligned state, when a voltage for formal writing is applied, an angle at which the liquid crystal molecules tilt can be controlled by the magnitude of an applied voltage, but which direction (horizontal direction) the liquid crystal molecules tilt cannot be controlled.

In this case, the liquid crystal molecules temporarily shift to an energetically stable alignment state at that point in time, and thereafter move in a correct horizontal direction while avoiding collision with each other. Therefore, it takes time for the liquid crystal molecules to reach a desired alignment state (transmittance), i.e. to reach an intended grayscale level, which causes an abnormal response in several frames. If the abnormal response in several frames occurs, trailing occurs.

On the contrary, according to the above arrangement, the non-image signal is a pre-tilt signal for making the liquid crystal molecules pre-tilted. This changes the liquid crystal molecules from a vertically aligned state to a tilted state. That is, a voltage at the time of writing low-grayscale display and low-luminance display including black display is higher by a pre-tilt angle than a voltage applied when the liquid crystal molecules are vertically aligned completely. Application of a voltage in a state where the liquid crystal molecules are tilted by the pre-tilt angle can reduce a time elapsed until the liquid crystal molecules tilt in a desired horizontal direction and transmittance comes close to an intended value. As such, it is possible to prevent the occurrence of an abnormal response and improve trailing.

Further, a driving method of a liquid crystal display device according to the present invention is preferably such that in a case where display luminance T when white luminance level is 1 and black luminance level is 0 is nearly close to $T=(L/Lw)^{\gamma}$ where L is display grayscale level, Lw is white display grayscale, and γ is γ characteristics, the pre-tilt signal is a signal indicating $Lw\times10^{(-3/\gamma)}$ or greater.

Still further, a liquid crystal display device according to the present invention is preferably such that in a case where display luminance T when white luminance level is 1 and black luminance level is 0 is nearly close to $T=(L/Lw)^{\gamma}$ where L is display grayscale level, Lw is white display grayscale, and γ is γ characteristics, the pre-tilt signal is a signal indicating $Lw\times10^{(-3/\gamma)}$ or greater.

In a case where display luminance T when white luminance level is 1 and black luminance level is 0 is nearly close to $T=(L/Lw)^{\gamma}$ where L is display grayscale level, Lw is white display grayscale, and γ is γ characteristics, the pre-tilt signal is a signal indicating $Lw\times10^{(-3/\gamma)}$ or greater. With this arrangement, the inventors of the present invention can improve trailing afterimage.

Further, a driving method of a liquid crystal display device according to the present invention is preferably such that regarding γ indicating γ characteristics, display grayscale L is defined as: $L=255\times T^{(1/2.2)}$ where T is display luminance when white luminance level is 1 and black luminance level is 0, and the pre-tilt signal is a signal that generates a grayscale voltage higher than a grayscale voltage obtained when L=12.

Still further, a liquid crystal display device according to the present invention is preferably such that regarding γ indicating γ characteristics, display grayscale L is defined as: $L=255\times T^{(1/2.2)}$ where T is display luminance when white luminance level is 1 and black luminance level is 0, and the pre-tilt signal is a signal that generates a grayscale voltage higher than a grayscale voltage obtained when L=12.

Regarding γ indicating γ characteristics, display grayscale L is defined as: $L=255\times T^{(1/2.2)}$ where T is display luminance when white luminance level is 1 and black luminance level is 0, and the pre-tilt signal is a signal that generates a grayscale voltage higher than a grayscale voltage obtained when L=12. With this arrangement, the inventors of the present invention can improve trailing afterimage.

Further, a driving method of a liquid crystal display device according to the present invention is preferably such that the pre-tilt signal is a signal indicating γ characteristics of 2.2 and 12th grayscale level or higher level out of 256 display grayscale levels. Still further, a liquid crystal display device according to the present invention is preferably such that the pre-tilt signal is a signal indicating γ characteristics of 2.2 and 12th grayscale level or higher level out of 256 display grayscale levels.

The inventors of the present invention can improve trailing afterimage if the pre-tilt signal is a signal indicating γ characteristics of 2.2 and 12th grayscale level or higher level out of 256 display grayscale levels.

Further, a driving method of a liquid crystal display device according to the present invention is preferably such that the pre-tilt signal is a signal indicating γ characteristics of 2.2 and 45th grayscale level or higher level out of 1024 display grayscale levels. Still further, a liquid crystal display device according to the present invention is preferably such that the pre-tilt signal is a signal indicating γ characteristics of 2.2 and 45th grayscale level or higher level out of 1024 display grayscale levels.

The inventors of the present invention can improve trailing afterimage if the pre-tilt signal is a signal indicating γ characteristics of 2.2 and 45th grayscale level or higher level out of 1024 display grayscale levels.

Further, a driving method of a liquid crystal display device according to the present invention is preferably such that when luminance level of white display is 100% and luminance level of black display is 0%, luminance level of the pre-tilt signal is not less than 0.1%.

Still further, a liquid crystal display device according to the present invention is preferably such that when luminance level of white display is 100% and luminance level of black display is 0%, luminance level of the pre-tilt signal is not less than 0.1%.

As a result of diligent study, the inventors of the present invention can improve trailing after image by making luminance level of the pre-tilt signal to be not less than 0.1% when luminance level of white display is 100% and luminance level of black display is 0%.

Further, a driving method of a liquid crystal display device according to the present invention is preferably such that application of the non-image signals to the data signal lines is performed with adjacent data signal lines short-circuited to each other.

Still further, a liquid crystal display device according to the present invention is preferably such that the adjacent data signal lines are connected capable of being short-circuited to each other, and application of the non-image signals to the data signal lines is performed with the data signal lines short-circuited.

According to the above arrangement, application of the non-image signals to the data signal lines is performed with the adjacent data signal lines short-circuited to each other. That is, the non-image signals are applied to data with the adjacent data signal lines short-circuited at the polarity reversal of the data signals. Therefore, it is possible to reduce power consumption.

Further, a driving method of a liquid crystal display device according to the present invention is preferably such that application of the non-image signals to the data signal lines is performed by application of a fixed voltage to each of the data signal lines.

Still further, a liquid crystal display device according to the present invention preferably further includes a fixed voltage power source that applies the non-image signals to the data signal lines by applying a common fixed voltage to the data signal lines.

In a feed through voltage generated due to a parasitic capacity inside a pixel section, there is difference between a pixel voltage for display of a high luminance pixel and a pixel voltage for display of a low luminance pixel. A voltage generated with the adjacent data signal lines short-circuited to each other (voltage applying the non-image signal; also referred to as "charge share voltage") varies depending upon a display grayscale level. This gives rise to the problem that a shadow of a pattern to be displayed can be visually identified depending upon the pattern.

On the contrary, the non-image signals are applied by applying a fixed voltage in the above arrangement. This allows the voltages of the data signal lines to be kept the same all the time, thus improving the problem that a shadow of a pattern to be displayed is visually identified.

Further, a driving method of a liquid crystal display device according to the present invention is preferably such that each of the non-image signals is a voltage that exists between voltages whose polarities are opposite to each other, and application of the non-image signal to the data signal lines is performed at polarity reversal of a data signal.

Still further, a liquid crystal display device according to the present invention is preferably such that each of the non-image signals is a voltage that exists between voltages whose polarities are opposite to each other, and application of the non-image signal to the data signal lines is performed at polarity reversal of a data signal.

According to the above arrangement, each of the non-image signals is a voltage that exists between voltages whose polarities are opposite to each other, and application of the non-image signal to the data signal lines is performed at polarity reversal of a data signal. Therefore, the non-image signal can be applied in sync with the timing of the polarity reversal in the so-called dot inversion driving. This makes it possible to simplify a circuit.

Further, a driving method of a liquid crystal display device according to the present invention is preferably such that at a time when a polarity of a signal on the data signal line is reversed in each horizontal scanning period, the number of times the scanning signal line is selected in sync with the timing of application of the non-image signal to the data signal line is an even-number.

Still further, a liquid crystal display device according to the present invention is preferably such that at a time when a polarity of a signal on the data signal line is reversed in each horizontal scanning period, the number of times the scanning signal line is selected in sync with the timing of application of the non-image signal to the data signal line is an even-number.

According to the above arrangement, it is possible to make identical, on each of the scanning signal lines, the number of times the non-image signal is selected during a negative-to-positive reversal with the number of times the non-image signal is selected during a positive-to-negative reversal. This makes it possible to provide a driving method of a liquid crystal display device which realizes impulse display while reducing the difference in charging rate between the adjacent pixels and improving display unevenness that occurs on each scanning line.

Note that it is more preferable that the non-image signal is selected every consecutive horizontal periods. Since the polarity of the image signal is reversed in each horizontal period, it is possible to make identical the properties of the applied non-image signals on the adjacent scanning lines. That is, it is possible to eliminate a polarity bias.

Further, a driving method of a liquid crystal display device according to the present invention is preferably such that application of the non-image signals to the data signal lines is performed by application of a voltage whose polarity is reversed in each vertical scanning period commonly to the data signal lines.

Still further, a liquid crystal display device according to the present invention preferably further includes: a first polarity reversal power source that applies the non-image signals to the data signal lines by applying a voltage whose polarity is reversed in each vertical scanning period commonly to the data signal lines.

According to the above arrangement, in addition to the effect caused by application of the fixed voltage commonly to the data signal lines, the polarity of the non-image signal applied to each of the data signal lines is reversed in each vertical scanning period. This makes it possible to prevent the occurrence of screen burn-in.

Further, a driving method of a liquid crystal display device according to the present invention is preferably such that application of the non-image signals to the data signal lines is performed by application of a voltage whose polarity is reversed in each horizontal scanning period.

Still further, a liquid crystal display device according to the present invention preferably further includes: a second polarity reversal power source that applies the non-image signals to the data signal lines by applying a voltage whose polarity is reversed in each horizontal scanning period commonly to the data signal lines.

According to the above arrangement, in addition to the effect caused by application of the fixed voltage commonly to the data signal lines, the polarity of the non-image signal applied to each of the data signal lines is reversed in each vertical scanning period. This makes it possible to prevent the occurrence of screen burn-in.

Further, a driving method of a liquid crystal display device according to the present invention is preferably such that application of the non-image signals to the data signal lines is performed with the adjacent data signal lines short-circuited to each other by application of voltages whose polarities are reversed in each horizontal scanning period, the voltages on the adjacent data signal lines being opposite in polarity to each other.

Still further, a liquid crystal display device according to the present invention is preferably such that: the second polarity reversal power source applies the non-image signals commonly to the data signal lines by applying voltages whose polarities are reversed in each horizontal scanning period, the voltages on the adjacent data signal lines being opposite in polarity to each other.

According to the above arrangement, driving can be performed by the so-called dot inversion driving. This makes it possible to prevent the occurrence of screen burn-in and flicker.

Further, a driving method of a liquid crystal display device according to the present invention is preferably such that a polarity of a voltage corresponding to the non-image signal is identical with a polarity of a voltage corresponding to an image signal in a horizontal scanning period immediately after application of the non-image signal.

Still further, a liquid crystal display device according to the present invention is preferably such that: a polarity of a voltage corresponding to the non-image signal is identical with a polarity of a voltage corresponding to an image signal in a horizontal scanning period immediately after application of the non-image signal.

According to the above arrangement, the polarity of the non-image signal is made identical with the polarity of the data signal in the following horizontal scanning period. This is advantageous in increasing a charging rate.

Further, a driving method of a liquid crystal display device according to the present invention is preferably such that a polarity of a non-image signal selected at the end of one vertical scanning period and applied to the pixel section is identical with a polarity of an image signal selected in a subsequent vertical scanning period.

Still further, a liquid crystal display device according to the present invention is preferably such that a polarity of a non-image signal selected at the end of one vertical scanning period and applied to the pixel section is identical with a polarity of an image signal selected in a subsequent vertical scanning period.

According to the above arrangement, it is advantageous in increasing a charging rate of a pixel that the polarity of the image signal applied to the pixel section in the subsequent vertical scanning period (frame) is identical with the polarity of the last non-image signal (pre-tilt signal) applied to the pixel section in the preceding vertical scanning period (frame).

Further, a driving method of a liquid crystal display device according to the present invention is preferably such that a polarity of a signal on the data signal line is reversed every plural horizontal scanning periods.

Still further, a liquid crystal display device according to the present invention is preferably such that a polarity of a signal on the data signal line is reversed every plural horizontal scanning periods.

According to the above arrangement, as compared with the arrangement in which the polarity of the data signal is reversed in each horizontal scanning period, killer pattern caused by flicker or the like phenomenon is less likely to occur, for example, in a checked dot screen of an end screen in Microsoft's OS, Windows®, of a personal computer, a screen of dithering in which a halftone of luminance that cannot be expressed by one dot is expressed by a combination of several pixels (tile pattern).

Note that it is preferable that the polarity of the non-image signal is made identical with the polarity of the data signal in the subsequent horizontal scanning period. This is advantageous in increasing a charging rate.

Further, a driving method of a liquid crystal display device according to the present invention is preferably such that the non-image signal is applied to the data signal line when a polarity of a data signal is not reversed in between adjacent horizontal periods.

Still further, a liquid crystal display device according to the present invention is preferably such that the non-image signal is applied to the data signal line when a polarity of a data signal is not reversed in between adjacent horizontal periods.

According to the above arrangement, it is possible to apply the non-image signal with the scanning signal line selected in each horizontal scanning period even in a case where the polarity of data signal is reversed every plural horizontal scanning periods. That is, the non-image signal is applied not only when the polarity of a signal on the data signal line is reversed but also when the polarity is not reversed. This makes it easy to adjust timings and total time of the start and end of application of the non-image signal to a pixel on each of the scanning signal lines. In addition, application of the non-image signal when the polarity is not reversed makes it easy to agree a charging rate in a horizontal scanning period immediately after the polarity reversal with a charging rate of a horizontal scanning period in the subsequent horizontal scanning period. This makes it possible to prevent unevenness (e.g. unevenness that occurs every two scanning lines in 2H reversal) that can occur every plural horizontal scanning periods.

Note that in the above arrangement it is preferable that the number of times the non-image signal supplied when the polarity of the data signal on the data signal line is reversed is selected is equal on each of the scanning signal lines. Further, it is preferable that the number of times the non-image signal supplied when the polarity of the data signal on the data signal line is not reversed is selected is equal on each of the scanning signal lines.

For this reason, a driving method of a liquid crystal display device according to the present invention is preferably such that at a time when the polarity of the signal on the data signal line is reversed every n-number (n is an integer not less than 2) of horizontal scanning periods, the number of times the scanning signal line is selected in sync with the timing of application of the non-image signal to the data signal line is a multiple number of n.

Further, a liquid crystal display device according to the present invention is preferably such that at a time when the polarity of the signal on the data signal line is reversed every n-number (n is an integer not less than 2) of horizontal scanning periods, the number of times the scanning signal line is selected in sync with the timing of application of the non-image signal to the data signal line is a multiple number of n.

According to the above arrangement, it is possible to agree the number of non-image signals applied at the time when the polarity reversal is performed with the number of non-image signals applied at the time when the polarity reversal is not performed, on the adjacent scanning lines. This makes it possible to provide a liquid crystal display device which realizes impulse display while reducing the difference in charging rate between the adjacent pixels and improving display unevenness that occurs on each scanning line.

Note that it is more preferable that the non-image signal is selected every consecutive horizontal periods. According to this arrangement, the number of polarity reversals of the image signal and the number of non-polarity reversals of the image signal in n-number of horizontal periods are constant on each of the scanning lines. This makes it possible to make identical the properties of the applied non-image signals on the adjacent scanning lines.

Further, a driving method of a liquid crystal display device according to the present invention is preferably such that the number of times the scanning signal line is selected in sync with the timing of application of the non-image signal to the data signal line is a multiple number of 2n.

Still further, a liquid crystal display device according to the present invention is preferably such that the number of times the scanning signal line is selected in sync with the timing of application of the non-image signal to the data signal line is a multiple number of 2n.

According to the above arrangement, it is possible to make identical the number of times the non-image signal is selected during a negative-to-positive reversal with the number of times the non-image signal is selected during a positive-to-negative reversal, in a case where the polarity of the data signal is reversed on each of the scanning signal lines. In addition, it is possible to make identical the number of times the non-image signal is selected between positive polarity periods with the number of times the non-image signal is selected between negative polarity periods, in a case where the polarity of the data signal is reversed on each of the scanning signal lines. This makes it possible to reduce the difference in charging rate between the adjacent pixels and improve unevenness that occurs on each scanning line.

Note that it is more preferable that the non-image signal is selected every consecutive horizontal periods. According to this, since the polarity of the image signal is reversed every 2n-number of horizontal periods, it is possible to make identical the properties of the applied non-image signals on the adjacent scanning lines. That is, it is possible to eliminate a polarity bias.

Further, a driving method of a liquid crystal display device according to the present invention is preferably such that application of the non-image signals to the data signal lines is performed by application of fixed voltages to each of the data signal lines, and polarities of the fixed voltages are reversed every plural horizontal scanning periods.

Still further, a liquid crystal display device according to the present invention preferably further includes: a third polarity reversal power source that applies the non-image signals to the data signal lines by applying a voltage whose polarity is reversed every plural horizontal scanning periods to the data signal lines.

According to the above arrangement, in addition to the effect caused by application of the fixed voltages to the data signal lines, the polarity of the non-image signal applied to each of the data signal lines is reversed every plural horizontal scanning periods. This makes it possible to prevent the occurrence of screen burn-in.

Further, a driving method of a liquid crystal display device according to the present invention is preferably such that the fixed voltages are voltages whose polarities are reversed every plural horizontal scanning periods, and the fixed voltages applied on the adjacent data signal lines are opposite in polarity to each other.

Still further, a liquid crystal display device according to the present invention preferably further includes: the third polarity reversal power source applies the non-image signals to the data signal lines by applying to the data signal lines voltages whose polarities are reversed every plural horizontal scanning periods, the voltages on the adjacent data signal lines being opposite in polarity to each other.

According to the above arrangement, driving can be performed by the so-called dot inversion driving. This makes it possible to prevent the occurrence of screen burn-in and flicker.

Further, a driving method of a liquid crystal display device according to the present invention is preferably such that the liquid crystal display device performs overshoot driving, and amounts of grayscale correction in the overshoot driving are found in accordance with polarities of pixels and video signals obtained from an external entity.

Still further, a liquid crystal display device according to the present invention preferably further includes: polarity information detecting means that detects pieces of polarity information of the pixels; and correction amount calculating means that finds the amounts of grayscale correction in overshoot driving in accordance with the polarity information and video signals obtained from an external entity.

Generally, overshoot driving is performed in accordance with an appropriate amount of grayscale correction (amount of OS) which is calculated from a start grayscale level and a target grayscale level. Further, in order to find the amount of grayscale correction, it is necessary to constitute a special correction algorithm in consideration of which direction a liquid crystal molecule tilts is uncertain in a case where a pre-tilt angle of the liquid crystal molecule is extremely small. This increases a circuit size or gives rise to the problem of difficulty of calculation in real time. On the contrary, according to the above arrangement, the amounts of grayscale correction for use in the overshoot driving are found in accordance with the polarities of the pixels and the video signals obtained from the external entity. Therefore, it is possible to find the amount of grayscale correction without using a special correction algorithm and to use the existing overshoot driving without a significant change.

Further, a driving method of a liquid crystal display device according to the present invention is preferably such that the amounts of grayscale correction for use in the overshoot driving are found by using a lookup table in which the polarities of the pixels and the video signals obtained from the external entity are associated with each other.

Still further, a liquid crystal display device according to the present invention preferably further includes: a lookup table in which the polarities of the pixels and the video signals obtained from the external entity are associated with each other.

According to the above arrangement, it is possible to find the amount of grayscale correction only by referring to the lookup table on the basis of the polarity of the pixel and the video signal obtained from the external entity.

Further, a driving method of a liquid crystal display device according to the present invention is preferably such that the liquid crystal display device has a backlight, and the backlight is turned off in sync with a timing of application of the non-image signal to the data signal line.

In a case where the non-image signal is applied to the data signal line, a potential thereof leads to increase of luminance, and thus gives rise to the problem of a graying of black level. When the backlight is turned off as described above, it is possible to prevent the graying of black level from being identified.

Further, a driving method of a liquid crystal display device according to the present invention is preferably such that a duration of application of the non-image signal to the data signal line is shorter than a duration of application of an image signal for image display which signal is applied to the data signal lines.

Still further, a liquid crystal display device according to the present invention is preferably such that a duration of application of the non-image signal to the data signal line is shorter than a duration of application of an image signal for image display which signal is applied to the data signal.

Patent document 9 discloses the liquid crystal display device in which each of the gate lines (scanning signal lines) is selected at least twice in each frame periods, and (i) a deletion voltage for making the states of the pixels identical and (ii) a grayscale voltage corresponding to an image to be displayed are written each at least once. With this liquid crystal display device, it is possible to obtain an excellent moving image display while suppressing an after image of the displayed image. However, in this liquid crystal display device, a voltage supplied to the source line is switched between a grayscale voltage based on an image signal and a black voltage, and a duration of period during which each of the gate lines is selected for application of the grayscale voltage is half a time obtained by division of one frame period by the number of gate lines. As such, a short time for charging of a pixel capacity by the grayscale voltage may cause insufficient charging.

In view of this, by making the duration of application of the non-image signal applied to the data signal line shorter than the duration of application of the image signal as in the above arrangement, it is possible to realize impulse display while suppressing insufficient charging of the image signal in each of the pixels. Especially, the above arrangement is suitable (a) at the increase in load on the data signal lines and others due to upsizing of a screen size and high definition and (b) at the reduction of the duration of application of the image signal in a case where improvement in moving image identification is further performed by increase of a frame frequency.

Further, a driving method of a liquid crystal display device according to the present invention is preferably such that the liquid crystal display device is a liquid crystal display device of normally black mode in which black display is performed in a state where no voltage is applied.

Still further, a liquid crystal display device according to the present invention is preferably such that the liquid crystal display device is a liquid crystal display device of normally black mode in which black display is performed in a state where no voltage is applied.

According to the above arrangement, the liquid crystal display device is a liquid crystal display device of normally black mode. For example, this makes it possible to easily perform black insertion display in a case where the non-image signal is a charge share potential, and to constitute a display device that is advantageous in terms of power consumption.

Further, a liquid crystal display program of the present invention is preferably a liquid crystal display program for operating the above liquid crystal display device, the program causing a computer to function as the polarity information detecting means and the correction amount calculating means.

Still further, a computer-readable storage medium of the present invention is preferably a computer-readable storage medium storing the above liquid crystal display program.

Yet further, a television receiver of the present invention is preferably a television receiver including: the above liquid crystal display device; and a tuner section that receives a television broadcast.

In order to solve the above problem, a drive circuit of the present invention is a drive circuit for use in an active matrix type liquid crystal display device including: a plurality of data signal lines; a plurality of scanning signal lines that intersect the data signal lines; and a plurality of pixel sections being disposed in a matrix manner at the respective intersections of the data signal lines and the scanning signal lines, each of the pixel sections receiving as a pixel value a voltage applied to the data signal line that passes through the corresponding intersection when the scanning signal line that passes through the corresponding intersection is selected, wherein non-image signals are applied to the data signal lines at a boundary point between the adjacent horizontal scanning periods, and the scanning signal lines are selected in an effective scanning period, and thereafter the scanning signal lines are selected, in sync with a timing of application of the non-image signals to the data signal lines, before the subsequent effective scanning period comes after a point in time when the scanning signal lines have been brought into non-selected state.

According to the above arrangement, the non-image signals are applied to the data signal lines at a boundary point between the adjacent horizontal scanning periods, and the scanning signal lines are selected in an effective scanning period, and thereafter the scanning signal lines are selected in sync with the timing of application of the non-image signals to the data signal lines before the subsequent effective scanning period comes after a point in time when the scanning signal lines have been brought into non-selected state.

That is, non-image display is performed by applying the non-image signals to the data signal lines in the period (non-effective scanning period) between effective scanning periods. The "effective scanning period" refers to a period corresponding to a display period of horizontal scanning periods. More specifically, the "effective scanning period" means a period in which a pixel data write pulse is in High level on the scanning signal line. Therefore, it is unnecessary to provide a drive circuit for non-image display, and it is possible to realize impulse display without shortening a charging time of a pixel capacity for pixel value writing. As a result, it is possible to enhance moving image display capability of a liquid crystal display device. In addition, it is unnecessary to increase an operating speed of data line drive circuit and other circuits for non-image display.

As such, with the use of the drive circuit of the present invention, it is possible to realize a liquid crystal display device which realizes impulse display while suppressing complication of a drive circuit and other components and increase of operating frequency of a drive circuit.

Further, in order to solve the above problem, a drive circuit of the present invention is a drive circuit for use in an active matrix type liquid crystal display device, the drive circuit supplying data signals to data signal lines, the liquid crystal display device comprising: a plurality of data signal lines; a plurality of scanning signal lines that intersect the data signal lines; and a plurality of pixel sections being disposed in a matrix manner at the respective intersections of the data signal lines and the scanning signal lines, each of the pixel sections receiving as a pixel value a voltage applied to the data signal line that passes through the corresponding intersection when the scanning signal line that passes through the corresponding intersection is selected, the drive circuit including: a first polarity reversal power source being connected to the data signal lines and capable of generating voltages whose polarities are reversed, the first polarity reversal power source generating voltages whose polarities are reversed in each vertical scanning period in sync with the timing of supply of a gate start pulse signal to the first polarity reversal power source, and applying the thus generated voltages as non-image signals respectively to the data signal lines at polarity reversal of the data signals.

The gate start pulse signal is a signal that is generated by a display control circuit of the liquid crystal display device to start an operation of a shift register of a gate driver.

According to the above arrangement, the drive circuit includes the first polarity reversal power source that reverses a voltage applied as the non-image signal to the data signal line in each vertical scanning period. That is, a voltage applied to the data signal line is reversed for each frame. Therefore, it is possible to prevent the occurrence of screen burn-in caused by application of voltages of one-side polarity.

Further, in order to solve the above problem, a drive circuit of the present invention is a drive circuit for use in an active matrix type liquid crystal display device, the drive circuit supplying video signals to data signal lines, the liquid crystal display device comprising: a plurality of data signal lines; a plurality of scanning signal lines that intersect the data signal lines; and a plurality of pixel sections being disposed in a matrix manner at the respective intersections of the data signal lines and the scanning signal lines, each of the pixel sections receiving as a pixel value a voltage applied to the data signal line that passes through the corresponding intersection when the scanning signal line that passes through the corresponding intersection is selected, the drive circuit including: a second polarity reversal power source being connected to the data signal lines and capable of generating voltages whose polarities are reversed, the second polarity reversal power source generating voltages whose polarities are reversed in each horizontal scanning period in sync with a timing of supply of a gate clock signal to the second polarity reversal power source, and applying the thus generated voltages as non-image signals respectively to the data signal lines at polarity reversal of data signals.

The gate clock signal is a signal generated by the display control circuit of the liquid crystal display device to control the timing of a shift operation of a shift register of a gate driver.

According to the above arrangement, the drive circuit includes the second polarity reversal power source capable of generating voltages which are applied as the non-image signals to the data signal lines and whose polarities are reversed in each horizontal scanning period. That is, a voltage applied to the data signal line is reversed for each line. Therefore, it is possible to prevent the occurrence of screen burn-in caused by application of voltages of one-side polarity Further, in order to solve the above problem, a drive circuit of the present invention is a drive circuit for use in an active matrix type liquid crystal display device, the drive circuit supplying video signals to data signal lines, the liquid crystal display device comprising: a plurality of data signal lines; a plurality of scanning signal lines that intersect the data signal lines; and a plurality of pixel sections being disposed in a matrix manner at the respective intersections of the data signal lines and the scanning signal lines, each of the pixel sections receiving as a pixel value a voltage applied to the data signal line that passes through the corresponding intersection when the scanning signal line that passes through the corresponding intersection is selected, the drive circuit including: a second polarity reversal power source being connected to the data signal lines and capable of generating voltages whose polarities are reversed, the second polarity reversal power source generating voltages whose polarities are reversed in each horizontal scanning period in sync with a timing of supply of a gate clock signal to the second polarity reversal power source, and applying the thus generated voltages as non-image signals respectively to odd-numbered lines of the data signal lines at polarity reversal of data signals while applying voltages which are opposite in polarity to the thus generated voltages as the non-image signals respectively to even-numbered lines of the data signal lines at polarity reversal of data signals.

According to the above arrangement, the drive circuit includes the second polarity reversal power source that applies the thus generated voltages as non-image signals respectively to odd-numbered lines of the data signal lines at polarity reversal of data signals, while applying voltages which are opposite in polarity to the thus generated voltages as the non-image signals respectively to even-numbered lines of the data signal lines at polarity reversal of data signals. That is, a voltage applied to the data signal line is reversed for each dot. Therefore, it is possible to prevent the occurrence of screen burn-in caused by application of voltages of one-side polarity and to prevent the occurrence of flicker.

Further, in order to solve the above problem, a drive circuit of the present invention is a drive circuit supplying video signals to a plurality of data signal lines, including: a constant-voltage diodes being connected respectively to the data signal lines; and a fixed voltage power source, connected to the data signal lines via the respective constant-voltage diodes, applying a common fixed voltage as an non-image signal to the data signal lines at polarity reversal of data signals. According to the above arrangement, the fixed voltage power source is connected to the data signal lines via the constant-voltage diodes, respectively. Since voltages can be accumulated in the constant-voltage diodes, it is possible to realize voltage reversal for each dot with a simpler structure.

Further, in order to solve the above problem, a drive circuit of the present invention is a drive circuit supplying video signals to a plurality of data signal lines, including: a third polarity reversal power source being connected to the data signal lines and capable of generating voltages whose polarities are reversed, the third polarity reversal power source generating voltages whose polarities are reversed every plural horizontal scanning periods, and applying the thus generated voltages as non-image signals respectively to the data signal lines.

The polarities of the voltages are reversed in sync with a timing of supply of the reverse signal to the third polarity reversal power source, the reverse signal being a signal for determining polarity reversal.

According to the above arrangement, the drive circuit includes the third polarity reversal power source capable of generating voltages which are applied as the non-image signals to the data signal lines and whose polarities are reversed every plural horizontal scanning periods. That is, a voltage applied to the data signal line is reversed for each line. Therefore, it is possible to prevent the occurrence of screen burn-in caused by application of voltages of one-side polarity.

Further, a drive circuit of the present invention is preferably such that the third polarity reversal power source generates voltages whose polarities are reversed every plural horizontal scanning periods, and applies the thus generated voltages as non-image signals respectively to odd-numbered data signal lines of the data signal lines while applying voltages which are opposite in polarity to the thus generated voltages as the non-image signals respectively to even-numbered data signal lines of the data signal lines.

According to the above arrangement, the drive circuit includes the third polarity reversal power source that applies the thus generated voltages as non-image signals respectively to odd-numbered data signal lines while applying voltages which are opposite in polarity to the thus generated voltages as the non-image signals respectively to even-numbered data signal lines. That is, a voltage applied to the data signal line is reversed for each dot. Therefore, it is possible to prevent the occurrence of screen burn-in caused by application of voltages of one-side polarity and to prevent the occurrence of flicker.

Further, a driving method of a liquid crystal display device according to the present invention is a driving method of an active matrix type liquid crystal display device including: a plurality of data signal lines; a plurality of scanning signal lines that intersect the data signal lines; and a plurality of pixel sections being disposed in a matrix manner at the respective intersections of the data signal lines and the scanning signal lines, each of the pixel sections receiving as a pixel value a voltage applied to the data signal line that passes through the corresponding intersection when the scanning signal line that passes through the corresponding intersection is selected, wherein a non-image signal is applied to the data signal lines at a boundary point between adjacent horizontal scanning periods, the non-image signal being identical in voltage polarity with an image signal applied in the latter horizontal scanning period of the adjacent horizontal scanning periods.

According to the above arrangement, a voltage polarity of the non-image signal applied to the data signal lines at a boundary point between the adjacent horizontal scanning periods is identical with a voltage polarity of the image signal applied in the latter horizontal scanning period of the adjacent horizontal scanning periods. This is advantageous in increasing a charging rate of a pixel.

Further, a liquid crystal display device of the present invention may be driven by using the above driving method. This is advantageous in increasing a charging rate of a pixel.

Additional objects, features, and strengths of the present invention will be made clear by the description below. Further, the advantages of the present invention will be evident from the following explanation in reference to the drawings.

BRIEF DESCRIPTION OF DRAWINGS

FIG. 5(*b*) is a block diagram illustrating the configuration of a gate driver IC chip illustrated in FIG. 5(*a*).

FIG. 13(*b*) is a schematic view illustrating an alignment state of liquid crystal molecules in a case where a high voltage is applied in the state of FIG. 13(*a*).

FIG. 17(*b*) is a graph showing a grayscale change from black to lighting state and a grayscale change from black writing to lighting state.

FIG. 18(*b*) is a graph showing a grayscale change from black to lighting state and a grayscale change from black writing to lighting state in charge share impulse driving.

FIG. 20(*b*) is a graph showing a grayscale change from black to lighting state and a grayscale change from black writing to lighting state when a desired luminance and the range of grayscale levels are as shown in FIG. 19, corresponding to FIG. 18(*b*).

FIG. 28 is a view showing a relationship between polarity information of a pixel and an address that is positional information.

FIG. 29 is a view showing the structure of a LUT illustrated in FIG. 27.

FIG. 49(*a*) is a view schematically showing 2H dot inversion.

FIG. 49(*b*) is a view schematically showing 2H line inversion.

FIG. 49(*c*) is a view schematically showing 4H dot inversion.

FIG. 57(*b*) is a waveform diagram showing waveforms of data signals in a case where the polarity of a non-image signal is identical with the polarity of a subsequent data signal and in a case where the polarity of the non-image signal is different from the polarity of the subsequent data signal.

FIG. 57(*c*) is a waveform diagram showing actual waveforms in the cases of FIGS. 57(*a*) and 57(*b*), wherein a solid line represents an actual waveform in the case of FIG. 57(*a*) and a broken line represents an actual waveform in the case of FIG. 57(*b*).

FIG. 58(*b*) is a waveform diagram showing waveforms of data signals in a case where the polarity of a non-image signal is identical with the polarity of a subsequent data signal and in a case where the polarity of the non-image signal is different from the polarity of the subsequent data signal, in First Embodiment.

FIG. 58(*c*) is a waveform diagram showing actual waveforms in the cases of FIGS. 58(*a*) and 58(*b*), wherein a solid line represents an actual waveform in the case of FIG. 58(*a*) and a broken line represents an actual waveform in the case of FIG. 58(*b*).

EXPLANATION OF REFERENCE NUMERALS

| | |
|---|---|
| 3 | source driver (drive circuit) |
| 5 | pixel formation section |
| 20 | liquid crystal molecule |
| 35 | charge share voltage fixing-use power source (fixed voltage power source) |
| 51 | polarity information processing section (polarity information detecting means) |
| 53 | correction amount calculating section (correction amount calculating means) |
| 54 | LUT (lookup table) |
| 82a-82h | fluorescent lamp (backlight) |
| 99 | tuner section |
| 100 | first polarity reversal power source |
| 103 | second polarity reversal power source |
| 113 | third polarity reversal power source |
| 108 | constant-voltage diode |
| 200 | display device (liquid crystal display device) |
| Dv | video signal |
| Eshp | fixed voltage |
| SL1-SLn | source lines (data signal lines) |
| GL1-GLm | gate lines (scanning signal lines) |
| S(1)-S(n) | data signals |
| GSP | gate start pulse signal |
| GCK | gate clock signal |

BEST MODE FOR CARRYING OUT THE INVENTION

First Embodiment

The following will describe an embodiment of the present invention with reference to drawings.

Figure 2:
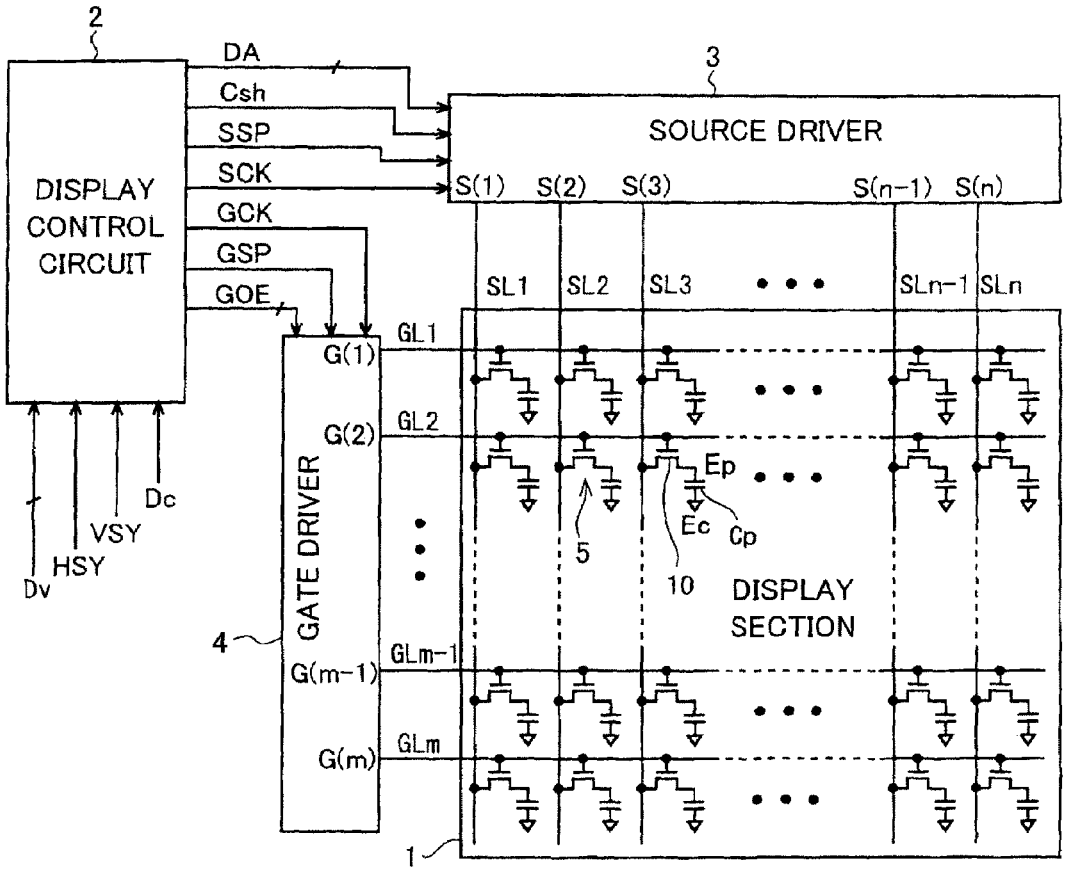
FIG. 2 is a block diagram illustrating a liquid crystal display device of the present embodiment together with an equivalent circuit of a display section of the liquid crystal display device.

FIG. 2 is a block diagram illustrating (i) a liquid crystal display device of the present embodiment and (ii) an equivalent circuit of a display section thereof. As illustrated in FIG. 2, the liquid crystal display device includes a source driver (drive circuit) 3 as a data signal line drive circuit, a gate driver 4 as a scanning signal line drive circuit, an active matrix type display section 1, and a display control circuit 2 for controlling the source driver 3 and the gate driver 4.

The display section 1 includes a plurality of (m-number of) gate lines GL1-GLm as scanning signal lines, a plurality of (n-number of) source lines SL1-SLn as data signal lines intersecting with the gate lines GL1-GLm, a plurality of (m×n) pixel formation sections 5 which are provided at the respective intersections of the gate lines GL1-GLm and the source lines SL1-SLn.

The pixel formation sections 5 are arranged in a matrix manner so as to make up a pixel array. Each of the pixel formation sections 5 is constructed from: (i) a TFT 10 which is a switching element whose gate terminal is connected to a gate line GLj that passes through the corresponding intersection, and whose source terminal is connected to a source line SLi that passes through the corresponding intersection; a pixel electrode Ep which is connected to a drain terminal of the TFT 10; and a common electrode Ec which is a counter electrode provided in common in the pixel formation sections 5; and a liquid crystal layer which is sandwiched between the pixel electrode Ep and the common electrode Ec.

A pixel capacitor Cp is constructed from a liquid crystal capacitor that is made up of the pixel electrode Ep and the common electrode Ec. To ensure the pixel capacitor Cp to hold a voltage, an auxiliary capacitor may be provided in parallel to the liquid crystal capacitor (pixel capacitor Cp). The auxiliary capacitor is not directly related to the present invention, and explanation and illustration thereof is therefore omitted.

To the pixel electrode Ep, an electric potential corresponding to an image to be displayed is applied by the operating source driver 3 and gate driver 4, as will be described later. To the common electrode Ec, a predetermined electric potential Vcom is applied by a power source circuit (not shown). With this arrangement, a voltage corresponding to a potential difference between the pixel electrode Ep and the common electrode Ec is applied to the liquid crystal layer, and such a voltage application controls the amount of light passing through the liquid crystal layer, whereby image display is performed. In order to control the amount of light passing through the liquid crystal layer by voltage application, polarizing plates (not shown) are used. In the liquid crystal display device of the present embodiment, polarizing plates are provided so as to achieve normally black, as an example. A liquid crystal display device in normally black mode performs black display in a state where no voltage is applied, and thus can easily perform black insertion and reduce power consumption.

The display control circuit 2 receives, from an external signal source (not shown), a digital video signal Dv representing an image to be displayed, a horizontal sync signal HSY and a vertical sync signal VSY both of which correspond to the digital video signal Dv, and a control signal Dc for controlling a display operation.

On the basis of the signals Dv, HSY, VSY, and Dc, the display control circuit 2 generates and outputs the following signals: a data start pulse signal SSP; a data clock signal SCK; a charge share control signal Csh; a digital image signal DA (signal corresponding to the video signal Dv) representing the image to be displayed; a gate start pulse signal GSP; a gate clock signal GCK; and a gate driver output control signal GOE (GOE1-GOEq). With these signals, an image represented by the digital video signal Dv is displayed on the display section 1.

More specifically, an internal memory (not shown) of the display control circuit 2 subjects the video signal Dv received from the external signal source to timing control etc., if necessary. Thereafter, the display control circuit 2 outputs the video signal Dv in the form of the digital image signal DA, generates the data clock signal SCK as a signal realized by pulses corresponding to pixels for an image represented by the digital image signal DA, generates the data start pulse signal SSP as a signal that is at high level (H level) for only a predetermined period in each horizontal scanning period on the basis of the horizontal sync signal HSY, generates the gate start pulse signal GSP as a signal that is at H level for only a predetermined period in each frame period (each vertical scanning period) on the basis of the vertical sync signal VSY, generates the gate clock signal GCK on the basis of the horizontal sync signal HSY, and generates the charge share control signal Csh and the gate driver output control signal GOE on the basis of the horizontal sync signal HSY and the control signal Dc.

Among the signals thus generated by the display control circuit 2, the digital image signal DA, the charge share control signal Csh, the data start pulse signal SSP, and the data clock signal SCK are supplied to the source driver 3, whereas the gate start pulse signal GSP, the gate clock signal GCK, and gate driver output control signal GOE are supplied to the gate driver 4.

Figure 3:
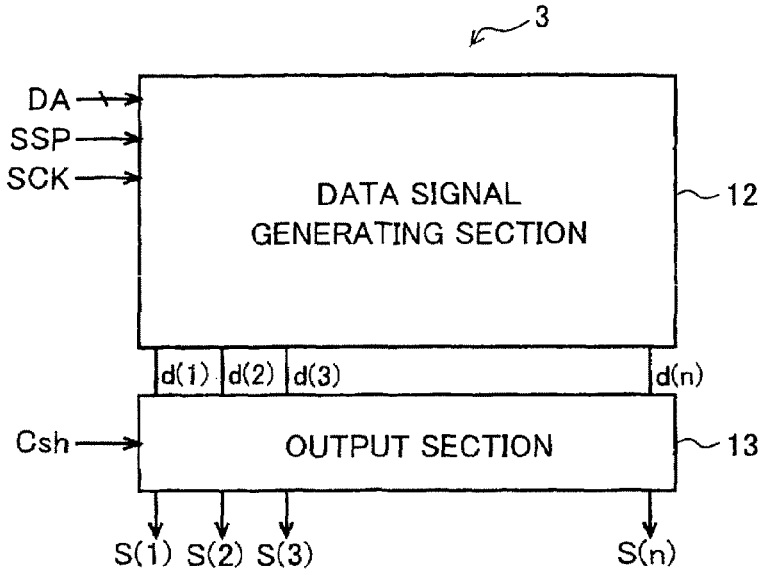
FIG. 3 is a block diagram illustrating the configuration of a source driver illustrated in FIG. 2.

FIG. 3 is a block diagram illustrating the configuration of the source driver 3.

As illustrated in FIG. 3, the source driver 3 includes a data signal generating section 12 and an output section 13 which is provided at the subsequent stage of the data signal generating section 12. The data signal generating section 12 generates analogue voltage signals d(1)-d(n) respectively corresponding to the source lines SL1-SLn from the digital image signal DA on the basis of the data start pulse signal SSP and the data clock signal SCK. The configuration of the data signal generating section 12 is the same as that of the data signal generating section 12 in the conventional source driver, and explanation thereof is omitted.

The output section 13 includes a plurality of output buffers 31 (FIG. 4) which are constituted by voltage followers provided for the respective analogue voltage signals d(i), which are generated by the data signal generating section 12. These output buffers 31 subject the analogue voltage signals d(i) to impedance conversion to output them in the form of data signals S(i) (i=1, 2, . . . , n).

However, as will be described later, the application of the data signals S(1)-S(n) to the respective source lines SL1-SLn is interrupted under the charge share control signal Csh and the source lines SL1-SLn are short-circuited to one another, during a charge sharing period Tsh ((b) in FIG. 1). As will be described in detail later with reference to FIG. 4, the output section 13 includes a switch circuit and a power source, for the sake of realizing such an operation.

In each horizontal scanning period, the source driver 3 serially generates the data signals S(1)-S(n) as analogue voltages corresponding to pixel values in the horizontal scanning lines for an image represented by the digital image signal DA, on the basis of the digital image signal DA, the data start pulse signal SSP, and the data clock signal SCK. Then, the source driver 3 applies the thus generated data signals S(1)-S(n) to the source lines SL1-SLn, respectively.

The source driver 3 in the present embodiment adopts a dot inversion driving method, in which the data signals S(1)-S(n) are outputted so that the polarity of a voltage applied to the liquid crystal layer is reversed in each frame period, and the polarity of the applied voltage is reversed for each gate line and each source line in each frame. In other words, the dot inversion driving method is a method in which the polarity is inverted in each horizontal scanning period, and the adjacent data signal lines are opposite in polarity to each other.

Therefore, the source driver 3 arranges the polarities of voltages to be applied to the adjacent ones of the source lines SL1-SLn to be opposite to each other, and reverses voltage polarity of the data signal S(i) to be applied to each of the source lines SLi in each horizontal scanning period. A reference electric potential for polarity reversal of voltages to be applied to the source lines SL1-SLn is a DC level (electric potential corresponding to a DC component) of each of the data signals S(1)-S(n). This DC level is typically different from the DC level of the common electrode Ec, by a feed through voltage ΔVd which is generated by a parasitic capacitor Cgd between the gate and the drain of the TFT 10 in each of the pixel formation sections 5.

Note that in a case where the feed through voltage ΔVd caused by the parasitic capacitor Cgd is sufficiently lower than an optical threshold voltage Vth of a liquid crystal, the DC level of each of the data signals S(1)-S(n) is assumed to be equal to the DC level of the common electrode Ec. Therefore, the polarity of each of the data signals S(1)-S(n), i.e. the polarity of the voltage to be applied to each of the source lines SL1-SLn may be considered to be reversed in each horizontal scanning period with reference to the electric potential (counter voltage) of the common electrode Ec.

In addition, the source driver 3 adopts the so-called charge sharing method, in which respective pairs of the adjacent source lines of the source lines SL1-SLn are short-circuited at the polarity reversal of the data signals S(1)-S(n) in order to reduce the power consumption.

Figure 4:
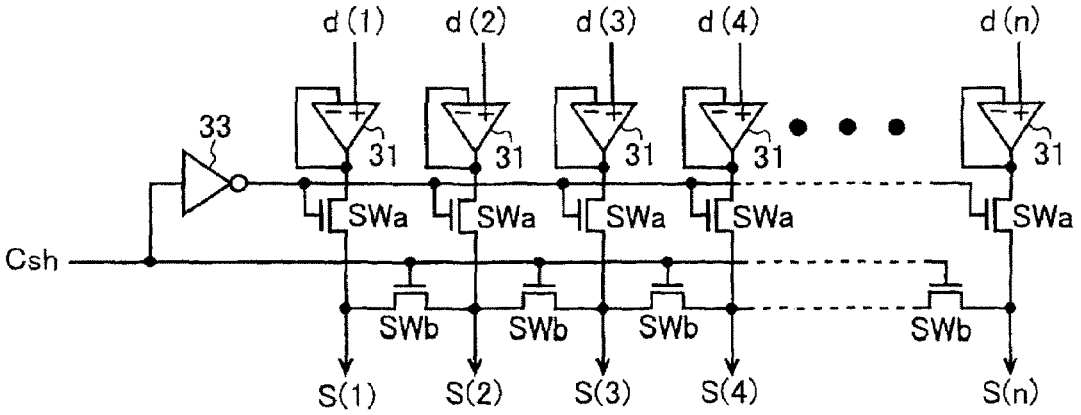
FIG. 4 is a circuit diagram illustrating an output section of the source driver illustrated in FIG. 3.

On this account, the output section 13, i.e. a section from which the data signals S(1-S(n) are outputted in the source driver 3, has the configuration as illustrated in FIG. 4. That is, the output section 13 receives the analogue voltage signals d(1)-d(n) generated on the basis of the digital image signal DA, and subject the analogue voltage signals d(1)-d(n) to impedance conversion so as to generate the data signals S(1)-S(n) as video signals to be transmitted to the source lines SL1-SLn. As illustrated in FIG. 4, the output section 13 has n-number of output buffers 31 as a voltage follower for the impedance conversion. Further, as illustrated in FIG. 4, first MOS transistors SWa as switching elements are connected to the output terminals of the output buffers 31. Data signals S(i) (i=1, 2, . . . , n) from the output buffers 31 are outputted from the output terminals of the source driver 3 via the first MOS transistors SWa.

The adjacent output terminals of the source driver 3 are connected to each other via a second MOS transistor SWb as a switching element. That is, the adjacent source lines of the source lines SL1-SLn are connected to each other via the second MOS transistor SWb. To a gate terminal of the second MOS transistor SWb between these output terminals, the charge share control signal Csh is supplied. To a gate terminal of the first MOS transistor SWa connected to the output terminal of the output buffer 31, an output signal of an inverter 33, i.e. a signal generated by logically reversing the charge share control signal Csh is supplied.

Therefore, when the charge share control signal Csh is inactive (at low level), the first MOS transistor SWa is turned on (conducting), and the second MOS transistor SWb is turned off (out of conduction). Thus, the data signals from the output buffers 31 are outputted from the source driver 3 via the first MOS transistors SWa.

On the other hand, when the charge share control signal Csh is active (at high level), the first MOS transistor SWa is turned off (out of conduction), and the second MOS transistor SWb is turned on (conducting). Thus, the data signals from the output buffers 31 are not outputted (i.e. application of the data signals S(1)-S(n) to the source lines SL1-SLn is interrupted), and respective pairs of adjacent source lines of the source lines SL1-SLn in the display section 1 are short-circuited via the second MOS transistors SWb.

Figure 1:
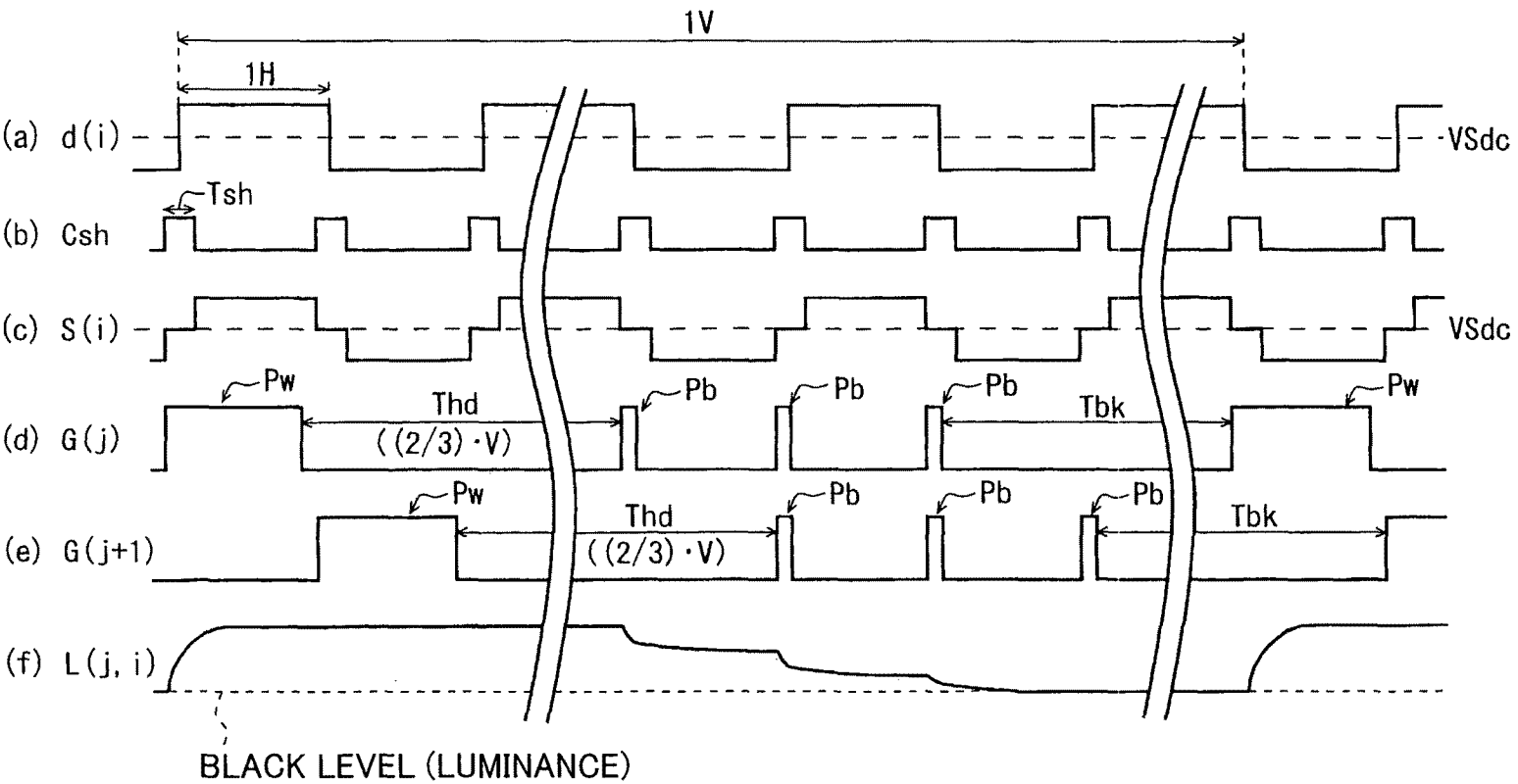
FIG. 1 is waveform diagrams wherein (*a*) is a waveform diagram showing an analogue voltage signal, (*b*) is a waveform diagram showing a charge share control signal, (*c*) is a waveform diagram showing a data signal, (*d*) is a waveform diagram showing a scanning signal G(j) applied to a gate line GLj, (*e*) is a waveform diagram showing a scanning signal G(j+1) applied to a gate line Gj+1, and (*f*) is a waveform diagram showing luminance of a pixel. These waveform diagrams are the ones for a liquid crystal display device of First Embodiment of the present invention.

The data signal generating section 12 of the source driver 3 generates the analogue voltage signal d(i) as a video signal whose polarity is reversed in each horizontal scanning period (1H), as illustrated in (a) of FIG. 1. On the other hand, the display control circuit 2 generates the charge share control signal Csh that becomes at high level (H level) for only a predetermined period (period that is as short as one horizontal blanking period; charge sharing period) at the polarity reversal of the analogue voltage signal d(i), as illustrated in (b) of FIG. 1.

As described above, when the charge share control signal Csh is at low level (L level), the analogue voltage signals d(i) are outputted as the data signals S(i). When the charge share control signal Csh is at high level (H level), supply of the data signals S(1)-S(n) to the source lines SL1-SLn is interrupted, and each pair of adjacent source lines of the source lines SL1-SLn is short-circuited to each other.

Since the dot inversion driving method is adopted, voltages of the adjacent source lines of the source lines SL1-SLn are opposite in polarity, and their absolute values are nearly equal to each other. Therefore, a value of each of the data signals S(i), i.e. a voltage of each of the source lines SLi is equivalent to a voltage (black voltage) for black display during the charge sharing period Tsh.

In the liquid crystal display device of the present embodiment, the polarity of each of the data signals S(i) is reversed with reference to the DC level VSdc of the data signal S(i). For this reason, as illustrated in (c) of FIG. 1, a voltage of the data signal S(i) is nearly equal to the DC level VSdc of the data signal S(i), during the charge sharing period Tsh.

Note that the arrangement in which respective pairs of adjacent source lines of the source lines SL1-SLn are short-circuited at the polarity reversal of the data signals S(1)-S(n) so that a voltage of each of the source lines SLi is made equal to the black voltage (DC level VSdc of the data signal S(i)) has been conventionally proposed as a measure for the reduction of power consumption. The arrangement illustrated in FIG. 4 is non-limitative arrangement.

To supply the data signals S(1)-S(n) to the respective pixel formation sections 5 (to the pixel capacitors thereof) on the basis of the gate start pulse signal GSP, the gate clock signal GCK, and the gate driver output control signal GOEr (r=1, 2, . . . , q), the gate driver 4 serially selects, in each frame period (each vertical scanning period) of the digital image signal DA, the gate lines GL1-GLm for about one horizontal scanning period for each line, and selects the gate line GLj (j=1 through m) for a predetermined period at the polarity reversal of the above data signal S(i) for the black insertion, which will be described later.

More specifically, the gate driver 4 supplies scanning signals G(1)-G(m) including a pixel data write pulse Pw and a black voltage application pulse (pulse applying a non-image signal) Pb, as illustrated in (d) and (e) of FIG. 1, respectively to the gate lines GL1-GLm. The gate line GLj to which the pixel data write pulse Pw and the black voltage application pulse Pb are supplied is in a selected state. The TFT 10 connected to the gate line GLj in a selected state is turned on, whereas the TFT 10 connected to the gate line GLj in non-selected state is turned off.

The pixel data write pulse Pw is at H level in an effective scanning period corresponding to a display period during one horizontal scanning period (1H), whereas the black voltage application pulse Pb is at H level in the charge sharing period Tsh, which corresponds to the blanking period (period that is not the display period), during one horizontal scanning period (1H).

As illustrated in (d) and (e) of FIG. 1, each of the scanning signals G(j) is arranged such that an interval between the pixel data write pulse Pw and the first black voltage application pulse Pb immediately after the pixel data write pulse Pw is equivalent to a ⅔ frame period (⅔V; Thd), and the black voltage application pulse Pb successively appears three times at intervals of one horizontal scanning period (1H) in one frame period (1V).

The duration of the black voltage application pulse Pb is preferably from 1.0 microseconds to 2.0 microseconds, more preferably 1.2 to 1.8 microseconds. It is desirable that the duration of the period (Tsh in FIG. 1) during which a non-image signal is applied to the data signal line is approximately two to three times longer than the duration of the black voltage application pulse Pb. That is, the duration of Tsh is preferably 2 to 6 microseconds, more preferably 3 to 5 microseconds.

The duration of time that a non-image signal is applied to the data signal line (i.e. duration of Pb) is preferably shorter than the duration of time that an image signal is applied to the data signal line (i.e. duration of Pw). This aims at securing the rate of charging to a pixel for the image signal. The rate of charging to a pixel for the non-image signal can be secured by increasing the number of black voltage application pulses Pb. Table 1 shows suitable durations of time that the image signal and the non-image signal are applied in FullHD (1080×1920× RGB dots) models. Table 1 shows the durations of time that the signals are applied to the data signal line or the scanning signal line.

TABLE 1

| Models | Duration of Pb | Image signal | Non-image signal | Number of Pb |
|---|---|---|---|---|
| 37-type Full HD | 1.2 μsec | 11.2 μsec | 3.6 μsec | 4 |
| 46-type Full HD | 1.6 μsec | 10.8 μsec | 4.0 μsec | 4 |
| 52-type Full HD | 1.8 μsec | 10.6 μsec | 4.2 μsec | 4 |

Note that the present invention is not necessarily limited to this. Since suitable values vary depending upon the definition of liquid crystal display elements, screen size, and other conditions, it is desirable to find the values according to the conditions where appropriate.

The number of black voltage application pulses Pb, which can be selected appropriately according to an intended black insertion level, is suitably 2 to 8, more preferably 3 to 6. The black voltage application pulse Pb is applied at the timing when the polarity of the data signal is reversed from +(positive) to −(negative) and at the timing when the polarity of the data signal is reversed from −(negative) to +(positive). If the timing when the black voltage application pulse Pb is applied is one-sided, flicker and unevenness on each scanning line can occur. Such defects can be suppressed by performing driving while the polarity of the data signal is reversed in each frame and by fine adjustment of Thd and Tbk. In view of this, the number of black voltage application pulses Pb may be an even-number (e.g. 4), so that the number of black voltage application pulses Pb applied at the timing of the polarity reversal from + to − becomes equal to the number of black voltage application pulses Pb applied at the timing of the polarity reversal from − to +.

Next, the following will describe how the display section 1 (see FIG. 1) is driven by the source driver 3 and the gate driver 4, with reference to FIG. 1. In each of the pixel formation sections 5 in the display section 1, when the pixel data write pulse Pw is applied to the gate line GLj which is connected to the gate terminal of the TFT 10, the TFT 10 is turned on, and a voltage of the source line SLi, which is connected to the source terminal of the TFT 10, is written as a value of the data signal S(i) into the pixel formation section 5. That is, a voltage of the source line SLi is held in the pixel capacitor Cp. Thereafter, the gate line GLj is in a non-selected state during the period (non-selected state period; pixel data holding period) Thd until the black voltage application pulse Pb appears. Therefore, the voltage written into the pixel formation section 5 continues to be held.

The black voltage application pulse Pb is applied to the gate line GLj during the charge sharing period Tsh that follows the pixel data holding period Thd. As described previously, a value of each of the data signals S(i), i.e. a voltage of each of the source lines SLi in the charge sharing period Tsh is nearly equal to the DC level of the data signal S(i). That is, a voltage of each source line SLi is black voltage.

Therefore, upon application of the black voltage application pulse Pb to the gate line GLj, the voltage held in the pixel capacitor Cp of the pixel formation section 5 starts to change toward black voltage. However, since the timing when the black voltage application pulse Pb is applied is at the polarity reversal of the data signal S(i), a pulse duration of the black voltage application pulse Pb is short. On this account, three black voltage application pulses Pb are successively applied to the gate line GLj at the intervals of one horizontal scanning period (1H) in each frame period, as illustrated in (d) and (e) of FIG. 1, so that the voltage held in the pixel capacitor Cp can be reliably changed to black voltage. As a result of this, luminance, (the amount of transmitted light determined by the voltage held by the pixel capacitor) L (j,i) of a pixel, which is formed in the pixel formation section 5 connected to the gate line GLj, changes as illustrated in (f) of FIG. 1.

Thus, in one display line corresponding to the pixel formation section 5 which is connected to each gate line GLj, display based on the digital image signal DA is carried out during the pixel data holding period Thd. Thereafter, the three black voltage application pulses Pb are applied. Then, black display is performed during the period Tbk until the next time when the pixel data write pulse Pw is applied to the gate line GLj. In this manner, the period Tbk (black display period) during which black display is performed is inserted into each frame period, which allows the liquid crystal display device to perform impulse display.

As is apparent from (d) and (e) of FIG. 1, the timings when the pixel data write pulse Pw appears are different by one horizontal scanning period (1H) between the adjacent scanning signals G(j). Accordingly, the timings when the black voltage application pulse Pb appears are different by one horizontal scanning period (1H) between the adjacent scanning signals G(j). For this reason, the black display period Tbk is shifted by one horizontal scanning period (1H) in each display line, and hence the length of black insertion is identical for all display lines.

In this manner, a sufficient black insertion period (non-image insertion period) is obtained without reduction of the period for charging in the pixel capacitor Cp for writing of pixel data. Also, it is unnecessary to speed up the operation of the source driver 3 or the like for the sake of black insertion (non-image insertion).

Figure 5:
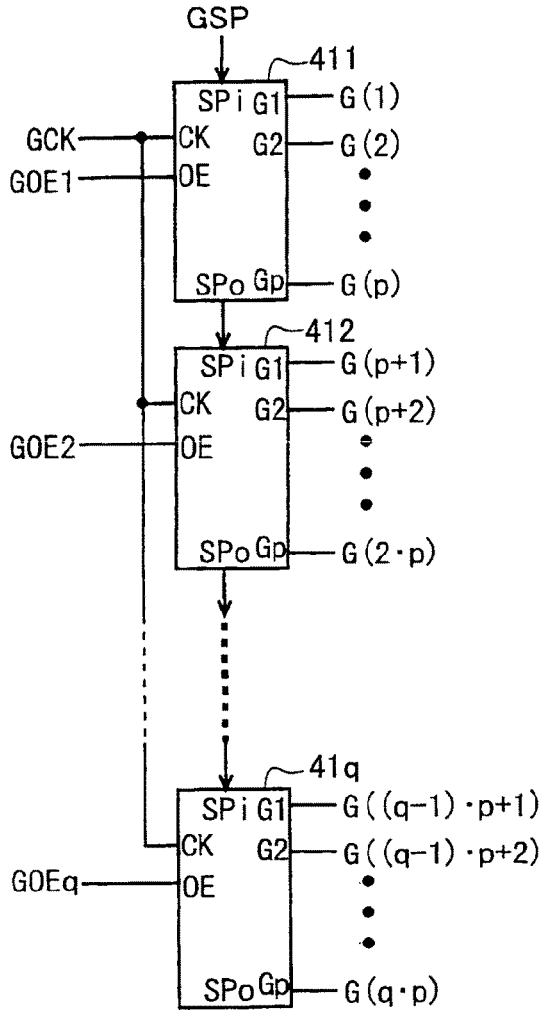
FIG. 5(*a*) is a block diagram illustrating the configuration of a gate driver illustrated in FIG. 2.
Figure 5:
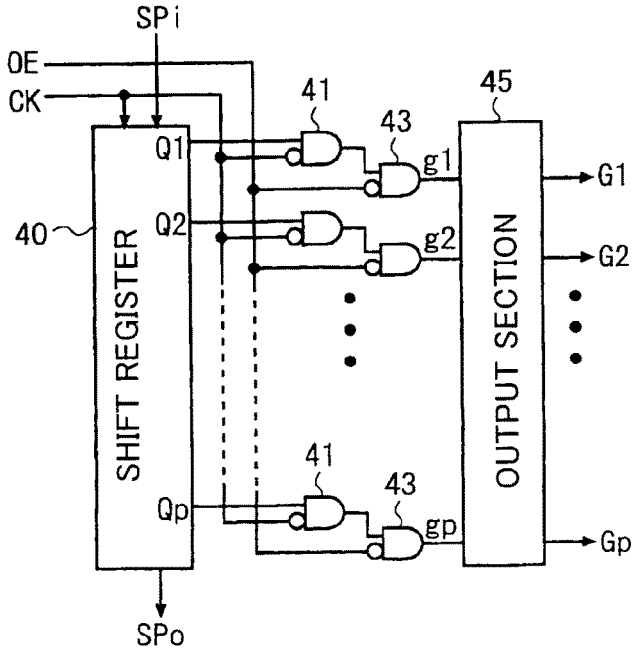

Next, the following will more specifically describe the configuration and others of the gate driver 4 of the present embodiment. FIG. 5(*a*) is a block diagram illustrating the configuration of the gate driver 4 that operates in waveforms shown in (d) and (e) of FIG. 1. As illustrated in FIG. 5(*a*), the gate driver 4 is made up of a plurality (q-number) of gate driver IC (Integrated Circuit) chips 411, 412, . . . , 41*q* each of which is a partial circuit and includes a shift register 40 (FIG. 5(*b*)). As illustrated in FIG. 5(*b*), each of the gate driver IC chips 411, 412, . . . , 41*q* includes: a shift register 40; first and second AND gates 42 and 43 which are provided corresponding to the stages of the shift register 40; and an output section 45 which outputs scanning signals G1-Gp in accordance with output signals g1-gp of the second AND gate 43, and receives external signals as a start pulse signal Spi, a clock signal CK, and an output control signal OE.

The start pulse signal Spi is supplied to an input terminal of the shift register 40, and a start pulse signal Spo is outputted from an output terminal of the shift register 40 to the gate driver IC chip at the subsequent stage. A signal generated by logically reversing the clock signal CK is supplied to each of the first AND gates 41, whereas a signal generated by logically reversing the output control signal OE is supplied to each of the second AND gates 43. Output signals Qk (k=1 through p) from the respective stages of the shift register 40 are supplied to the first AND gates 41 corresponding to the respective stages. The output signals from the first AND gates 41 are supplied to the second gates 43 corresponding to the respective stages.

As illustrated in FIG. 5(*a*), the gate driver 4 is constructed from a plurality of (q-number of) the gate driver IC chips 411-41*q* arranged as above which are cascaded to each other. More specifically, the output terminals of the shift registers in the gate driver IC chips 411-41*q* (output terminals for the start pulse signals Spo) are connected to the input terminals of the shift registers in the subsequent gate driver IC chips 411-41*q* (input terminals for the start pulse signals Spi), so that the shift registers 40 in the gate driver IC chips 411-41*q* constructs one shift register (hereinafter shift registers constituted by cascade connection are referred to as "coupled shift registers").

However, the gate start pulse signal GSP is supplied from the display control circuit 2 to the input terminal of the shift register in the first gate driver IC chip 411, and the output terminal of the shift register in the rearmost gate driver IC chip 41*q* is not connected to an external entity.

The gate clock signal GCK from the display control circuit 2 is supplied as clock signals CK in common to the gate driver IC chips 411-41*q*.

Meanwhile, the gate driver output control signal GOE, which is generated in the display control circuit 2, is made up of first to q-th gate driver output control signals GOE1-GOEq. The gate driver output control signals GOE1-GOEq are independently supplied as output control signals OE respectively to the gate driver IC chips 411-41*q*.

Figure 6:
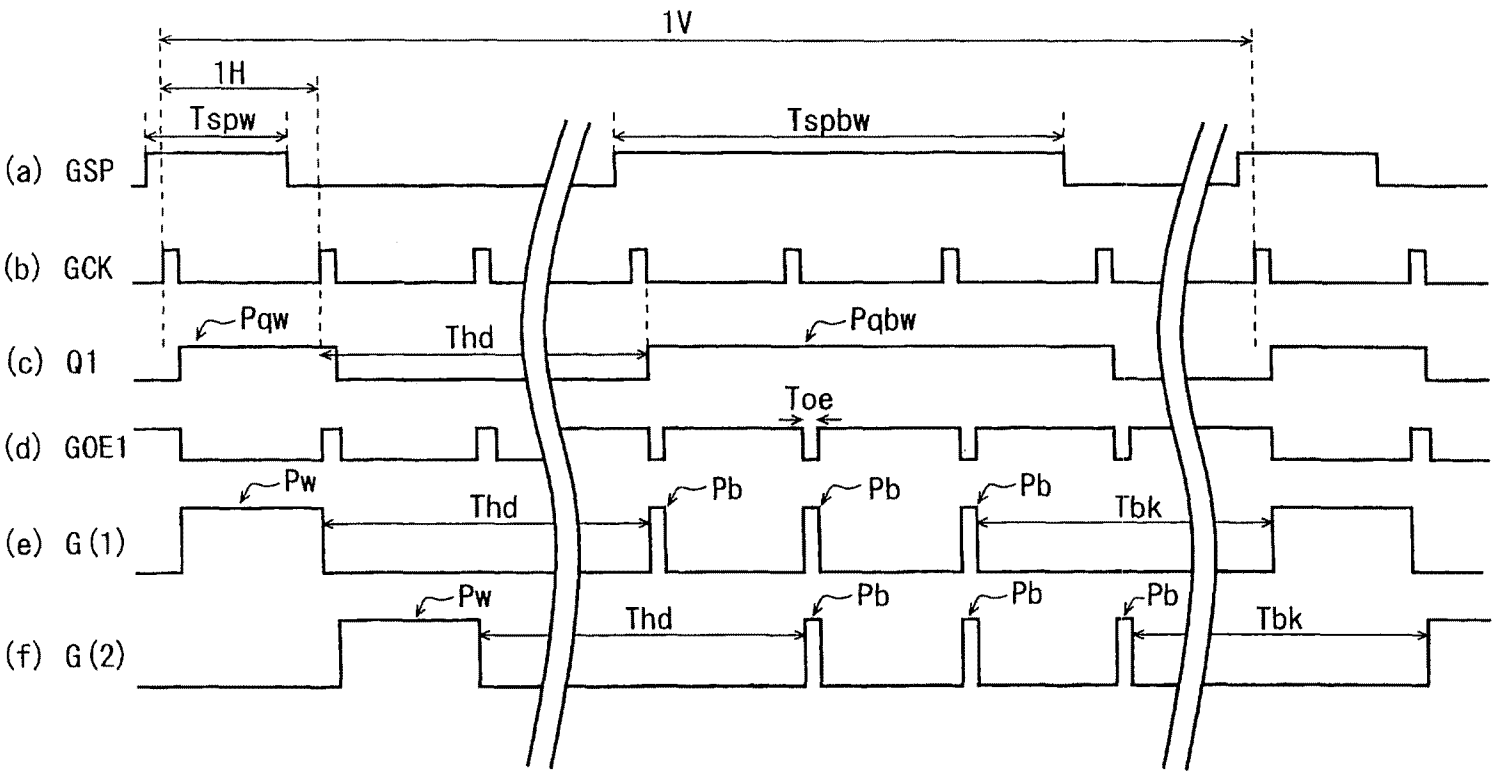
FIG. 6 is waveform diagrams wherein (a) is a waveform diagram showing a gate start pulse signal GSP, (b) is a waveform diagram showing a gate clock signal GCK, (c) is a waveform diagram showing an output signal Q1 from a first shift register at the first stage, (d) is a waveform diagram showing a gate driver output control signal GOE1 supplied to a first gate driver IC chip 411, (e) is a waveform diagram showing a scanning signal G(1) applied to a gate line GL1, and (f) is a waveform diagram showing a scanning signal G(2) applied to a gate line GL2.

Next, the following will describe how the gate driver 4 operates, with reference to (a) through (f) in FIG. 6.

As shown in (a) of FIG. 6, the display control circuit 2 generates, as the gate start pulse signal GSP, a signal that is at H level (active) only for periods Tspw and Tspbw, which correspond to the pixel data write pulse Pw and three black voltage application pulses Pb, respectively. As shown in (b) of FIG. 6, the display control circuit 2 generates the gate clock signal GCK that is at H level only for a predetermined period in each horizontal scanning period (1H). When such gate start pulse signal GSP and gate clock signal GCK are supplied to the gate driver 4, a signal as shown in (c) of FIG. 6 is outputted as a first output signal Q1 from the shift register 40 of the first gate driver IC chip 411. During each frame period, the output signal Q1 includes a single pulse Pqw, which corresponds to the pixel data write pulse Pw, and a single pulse Pqbw, which corresponds to three black voltage application pulses Pb. The pulses Pqw and Pqbw are away from each other by approximately the pixel data holding period Thd.

These two pulses Pqw and Pqbw are serially transferred in the coupled shift registers inside the gate driver 400, in accordance with the gate clock signal GCK. Accordingly, the signals in waveform shown in (c) of FIG. 6 are serially outputted from the respective stages of the coupled shift registers so as to be shifted by one horizontal scanning period (1H).

As described previously, the display control circuit 2 generates the gate driver output control signal GOE1-GOEq to be supplied to the gate driver IC chips 411-41*q*, which constitutes the gate driver 4. Here, during the period in which the pulse Pqw corresponding to the pixel data write pulse Pw is outputted from any of the stages of the shift register 40 in the gate driver IC chip 41*r*, a gate driver output control signal GOEr to be supplied to the r-th gate driver IC chip 41*r* is at L level, except that the signal is at H level for a predetermined period near the pulse of the gate clock signal GCK for the adjustment of the pixel data write pulse Pw. During the other periods, the gate driver output control signal GOEr is at H level, except that the signal is at L level for a predetermined period Toe (which is set so as to be included in the charge sharing period Tsh) immediately after the gate clock signal GCK changes from H level to L level.

For example, the gate driver output control signal GOE1 as shown in (d) of FIG. 6 is supplied to the first gate driver IC chip 411. Note that the pulse included in each of the gate driver output control signal GOE1-GOEq for the adjustment of the pixel data write pulse Pw (such pulse is hereinafter referred to as "write period adjustment pulse" since it is at H level for the predetermined period) rises before the rise of the gate clock signal GCK and falls after the fall of the gate clock signal GCK according to a required pixel data write pulse Pw.

The pixel data write pulse Pw may be adjusted only by the gate clock signal GCK, without the use of the write period adjustment pulse. In each of the gate driver IC chips 411*r* (r=1 through q), respective combinations of the first and second AND gates 41 and 43 generate internal scanning signals g1-gp on the basis of the output signals Qk (k=1 through p) from the stages of the shift register 40, the gate clock signal GCK, and the gate driver output control signal GOEr. The internal scanning signals g1-*gp* are subjected to level conversion in the output section 45 so that the scanning signals G1-Gp to be applied to the gate lines are outputted.

With this arrangement, as is apparent from the scanning signals G(1) and G(2) shown in (e) and (f) of FIG. 6, the pixel data write pulses Pw are serially applied to the gate lines GL1, GL2, . . . , and the black voltage application pulse Pb is applied to each of the gate lines GL1, GL2, . . . , at a timing when the pixel data holding period Thd elapses from the application of the pixel data write pulse. Thereafter, two black voltage application pulses Pb are applied to each of the gate lines GL1, GL2, . . . , at intervals of one horizontal scanning period (1H). After the three black voltage application pulses Pb are applied in this manner, the gate lines are kept at L level until the pixel data write pulse Pw of the next frame period is applied. That is, the black display period Tbk continues until the subsequent pixel data write pulse Pw is applied after the application of the three black voltage application pulses Pb.

As described above, the liquid crystal display device can be realize impulse driving as shown in (c) through (f) of FIG. 1 with the use of the gate driver 4 configured as illustrated in FIGS. 5(*a*) and 5(*b*), and can also apply a liquid crystal pre-tilt voltage.

Figure 7:
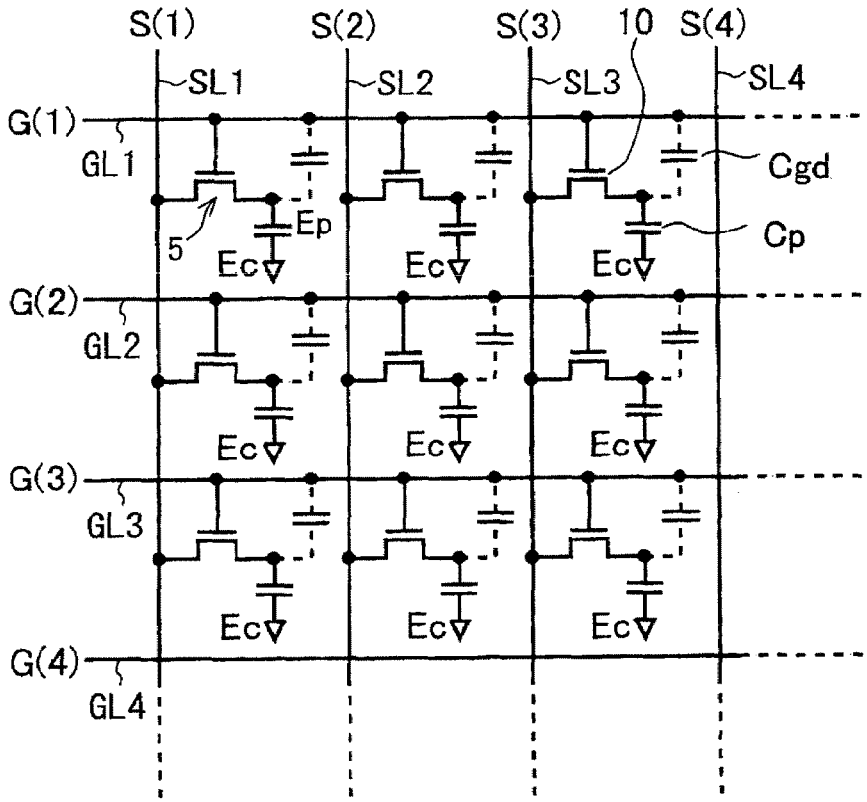
FIG. 7 is a diagram illustrating parasitic capacitances each of which exists between a gate and a drain of a TFT in each pixel formation section.

Incidentally, an active matrix type liquid crystal display device including the TFTs 10 generally has a parasitic capacitor Cgd between a gate and drain of the TFT 10 in each of the pixel formation section 5, as illustrated in FIG. 7. Due to the existence of the parasitic capacitance Cgd, a voltage (pixel voltage) Vd of the pixel electrode Ep in each of the pixel formation sections 5 decreases according to the ratio between the pixel capacitance Cp and the parasitic capacitance Cgd at the timing when the TFT 10 connected to the pixel electrode Ep is switched from on-state (conduction state) to off-state (out-of-conduction state). Hereinafter, the variation of the pixel voltage Vd caused by the parasitic capacitor Cgd is referred to as "level shift", the amount of which is referred to as "feed through voltage" and represented by ΔVd.

Figure 8:
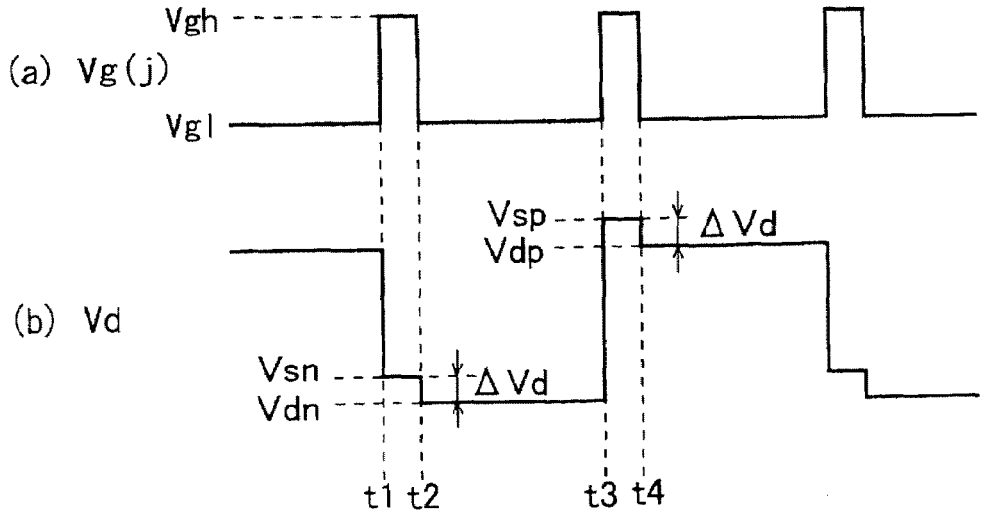
FIG. 8 is waveform diagrams wherein (a) is a waveform diagram showing a gate voltage Vg(j) that is a voltage of a scanning signal G(j) applied to a gate line GLj, (b) is a waveform diagram showing a voltage (pixel voltage) Vd of a pixel electrode Ep in a pixel formation section 5

More specifically, as illustrated in (a) and (b) of FIG. 8, when a gate voltage Vg(j) (j=1, 2, . . . m), which is a voltage of the scanning signal G(j) applied to any of the gate lines GLj, becomes on-voltage Vgh (time t1 or t3), and thereafter the gate voltage Vg(j) turns to the off-voltage Vg1 (time t2 or t4) by application of a voltage Vsn or Vsp of the source line SLi (i=1, 2, . . . , n) to the pixel electrode via the TFT 10 which is connected to the gate line GLj, the pixel voltage Vd decreases by the feed through voltage ΔVd represented by the following equation (1):

$$\Delta Vd=(Vgh-Vgl)\cdot Cgd/(Cp+Cgd) \quad (1)$$

Since a dielectric constant of liquid crystal varies depending upon a voltage applied to the liquid crystal, a value of the pixel capacitance Cp varies depending upon a grayscale level of a pixel. Accordingly, the feed through voltage ΔVd in the equation (1) varies depending upon a grayscale level of a pixel.

Generally, a liquid crystal display device is arranged such that the polarity of a voltage applied to liquid crystal reverses at predetermined intervals with reference to the potential of the common electrode Ec, i.e. counter voltage, and a light transmittance of liquid crystal varies according to a rms value (effective value) of a voltage applied to liquid crystal. In order to obtain flicker-free display, a voltage applied to a source line (source voltage) needs to be corrected with respect to the counter voltage in such a manner that a mean value of a voltage applied to liquid crystal is 0. That is, a value of the data signal needs to be corrected by the feed through voltage ΔVd. As described above, the feed through voltage ΔVd varies depending upon a grayscale level of a pixel. In view of this, the source voltage is corrected according to a grayscale level of a pixel to be displayed so that flicker-free display is obtained for all of the grayscale levels. That is, the amount of correction of the source voltage varies depending upon a display grayscale level.

Incidentally, a source voltage (charge share voltage) during the charge sharing period Tsh is nearly equal to a mean value of voltages to all of the source lines of each source driver immediately before the charge sharing period. Since the amount of correction of the source voltage varies depending upon a grayscale level of a pixel as described above, the charge share voltage varies depending upon a display grayscale level, as will be described below with reference to FIG. 9.

Figure 9:
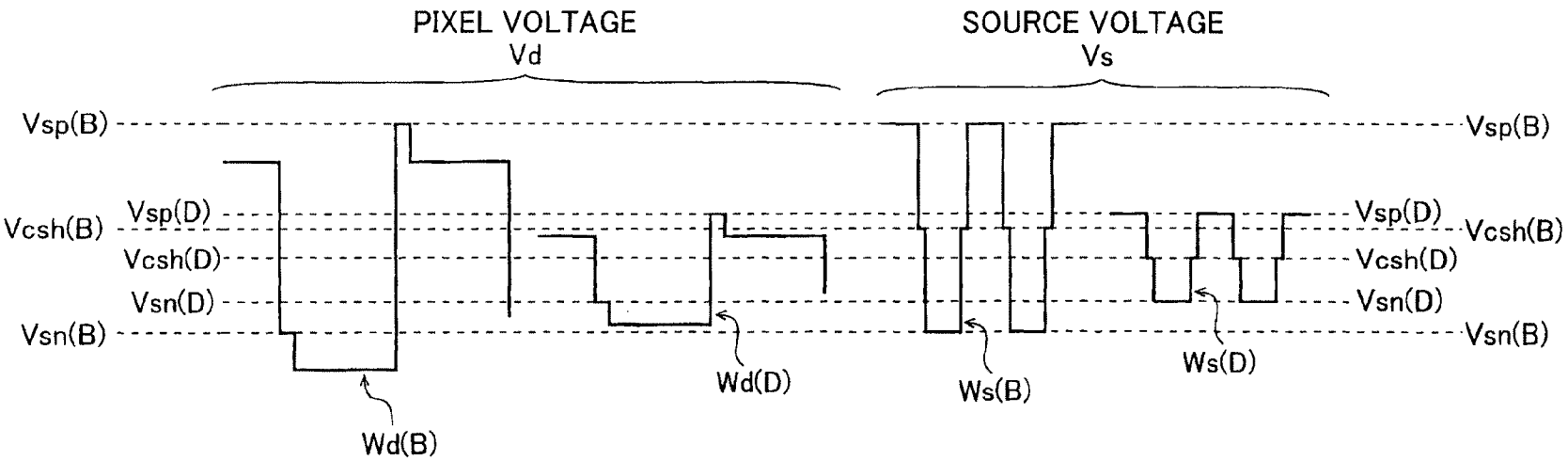
FIG. 9 is a waveform diagram showing: a voltage waveform Wd(B) of a pixel voltage (high luminance pixel voltage) Vd(B) for a high luminance display of a pixel; a voltage waveform Wd(D) of a pixel voltage (low luminance pixel voltage) Vd(D) for a low luminance display of a pixel; a voltage waveform Ws(B) of a voltage (high luminance source voltage) Vs(B) of a data signal for applying the high luminance pixel voltage Vd(B); and a voltage waveform Ws(D) of a voltage (low luminance source voltage) Vs(D) of a data signal for applying the low luminance pixel voltage Vd(D).

FIG. 9 shows: a voltage waveform Wd(B) of a pixel voltage (high luminance pixel voltage) Vd(B) for a high luminance display of a pixel; a voltage waveform Wd(D) of a pixel voltage (low luminance pixel voltage) Vd(D) for a low luminance display of a pixel; a voltage waveform Ws(B) of a voltage (high luminance source voltage) Vs(B) of a data signal for applying the high luminance pixel voltage Vd(B); and a voltage waveform Ws(D) of a voltage (low luminance source voltage) Vs(D) of a data signal for applying the low luminance pixel voltage Vd(D).

Note that there is no match in scale of a time axis (lateral axis) between the voltage waveform Wd(B) of the high luminance pixel voltage and the voltage waveform Wd(D) of the low luminance pixel voltage and between the voltage waveform Ws(B) of the high luminance source voltage and the voltage waveform Ws(D) of the low luminance source voltage. In FIG. 9, Vsp(B) represents a maximum value of the high luminance source voltage Vs(B), Vsn(B) represents a minimum value of the high luminance source voltage Vs(B), Vsp(D) represents a maximum value of the low luminance source voltage Vs(D), Vsn(D) represents a minimum value of the low luminance source voltage Vs(D).

Further, Vcsh(B) represents a charge share voltage in a case where the high luminance source voltage Vs(B) is applied to the source line, and Vcsh(D) represents a charge share voltage in a case where the low luminance source voltage Vs(D) is applied to the source line. As is apparent from FIG. 9, there is difference in feed through voltage ΔVd between the high luminance pixel voltage Vd(B) and the low luminance pixel voltage Vd(D). In addition, since a value of the source voltage is corrected by the feed through voltage ΔVd as described above, there is difference in the amount of correction between the high luminance source voltage Vs(B) and the low luminance source voltage Vs(D).

Therefore, the charge share voltage Vcsh(B) in a case where the high luminance source voltage Vs(B) is applied to the source line is different from the charge share voltage Vcsh(D) in a case where the low luminance source voltage Vs(D) is applied to the source line. That is, the charge share voltage Vcsh varies depending upon a display grayscale level.

In a liquid crystal display device of the present embodiment, as illustrated in FIG. 1, the charge share voltage (voltage VSdc shown in (a) and (c) of FIG. 1, which is a source voltage during the charge sharing period Tsh, becomes a voltage corresponding to black display. Therefore, black insertion is performed by application of the black voltage application pulse Pb that is at H level during the charge sharing period Tsh to the gate line GLj (j=1 through m), thereby allowing for impulse display.

In this case, since a pulse duration of the black voltage application pulse Pb is short, black insertion is performed during a plurality of charge sharing periods Tsh (three charge sharing periods Tsh in examples shown in FIGS. 1(*e*) and 1(*f*)) to compensate for insufficient black voltage writing. Even through being the voltage corresponding to black display, the charge share voltage Vcsh varies depending upon a display grayscale level (see FIG. 8). This is because a value of the source voltage is corrected as described above.

Figure 10:
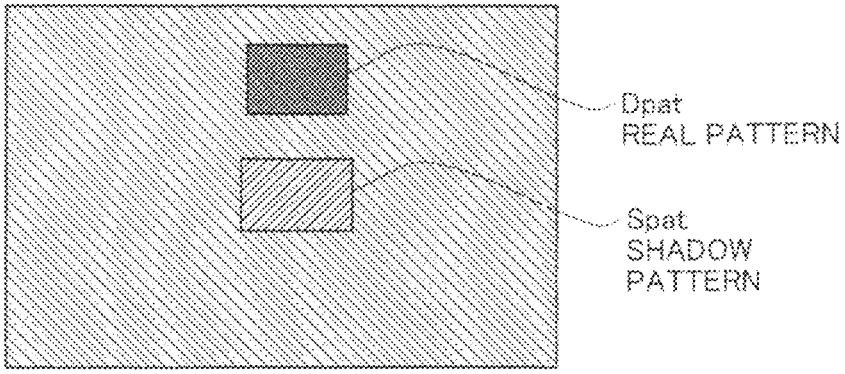
FIG. 10 is a diagram illustrating a shadow pattern Spat corresponding to a display pattern Dpat in accordance with writing of a charge share voltage Vcsh as a black voltage.

Since the charge share voltage Vcsh varies depending upon a display grayscale level as described above, a shadow of a pattern to be displayed can be visually identified depending upon the pattern. For example, as illustrated in FIG. 10, below a real display pattern Dpat in a screen of a liquid crystal display device, a shadow pattern Spat corresponding to the display pattern Dpt appears in accordance with writing of the charge share voltage Vcsh as a black voltage. The shadow pattern Spat can be visually identified as a shadow of the display pattern Dpat.

In order to solve the problem, it is preferable that a fixed voltage corresponding to black display is applied to each of the source lines SLi during the black signal insertion period. Application of the fixed voltage corresponding to black display to each of the source lines SLi allows voltages applied to the source lines SLi during the black signal insertion period to be the same all the time, even if the amount of correction of a data signal for the compensation for grayscale-level dependency of a feed through voltage based on the parasitic capacitor Cgd inside each of the pixel formation sections 5 varies depending upon a display grayscale level. This makes it possible to improve the problem that a shadow of a pattern is visually identified.

A specific configuration of the output section 13 of the source driver 3 in which such a fixed voltage is applied to each of the source lines SLi will be described with reference to drawings. That is, the configuration of the output section 13 of the source driver 3 is not limited to the configuration illustrated in FIG. 4, and may be the configuration as described below.

Figure 11:
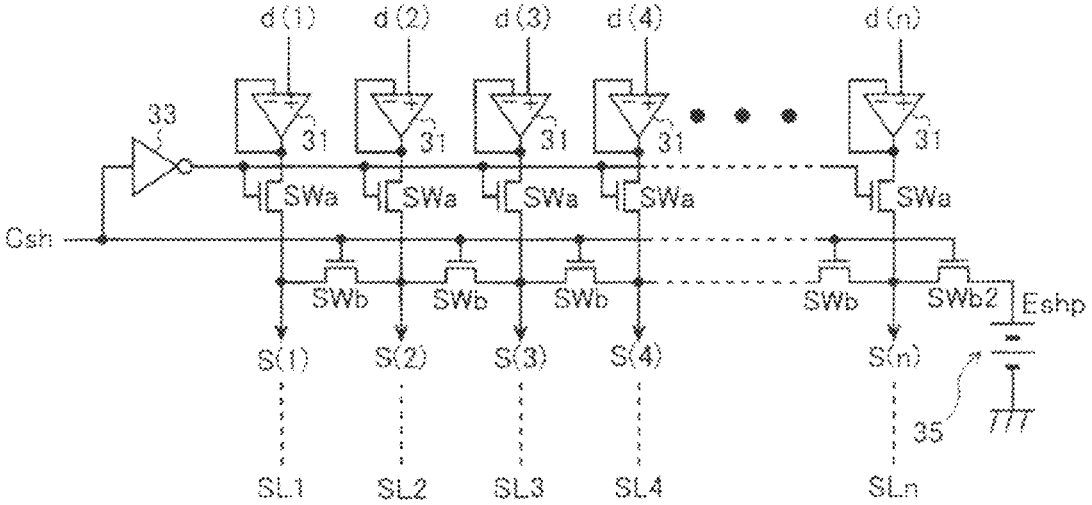
FIG. 11 is a circuit diagram illustrating another configuration of the output section of the source driver, which is not different from the configuration illustrated in FIG. 4.

FIG. 11 is a circuit diagram illustrating another configuration of an output section of the source driver.

An output section illustrated in FIG. 11 includes: n-number of output buffers 31; and a switch circuit which is made up of n-number of first MOS transistors SWa as switching elements, (n−1)-number of second MOS transistors SWb, and an inverter 33. Such a configuration is the same as the configuration of the output section 4 of the source driver 3 illustrated in FIG. 4.

Further, the output section illustrated in FIG. 11 is different from the output section 13 of the source driver 3 in that it has a charge share voltage fixing-use power source 35 and a third MOS transistor SWb2, and a positive electrode of the charge share voltage fixing-use power source 35 is connected to an output terminal of the source driver 3 which terminal is to be connected to any of the source lines SL(i) via the third MOS transistor SWb2 as a switching element (In an example illustrated in FIG. 11, the positive electrode of the charge share voltage fixing-use power source 35 is connected to an output terminal to be connected to n-th source line SLn.).

To the gate terminal of the third MOS transistor SWb2, the charge share control signal Csh is supplied, and a negative electrode of the charge share voltage fixing-use power source 35 is grounded.

It is preferable that the charge share voltage fixing-use power source 35 is a voltage applying section which applies a fixed voltage Eshp equivalent to a liquid crystal pre-tilt voltage by which liquid crystal is pre-tilted.

Note that the fixed voltage Eshp is applied to the pixel electrode during the charge sharing period Tsh in accordance with the black voltage application pulse Pb (see FIG. 1), but the pixel voltage is not strictly a voltage corresponding to black display, as described above. However, it is possible to obtain the impulse effect since writing of Eshp brings low luminance display (low grayscale display) with respect to a grayscale level of a pixel to be displayed in most of the grayscale regions.

As in the output section 13 of the source driver 3 illustrated in FIG. 4, the output section illustrated in FIG. 11 is such that during the (effective scanning) periods other than the charge sharing period Tsh, the analogue voltage signals d(1)-d(n) generated in the data signal generating section 12 are outputted as the data signals S(1)-S(n) to the source lines SL1-SLn via the output buffers 31 in accordance with the charge share control signal Csh, and during the charge sharing period Tsh, application of the data signals S(1)-S(n) to the source lines SL1-SLn is interrupted, and respective pairs of adjacent source lines of the source lines SL1-SLn are short-circuited to one another. As a result, all of the source lines SL1-SLn are short-circuited to one another.

In addition, according to the configuration illustrated in FIG. 11, the voltage Eshp of the charge share voltage fixing-use power source 35 is applied to each source line SLi (i=1 through n) during the charge sharing period Tsh. Thus, even if the amount of correction of a source voltage for the compensation for grayscale-level dependency of the feed through voltage ΔVd varies depending upon a display grayscale level, the charge share voltage can be kept to be the same voltage Eshp all the time during the charge sharing period Tsh that is the black signal insertion period. This makes it possible to suppress the occurrence of the shadow pattern as illustrated in FIG. 10.

Furthermore, application of the liquid crystal pre-tilt voltage by which liquid crystal is pre-tilted as the fixed voltage Eshp enables improvement of decrease in response speed of liquid crystal in a case where the high luminance pixel voltage is written in the subsequent frame and in the overshoot driving in which a voltage having a large potential difference is applied to the low luminance pixel potential corresponding to black display (details will be described later).

However, in the configuration example illustrated in FIG. 11, many source lines are connected to the charge share voltage fixing-use power source 35 via a plurality of MOS transistors SWb. This requires some time until voltages of all the source lines SL1-SLn become the same charge share voltage Esh. This may occur the event that black voltages to be held in the pixel capacitors of the pixel formation sections 5 cannot be the same at the black insertion depending upon the duration of the charge sharing period Tsh, and the occurrence of the shadow pattern cannot be therefore sufficiently suppressed.

Figure 12:
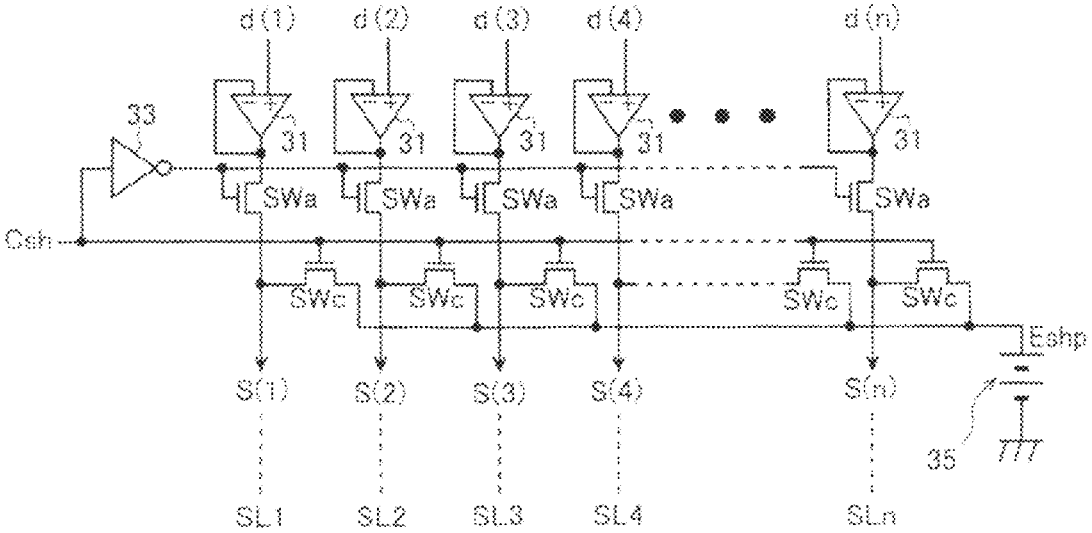
FIG. 12 is a circuit diagram illustrating still another configuration of the output section of the source driver, which is not different from the configuration illustrated in FIG. 4.

In view of this, the following will describe a configuration example of the output section of the source driver 3 which output section is arranged such that voltages of all the source lines SL1-SLn are changed to the same voltage Esh in a short time during the charge sharing period Tsh, with reference to FIG. 12.

FIG. 12 is a circuit diagram illustrating another configuration of the output section 13 of the source driver 3. Among the constituent elements in the output section 13 illustrated in FIG. 12, the same constituent elements as those illustrated in FIG. 11 are given the same reference numerals and explanations thereof are omitted here. As in the configuration of the output section illustrated in FIG. 11, the output section illustrated in FIG. 12 is provided with second MOS transistors SWc as switching elements respectively for the corresponding source lines SLi (i=1 through n). However, a switch circuit in the configuration illustrated in FIG. 12 is arranged such that one second MOS transistor SWc is inserted between each of the source lines SLi and the charge share voltage fixing-use power source 35, whereas the switch circuit in the output section 13 illustrated in FIG. 11 is arranged such that one second MOS transistor SWb is inserted between respective pairs of adjacent source lines SL1-SLn. That is, in the configuration illustrated in FIG. 12, the output terminals of the source driver to be connected to the source lines SLi are connected to the positive electrode of the charge share voltage fixing-use power source 35 via any one of the second MOS transistors SWc.

The charge share control signal Csh is supplied to all the gate terminals of the second MOS transistors SWc.

As in the output section of the source driver 3 in the configurations illustrated in FIGS. 11 and 4, the output section illustrated in FIG. 12 is such that during the (effective scanning) periods other than the charge sharing period Tsh, the analogue voltage signals d(1)-d(n) generated in the data signal generating section 12 are outputted as the data signals S(1)-S(n) in accordance with the charge share control signal Csh to the source lines SL1-SLn via the output buffers 31, and during the charge sharing period Tsh, application of the data signals S(1)-S(n) to the source lines SL1-SLn is interrupted, and respective pairs of adjacent source lines are short-circuited to one another (As a result, all of the source lines SL1-SLn are short-circuited to one another.).

In addition, according to the configuration illustrated in FIG. 12, the voltage Eshp of the charge share voltage fixing-use power source 35 is applied to each of the source line SLi (i=1 through n) during the charge sharing period Tsh. Thus, even if the amount of correction of a source voltage for the compensation for grayscale-level dependency of the feed through voltage ΔVd varies depending upon a grayscale level for display, the charge share voltage can be kept to be the same voltage Eshp all the time during the charge sharing period Tsh as the black signal insertion period. Besides, during the charge sharing period Tsh, the voltage Eshp of the charge share voltage fixing-use power source 35 is applied to the source lines SLi (i=1 through n) via one MOS transistor SWc. Therefore, voltages of the source lines SLi are changed to the same voltage Esh in a short time during the charge sharing period Tsh as the black signal insertion period. This makes it possible to reliably suppress the occurrence of the shadow pattern as illustrated in FIG. 10.

Next, the following will describe a suitable value of the voltage Eshp of the charge share voltage fixing-use power source 35 illustrated in FIGS. 11 and 12.

Figure 13:
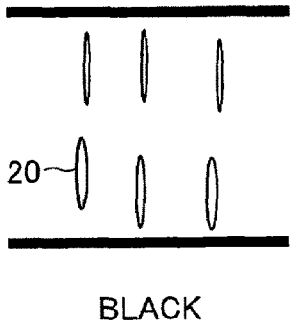
FIG. 13(*a*) is a schematic view illustrating liquid crystal molecules being vertically aligned.
Figure 13:
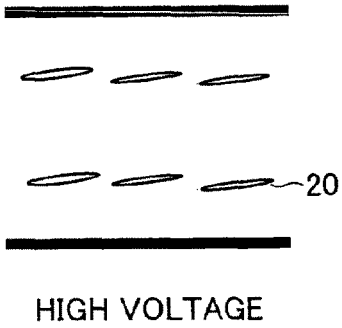

As to the behavior of liquid crystal molecules upon voltage application, a direction in which liquid crystal molecules having dielectric anisotropy align is controlled by application of a voltage to between upper and lower substrates in a liquid crystal display device. In the vertical alignment mode (VA mode), in a case where a low voltage is applied to between the upper and lower substrates (in a case where black writing is performed with a charge share potential as in the present embodiment), liquid crystal molecules 20 are vertically aligned as illustrated in FIG. 13(*a*). When a high voltage is applied to between the upper and lower substrates in the vertical alignment state, the liquid crystal molecules 20 fall down so as to be horizontally aligned, as illustrated in FIG. 13(*b*).

Figure 14:
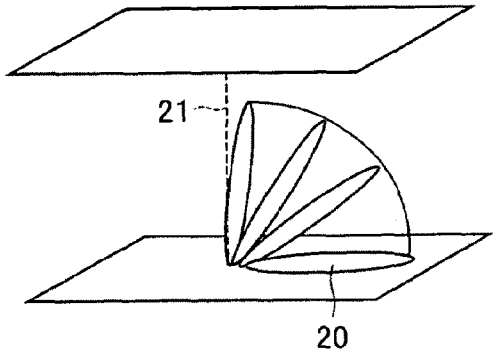
FIG. 14 is a view illustrating control of tilt angles of liquid crystal molecules by application of a voltage to liquid crystal molecules being vertically aligned state.
Figure 15:
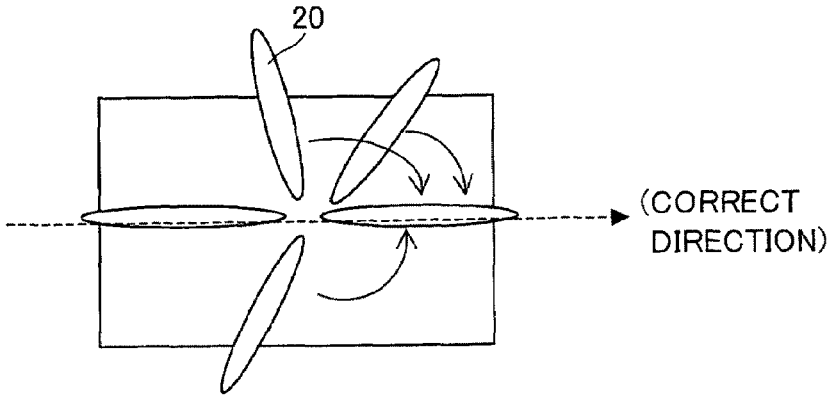
FIG. 15 a top plan view illustrating directions in which a liquid crystal molecule being vertically aligned falls down upon voltage application to the liquid crystal molecule.

When the liquid crystal molecules are fell down by application of a high voltage in a state where a voltage applied to the liquid crystal molecules 20 is as low as possible, i.e. in a state where the liquid crystal molecules 20 are aligned as vertically as possible, a tilt angle which the liquid crystal molecule 20 forms with a vertical axis 21 with respect to the substrate can be controlled, as illustrated in FIG. 14. However, a direction in which the liquid crystal molecule 20 falls down (horizontal azimuth direction) cannot be controlled. This gives rise to the problem that no one is sure which direction the liquid crystal molecules 20 fall down in, as illustrated in FIG. 15.

That is, the liquid crystal molecules 20 can fall down in various directions where their energies are stable on a case-by-case basis. Thereafter, the liquid crystal molecules align in a correct direction as indicated by an arrow in FIG. 15. However, it takes much time that the liquid crystal molecules 20 are aligned in the correct direction because they avoid collision with each other (i.e. they cannot penetrate through each other). In addition, liquid crystal molecules that are not aligned at 45-degree angle with respect to an absorption axis direction of a polarizing plate which forms crossed Nicols decrease transmittance.

Figure 16:
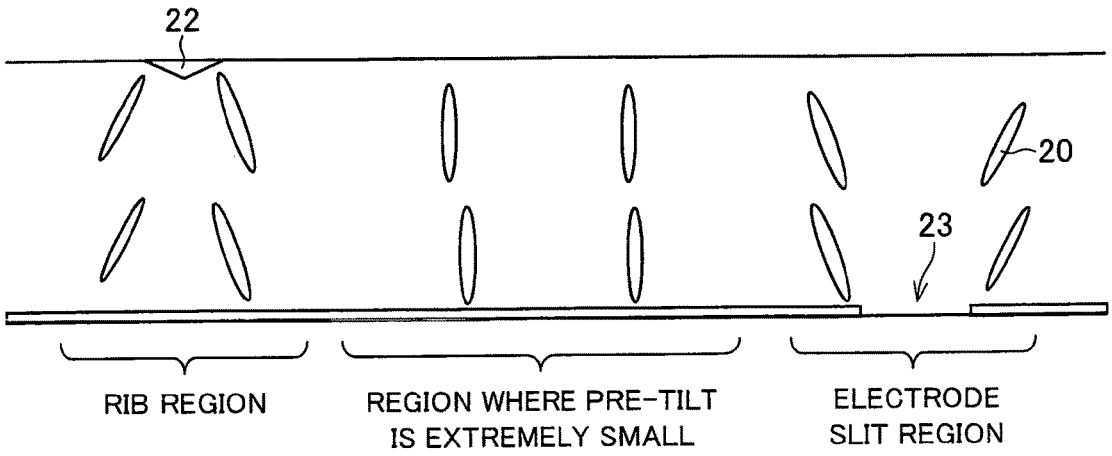
FIG. 16 is a view illustrating the structure by which liquid crystal is aligned on a slant.

The above problems mainly occur in the case of a liquid crystal display device in the VA mode which has a certain type of alignment state. That is, such a liquid crystal display device has a rib region and an electrode slit region, as illustrated in FIG. 16. In the rib region, as illustrated in FIG. 16, a taper section 22 is provided that has inclined surfaces with respect to a plane parallel to the substrate, and the liquid crystal molecules 20 are aligned on a slant along the taper section 22. Meanwhile, in the electrode slit region, a slit 23 is provided as illustrated in FIG. 16. At the electrode application, a latent electric field is applied to the slit 23, which makes it easy for the liquid crystal molecules 20 to be aligned on a slant.

The liquid crystal molecules 20 provided in a region where a pre-tilt is extremely small between the rib region and slit region attempt to align on a slant in the direction where the liquid crystal molecules 20 provided in the rib region and the slit region are aligned. However, a tilting function of the liquid crystal molecules 20 decreases with distance from the rib region and the slit region, and alignment of the liquid crystal molecules 20 therefore becomes more close to vertical alignment. As a result, it takes time for the liquid crystal molecules 20 to be aligned in the correct direction, as described above. FIG. 16 illustrates the configuration in which the rib region and the slit region are provided. However, this is not the only possibility. Alternatively, only one of the rib region and the slit region may be provided.

Figure 17:
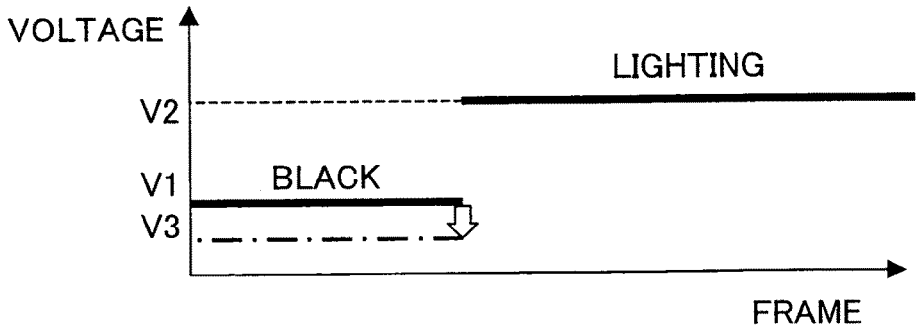
FIG. 17(*a*) is a view showing a voltage-frame relationship, indicating a black signal voltage, a black writing voltage, and a voltage for lighting state.
Figure 17:
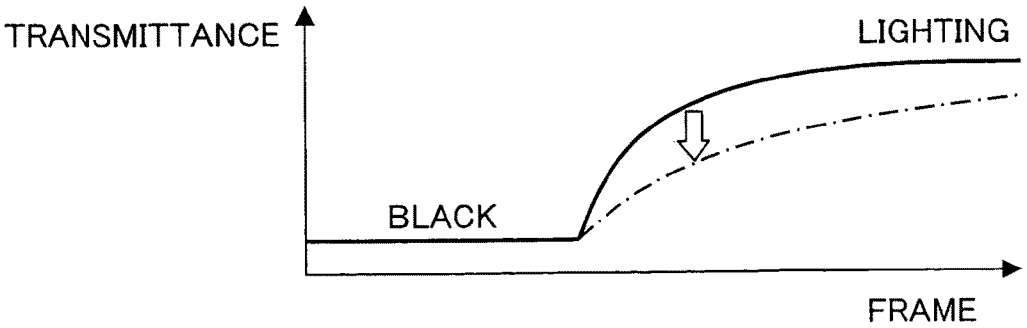

Now, response of the liquid crystal molecules will be described. As illustrated in FIG. 17(*a*), in a case where a shift is performed from a voltage V1 for a desired black signal to a voltage V2 for a lighting state, a time to reach for an intended grayscale level (transmittance) in the lighting state is relatively short as indicated by a solid line in FIG. 17(*b*). On the other hand, as illustrated in FIG. 17(*a*), in a case where a shift is performed from a voltage V3 for black writing (dashed-dotted line in FIG. 17(*a*)), which is lower than the voltage V1 for the black signal as illustrated in FIG. 17(*a*), to the voltage V2 for the lighting state, a time to reach for the intended grayscale level (target grayscale level) is very long, as indicated by a dashed-dotted line in FIG. 17(*b*). This is because it takes much time that the liquid crystal molecules 20 are aligned in the correct direction, as described above, and the response speed is therefore slow.

Figure 18:
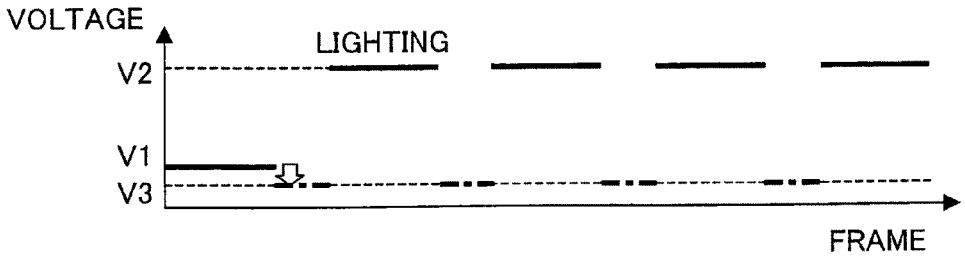
FIG. 18(*a*) is a view showing a voltage-frame relationship, corresponding to FIG. 17(*a*).
Figure 18:
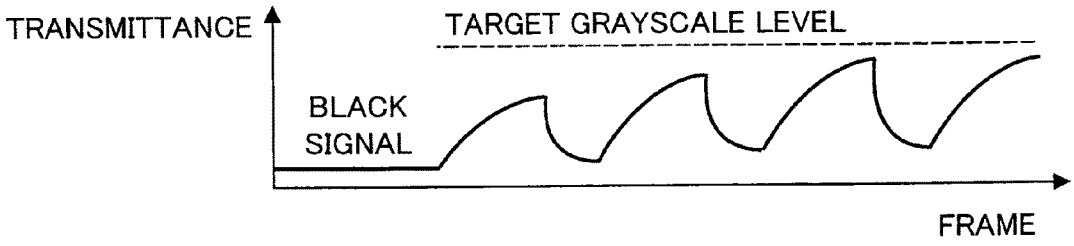

Next, the following will describe response behavior in the charge share impulse driving according to the response of the liquid crystal molecules 20. As illustrated in FIG. 18(*a*), in a case where a shift is performed from the voltage V3 for black writing, which is lower than the voltage V1 for a desired black signal, to the voltage V2 for the lighting state. In this case, black writing and the lighting state are alternately repeated as illustrated in FIG. 18(*b*), and reach for the target grayscale level indicating the lighting state is not achieved since the voltage V3 for black writing is lower than the voltage V1 for the desired black signal. This causes response failure in several frames, and trailing therefore occurs.

On the contrary, in the present embodiment, the voltage V1 for the desired black signal is a voltage for pre-tilt of the liquid crystal molecules 20. More specifically, the voltage V1 is expressed by a grayscale level and/or standardized luminance as below. In the charge share voltage fixing-use power source 35, data signals (non-image signals; pre-tilt signals) to be supplied to the source lines SL1-SLn at the polarity reversal of the data signals S(1)-S(n) are set as follows.

Figure 19:
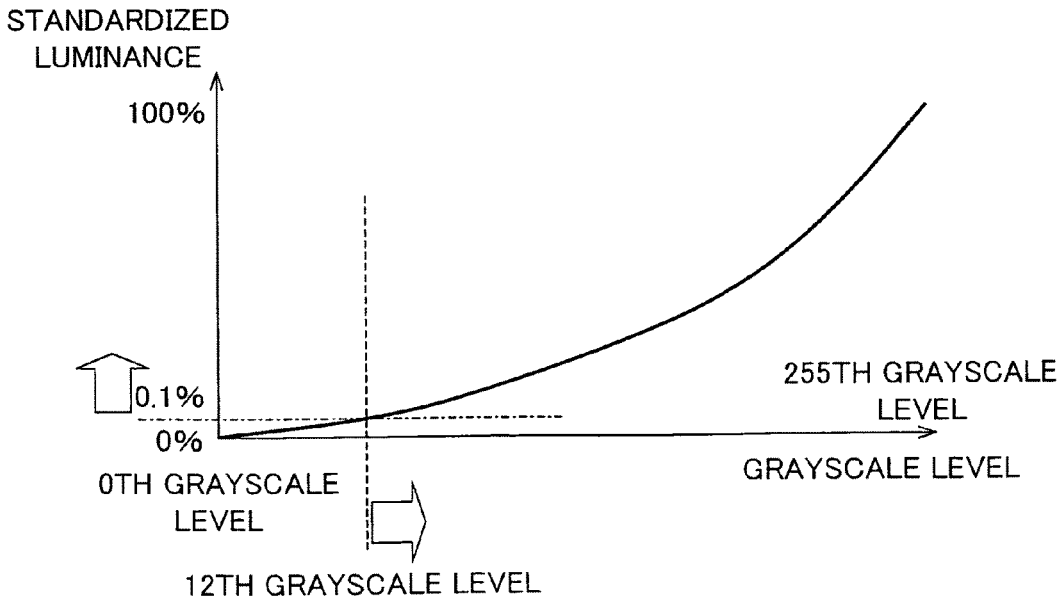
FIG. 19 is a view showing a desired luminance and the range of grayscale levels when a longitudinal axis is standardized luminance and a lateral axis is grayscale level.

As illustrated in FIG. 19, a longitudinal axis indicates standardized luminance, and a lateral axis indicates a grayscale level. In this case, the non-image signal is preferably such that γ characteristic is 2.2, a grayscale level is 12th grayscale level or higher level of the 8-bit grayscale expression (256 grayscale levels), and/or a standardized luminance is 0.1% or more when a white level is 100% and a black level is 0%. To obtain these preferable values, the present inventors examined the level of trailing afterimage with varying levels of the pretilt signal. When the grayscale level is set to be 12th grayscale level or higher level (and/or the standardized luminance is 0.1% or more), trailing afterimage can be improved.

Figure 20:
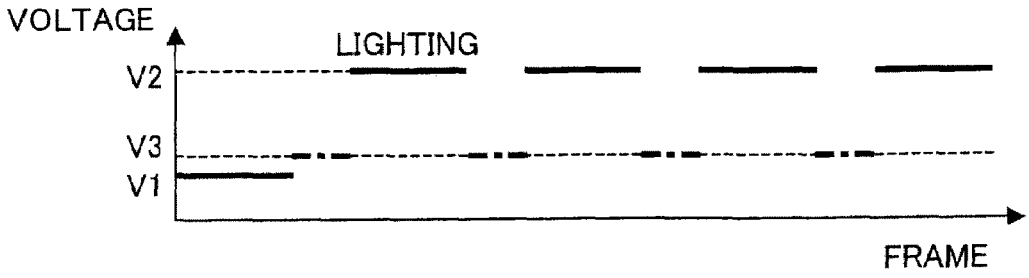
FIG. 20(*a*) is a view showing a voltage-frame relationship when a desired luminance and the range of grayscale levels are as shown in FIG. 19, corresponding to FIG. 18(*a*).
Figure 20:
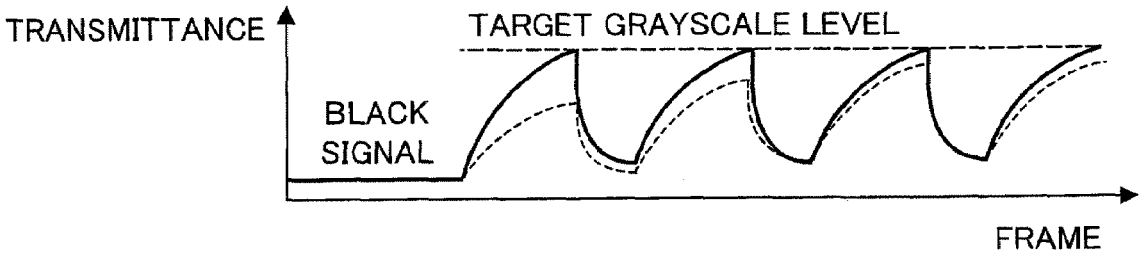

FIGS. 20(*a*) and 20(*b*) are graphs for explaining response of liquid crystal molecules when the pre-tilt signal is set so that γ characteristic is 2.2, and a grayscale level is 12th grayscale level or higher level out of 256 display grayscale levels. As illustrated in FIG. 20(*a*), assume that black writing is performed at the voltage V3 under the conditions where the pre-tilt signal is set so that γ characteristic is 2.2, and a grayscale level is 12th grayscale level or higher level out of 256 display grayscale levels. In this case, as indicated by a solid line in FIG. 20(*b*), reach for the target grayscale level is achieved every time shift is performed from black writing to lighting state, i.e. response is made in the state where the voltage V3 for black writing at which no response failure occurs is applied. This improves the occurrence of trailing.

Figure 21:
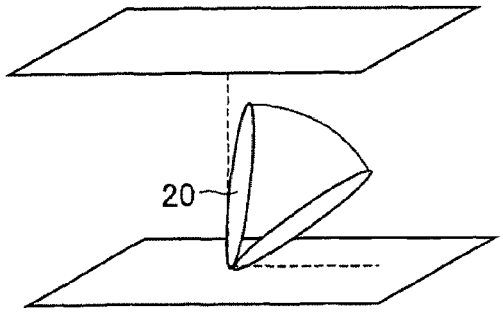
FIG. 21 is a view illustrating the manner that the liquid crystal molecule 20 slightly tilted from a vertically aligned state is fallen down by black writing under the conditions where a pre-tilt signal is set so that a grayscale level is 12th grayscale level or higher level out of 256 grayscale levels ($\gamma$=2.2).

More specifically, when black writing is performed under the condition where the pre-tilt signal is set so that γ characteristic is 2.2, and a grayscale level is 12th grayscale level or higher level out of 256 display grayscale levels, liquid crystal molecules 20 in vertically aligned state tilt slightly, as illustrated in FIG. 21. When a high voltage is applied to the liquid crystal molecules 20 tilting slightly, the liquid crystal molecules 20 fall down in the desired direction (correct direction). Therefore, it is possible to prevent the occurrence of response failure.

Apart from the above, in a case where display luminance T when white luminance level is 1 and black luminance level is 0 is nearly close to $T=(L/Lw)^{\gamma}$ where L is display grayscale level, Lw is white display grayscale, and γ is γ characteristics, the pre-tilt signal may be a signal indicating $Lw\times10^{(-3/\gamma)}$ or greater. Further, regarding γ indicating γ characteristics, display grayscale L is defined as: $L=255\times T^{(1/2.2)}$ where T is display luminance when white luminance level is 1 and black luminance level is 0, and the pre-tilt signal may be a signal that generates a grayscale voltage higher than a grayscale voltage obtained when L=12. In these cases, it is also possible to improve the occurrence of trailing.

Note that γ=2.2 is herein formulized as shown above. Waveforms of a curb indicating γ=2.2 are at least the following two types of waveforms:

(i) $T=(L/255)^{2.2}$; and (ii) $T=(L/255)/4.5$ or $(L/255+0.099)/1.099)^{2.2}$.

When overshoot driving (OS driving) is performed with black writing under the conditions where the pre-tilt signal is set so that γ characteristics is 2.2, and a grayscale level is 12th grayscale level or higher level out of 256 display grayscale levels, the following effect is obtained. The OS driving is a technique for applying a voltage much higher than the target grayscale voltage to compensate for grayscale transition with slow response. Generally, the OS driving is a driving performed in accordance with an appropriate amount of OS (amount of grayscale correction) which is calculated from a start grayscale level and a target grayscale level. That is, the amount of OS is calculated by the following equation:

Amount of OS=target grayscale level+α(target grayscale level, target grayscale level) (where α is function).

Figure 22:
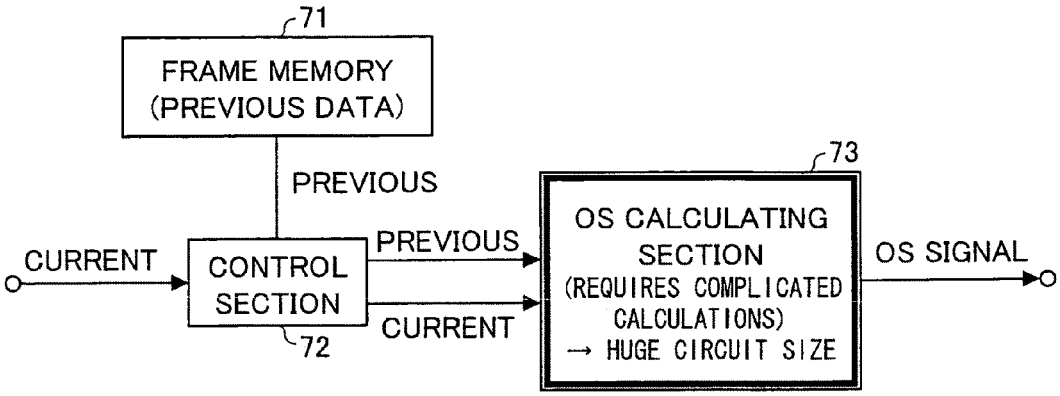
FIG. 22 is a block diagram illustrating an OS drive circuit in a case where a horizontal azimuth direction cannot be controlled.

Therefore, under the situation where a horizontal azimuth direction cannot be controlled by the above-described voltage application, OS driving cannot control response characteristics of the liquid crystal display device. That is, the component that cannot be controlled by voltage or grayscale level needs to be considered in performing OS driving, which requires construction of a special correction algorithm. For this reason, in order to perform OS driving, an OS calculating section 73 with a huge circuit size incorporating therein a correction algorithm that requires complicated calculations, needed to be provided, as illustrated in FIG. 22, in addition to a frame memory 71 into which previous data is stored and a control section 72, which are provided in a liquid crystal display device that performs normal OS driving. This increased a circuit size and thus gave rise to the problem of difficulty of calculation in real time.

Figure 23:
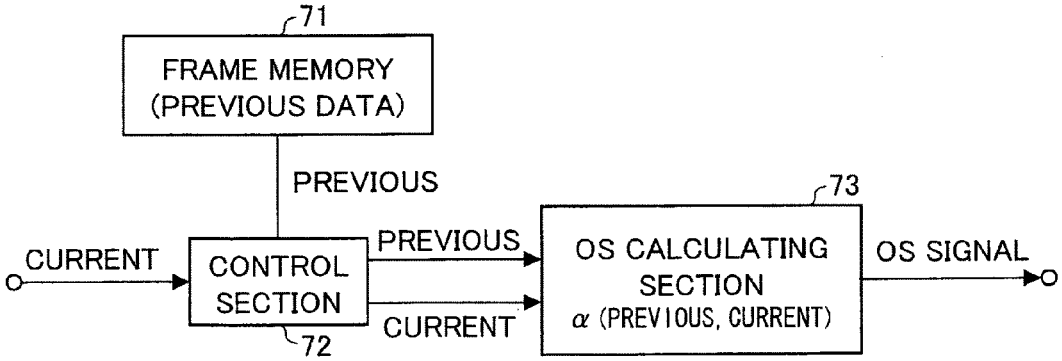
FIG. 23 is a block diagram illustrating an OS drive circuit in a case where a horizontal azimuth direction can be controlled.

On the contrary, in a case where black writing is performed under the conditions where the pre-tilt signal is set so that a grayscale level is 12th grayscale level or higher level out of the 256 grayscale levels ($\gamma$=2.2) as described above, the alignment of liquid crystal molecules can be controlled by grayscale (i.e. voltage), which enables a to be corrected by a simple approximate expression or a lookup table. This allows a drive circuit of the OS calculating section 73 to be of a relatively small size, as illustrated in FIG. 23.

In the above case, the pre-tilt signal is a signal indicating that $\gamma$ characteristics is 2.2 and a grayscale level is 12th grayscale level or higher level out of 256 display grayscale levels. However, the present embodiment is not limited to this. For example, the pre-tilt signal may be a signal indicating that $\gamma$ characteristics is 2.2 and a grayscale level is 45th grayscale level or higher level out of 1024 display grayscale levels. This can also bring the same effect as above.

Figure 24:
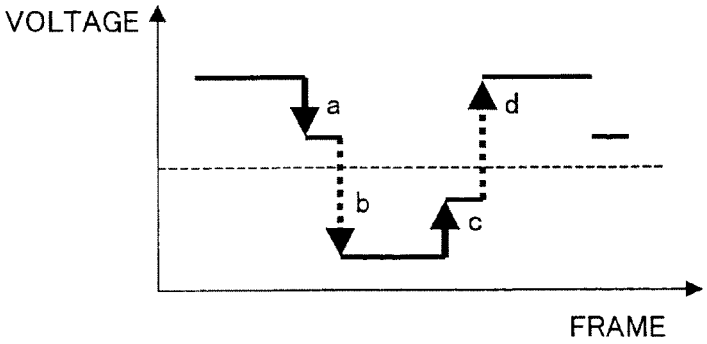
FIG. 24 is a graph showing an ideal voltage-to-frame relationship for black writing.

The following will describe an additional measure for improvement in the case where a voltage for black writing is fixed by using the charge share voltage fixing-use power source 35 as described above. First of all, an ideal voltage-to-frame relationship for black writing is described. As illustrated in FIG. 24, an ideal voltage-to-frame relationship is such that potential differences a and c for polarity reversal at the time of writing a video signal are equal to each other, and potential differences b and d for polarity reversal at the time of black writing are equal to each other. In this case, potential differences are identical in each of the states, and it is therefore possible to increase a response speed. Polarities of the potential for black writing are different from each other and therefore balanced. This makes it possible to increase reliability without the occurrence of electrical offset. The polarity of the pre-tilt signal applied to a pixel at the end of a frame is preferably identical with the polarity of a data signal in the subsequent frame. This enables the pixel to be charged in advance, which is advantageous in terms of increasing a charging rate of a pixel.

Figure 25:
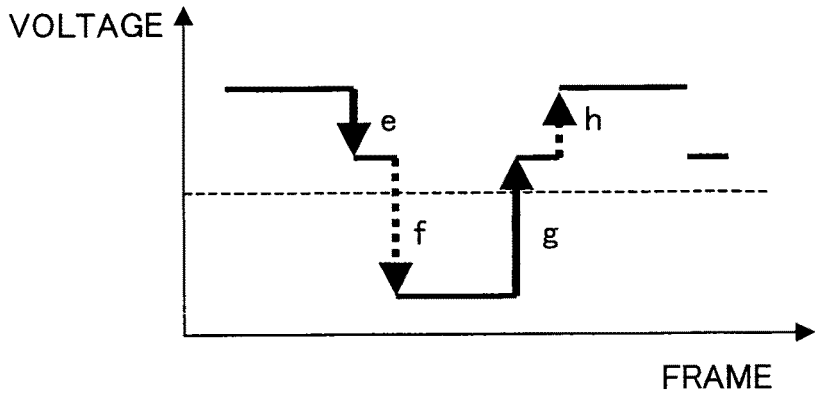
FIG. 25 is a graph showing a voltage-to-frame relationship in a case where black writing is performed with a fixed electric potential.

On the other hand, in a case where black writing is performed at a fixed value as described above, potential differences e and f for polarity reversal at the time of writing a video signal are different from each other, and potential differences g and h for polarity reversal at the time of black writing are different from each other, as illustrated in FIG. 25. Since response characteristics of liquid crystal vary depending upon a potential difference, response characteristics vary, and luminance varies depending upon a polarity. For this reason, in the case of dot inversion driving, for example, uneven response with checked pattern occurs. In a case where black writing is performed at a fixed value, imbalance between positive and negative polarities of pixels occurs, as illustrated in FIG. 25. That is, polarities of a voltage for black writing become one-sided, which causes electrical offset and thus gives rise to reliability concerns.

Figure 26:
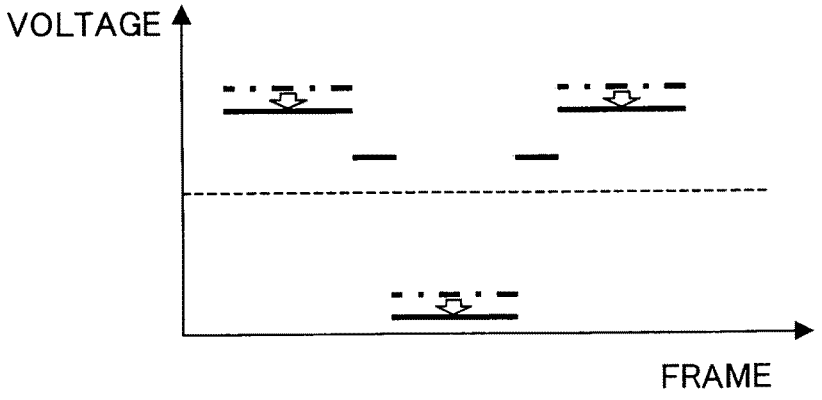
FIG. 26 is a graph showing a voltage-to-frame relationship in a case where rms values at a positive polarity and a negative polarity are corrected by adjustment of an analogue voltage, considering the voltage-to-frame relationship shown in FIG. 25.

On the contrary, in the present embodiment, rms values at positive polarity and negative polarity are corrected by adjusting an analogue voltage, as illustrated in FIG. 26. This makes it possible to improve reliability and prevent the occurrence of screen burn-in. Further, digital correction for a proper OS driving may be performed by (a) the analogue correction and (b) correction with respect to a video signal to be supplied to each pixel of the display section 1 according to polarity reversal information, or by the correction (b) only.

Figure 27:
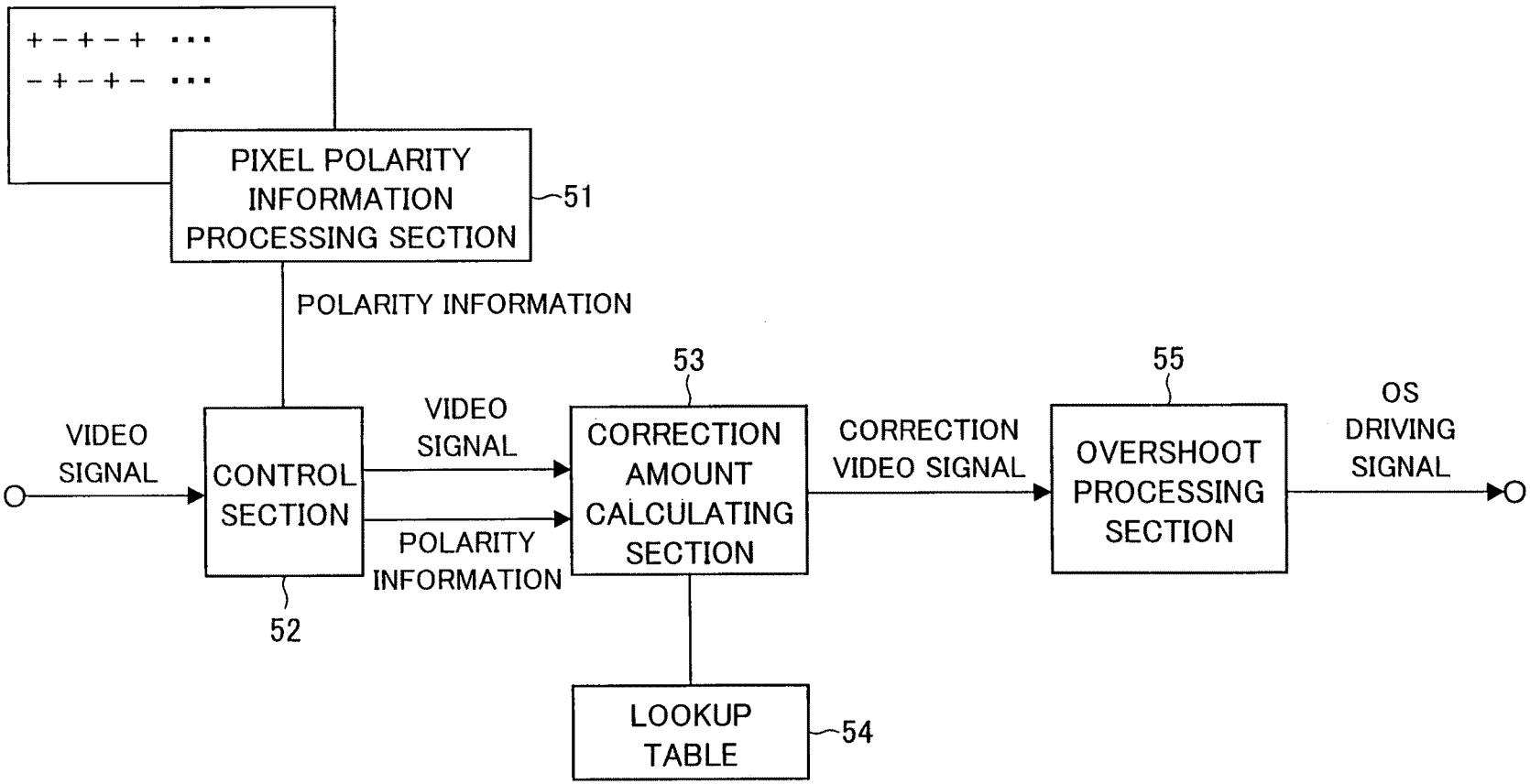
FIG. 27 is a block diagram schematically illustrating the configuration of an OS drive circuit.

The configuration of an overshoot drive circuit (OS drive circuit) for the digital correction will be described with reference to a block diagram. The OS drive circuit is provided at the previous stage of the display control circuit 2 (FIG. 2) and includes pixel polarity information processing section (polarity information processing section) 51, a control section 52, a correction amount calculating section 53, a lookup table (LUT) 54, and an overshoot processing section 55, as illustrated in FIG. 27.

The polarity information processing section 51 detects polarity information on which polarity (+ or −) a pixel takes, on the basis of a pre-designed condition of inversion driving, such as dot inversion driving, and positional information of a pixel in the display section 1 (in a panel). As an example, the case of the inversion driving condition in a dot inversion method will be described. The relationship of (x,y) indicating polarity information of a pixel and an address that is positional information of a pixel is as follows: As illustrated in FIG. 28, polarity information of a pixel is + when x and y are both odd-numbers or even-numbers, and polarity information of a pixel is − when x and y are respectively an odd number and an even number, and vice versa. That is, if the inversion driving condition is determined, it is possible to uniquely obtain polarity information of a pixel from positional information of the pixel.

The control section 52 receives a video signal (digital image signal DA; FIG. 2) from an external entity, and receives polarity information (+ or −) of a pixel from the polarity information processing section 51. The correction amount calculating section 53 receives a video signal and information on polarity from the control section 52, and obtains a correction value with reference to the LUT 54. The correction amount calculating section 53 transmits the obtained correction value in the form of correction video signal to the overshoot processing section 55 at the subsequent stage. FIG. 29 shows an example of the LUT 54. As illustrated in FIG. 29, the LUT 54 includes correction values assigned to pieces of polarity information of pixels and video signals. For example, in a case where (video signal, polarity information)=(5, +), a correction value of "8" can be obtained.

The overshoot processing section 55 compares the correction video signal recently received from the correction amount calculating section 53 with a previous correction video signal that has been stored in a frame memory (not shown), and then transmits an OS driving signal, in which the recently received correction video signal is emphasized appropriately, to the display control circuit 2, which is a display driving section.

Figure 30:
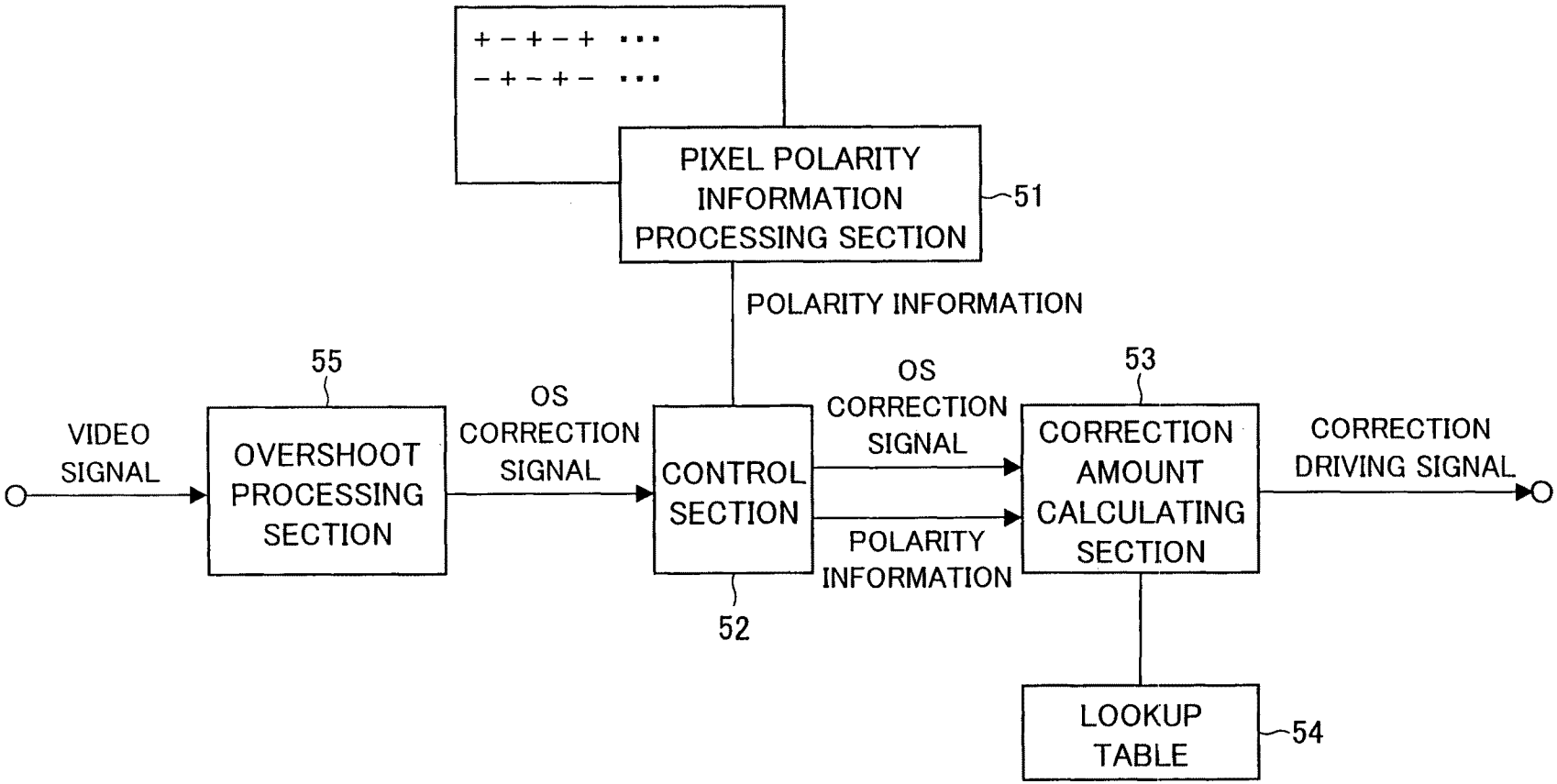
FIG. 30 is a block diagram schematically illustrating the configuration of another OS drive circuit.

The layout of the components in the OS drive circuit is not limited to the layout illustrated in FIG. 27, and may be the layout as below. In FIG. 27, the components are arranged, from the front end to the rear end of the OS drive circuit, in the following order: the pixel polarity information processing section 51 and the control section 52→the correction amount calculating section 53 and the lookup table 54,→the overshoot driving section 55. However, as illustrated in FIG. 30, the components may be arranged, from the front end to the rear end of the OS drive circuit, in the following order: the overshoot driving section 55→the pixel polarity information processing section 51 and the control section 52→the correction amount calculating section 53 and the lookup table 54. That is, the digital correction and the overshoot driving may be performed in reversed order.

The following will describe how the OS drive circuit illustrated in FIG. 30 operates. Explanation of the same matters as those that have been already described will be omitted appropriately.

The overshoot driving section 55 receives a video signal from an external entity, compares the currently received video signal with the previous video signal, and transmits an OS correction signal indicative of the amount of overshoot correction, in which the current video signal is emphasized properly, to the control section 52. The control section 52 that has received the OS correction signal receives polarity information (+ or −) of a pixel from the polarity information processing section 51.

The correction amount calculating section 53 receives the OS correction signal and the polarity information from the control section 52, and then obtains a correction value as the amount of grayscale correction with reference to the LUT 54. The correction amount calculating section 53 transmits the correction value as the correction driving signal to the display control circuit 2, which is a display drive section.

Figures 31, 32:
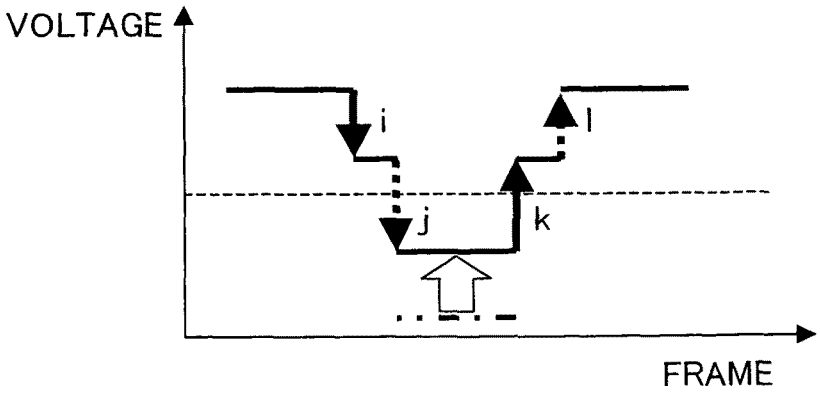
FIG. 31 is a view showing the structure of a LUT illustrated in FIG. 30.
FIG. 32 is a graph showing a voltage-to-frame relationship in a case where polarity values are subjected to digital correction by using the OS drive circuit illustrated in FIG. 27, considering the voltage-to-frame relationship shown in FIG. 25.

Next, FIG. 31 shows an example of the LUT 54 illustrated in FIG. 30. As illustrated in FIG. 31, the LUT 54 includes correction values assigned to pieces of polarity information of pixels and OS correction signals. For example, in a case where (OS correction signal, polarity information)=(5, +), a correction value of "6" can be obtained.

By the digital correction as above, it is possible to perform grayscale correction as illustrated in FIG. 32. With this arrangement, potential differences i and j for polarity reversal at the time of writing a video signal can be made substantially identical with each other, and potential differences k and l for polarity reversal at the time of black writing can be made substantially identical with each other, while a voltage for black writing is kept fixed. As a result of this, potential differences become identical in each of the states, and it is therefore possible to increase a response speed.

Figure 33:
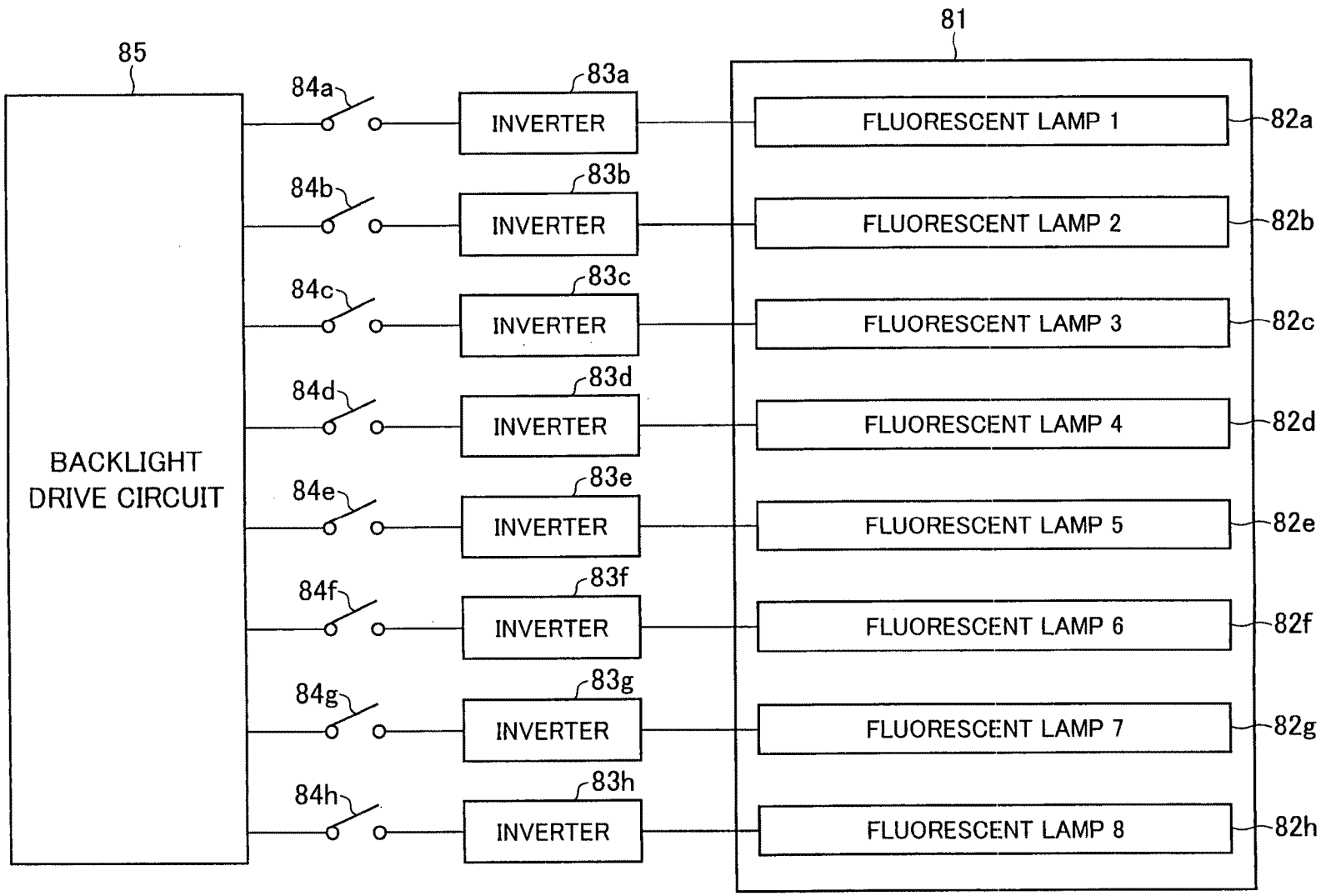
FIG. 33 is a diagram schematically illustrating the configuration of a backlight.

Further, a backlight provided in the liquid crystal display device may be turned off in sync with the timing of black writing. The backlight is provided on the backside of a liquid crystal display panel 81 of the liquid crystal display device. As illustrated in FIG. 33, the backlight includes: a plurality of (eight) direct-projection fluorescent lamps (backlights) 82*a*-82*h*; a plurality of inverters 83*a*-83*h* respectively connected to the fluorescent lamps 82*a*-82*h*; changeover switches 84*a*-84*h* respectively connected to the inverters 83*a*-83*h*; and a backlight drive circuit 85 which unifies the changeover switches 84*a*-84*h*.

The fluorescent lamps 82*a*-82*h* are arranged in parallel to the gate lines GL1-GLm (FIG. 2), and turned on/off in the arranged order in sync with the scanning signals G(1)-G(m) (FIG. 2). As described above, the inverters 83*a*-83*h* and the changeover switches 84*a*-84*h* are provided respectively for the fluorescent lamps 82*a*-82*h*, so that the fluorescent lamps 82*a*-82*h* can be turn on/off independently. As illustrated in FIG. 33, the fluorescent lamps 82*a*-82*h* are provided corresponding to eight division display areas into which the liquid crystal display panel 81 is divided into eight areas in the vertical direction. The fluorescent lamps 82 can be, for example, cold-cathode tubes.

The backlight drive circuit 85 controls turn-off/on of the fluorescent lamps 82*a*-82*h* by turning on/off the changeover switches 84*a*-84*h* in sync with the scanning signals G(1)-G (m) supplied from an external entity.

Figure 34:
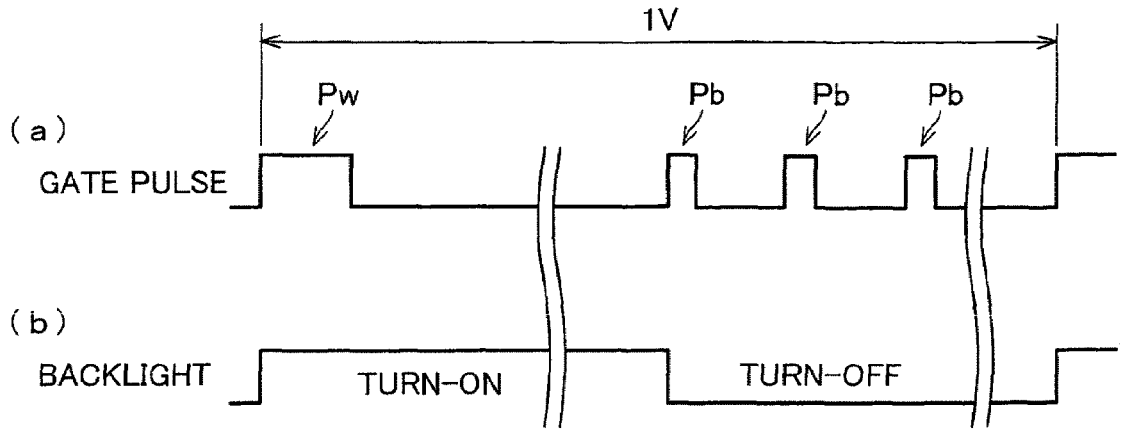
FIG. 34 is waveform diagrams wherein (a) is a waveform diagram showing a scanning signal applied to a certain gate line GLj in 1V, and (b) is a waveform diagram showing turn-on/off of a backlight in 1V.

Next, the operation of the backlight will be described. FIG. 34(*a*) is a waveform diagram of a scanning signal applied to a certain gate line GLj in one vertical scanning period (1V). FIG. 34(*b*) is a waveform diagram showing turn-on/off of the backlight in one vertical scanning period (1V). In FIG. 34(*b*), the backlight is turned on at high level and turned off at low level. For example, when the pixel data write pulse Pw is applied to the gate line GL1, which is provided in the first (top) division area as illustrated in FIG. 34(*a*), the backlight drive circuit 85 turns on the changeover switch 84*a*, which is provided corresponding to the fluorescent lamp 82*a*, in sync with the pixel data write pulse Pw to turn on the fluorescent lamp 82*a*.

Next, when the black voltage application pulse Pb is applied to the gate line GL1 as illustrated in FIG. 34(*a*), the backlight drive circuit 85 turns off the changeover switch 84*a*, which is provided corresponding to the fluorescent lamp 82*a*, in sync with the application of the black voltage application pulse Pb to turn off the fluorescent lamp 82*a* as illustrated in FIG. 34(*b*). Then, the fluorescent lamp 82*a* maintains a turn-off state until the pixel data write pulse Pw is applied to the gate line GL1 in next frame.

Similarly, the above operation is performed in each of the division display areas. That is, in the division display areas, the turn-off and turn-on of the fluorescent lamps 82*a*-82*h*, which area provided respectively for the division display areas, are performed in every one vertical scanning period. With the arrangement in which the fluorescent lamps 82*a*-82*h* are turned off in sync with the application of the black voltage application pulse Pb as described above, the amount of transmitted light can be decreased, for example, even in a case where pixel transmittance of the liquid crystal display panel 81 insufficiently decreases due to application of incomplete black voltage. Therefore, it is possible to increase the impulse effect. That is, it is possible to independently determine a pre-tilt voltage with the main aim of improving a response speed of liquid crystal.

In the above example, the number of fluorescent lamps 82*a*-82*h* is 8, which is not the only possibility. With increase of the number of fluorescent lamps 82*a*-82*h*, the number of gate lines for each fluorescent lamp decreases. This reduces luminance unevenness caused by difference in times for application of the pixel data write pulse Pw and the black voltage application pulse Pb to the gate lines GLj. However, the number of fluorescent lamps 82*a*-82*h*, the number of inverters 83*a*-83*h*, the number of changeover switches 84*a*-84*h* increase. This increases production cost and power consumption.

If there are too few fluorescent lamps 82*a*-82*h*, a desired display luminance cannot be obtained. In this case, fluorescent lamps 82*a*-82*h* may be hot-cathode tubes in order to increase luminescent efficiency of the fluorescent lamps 82*a*-82*h*. Alternatively, the fluorescent lamps 82*a*-82*h* may be light sources such as LEDs. In a case where the fluorescent lamps 82*a*-82*h* are LEDs, it is possible to divide the division display area more flexibly.

In the above case, the fluorescent lamps 82*a*-82*h* are completely turned off by the changeover switches 84*a*-84*h*. Alternatively, luminance of the fluorescent lamp, i.e. lamp luminance may be decreased by control of lamp currents flown to the fluorescent lamps 82*a*-82*h* in a state where the fluorescent lamps 82*a*-82*h* are turned on. Further, in the above case, the fluorescent lamps 82*a*-82*h* are turned on/off in sync with the pixel data write pulse Pw and the black voltage application pulse Pb applied to the (first) gate line GL1 at the first line in each of the division display areas. In order to increase the uniformity of the impulse effect due to turn-off of the fluorescent lamps 82*a*-82*h* in the division display areas, it is preferable that the fluorescent lamps 82*a*-82*h* are turned on/off in sync with the pixel data write pulse Pw and the black voltage application pulse Pb applied to the gate line in the center of each of the division display areas. However, turn-on/off of the fluorescent lamps 82*a*-82*h* may be in sync with the pixel data write pulse Pw and the black voltage application pulse Pb applied to any of the gate lines.

Further, a television receiver to which the above liquid crystal display device is applied will be described with reference to FIGS. 35 through 37. That is, each of the above liquid crystal display devices can be used in a television receiver.

Figure 35:
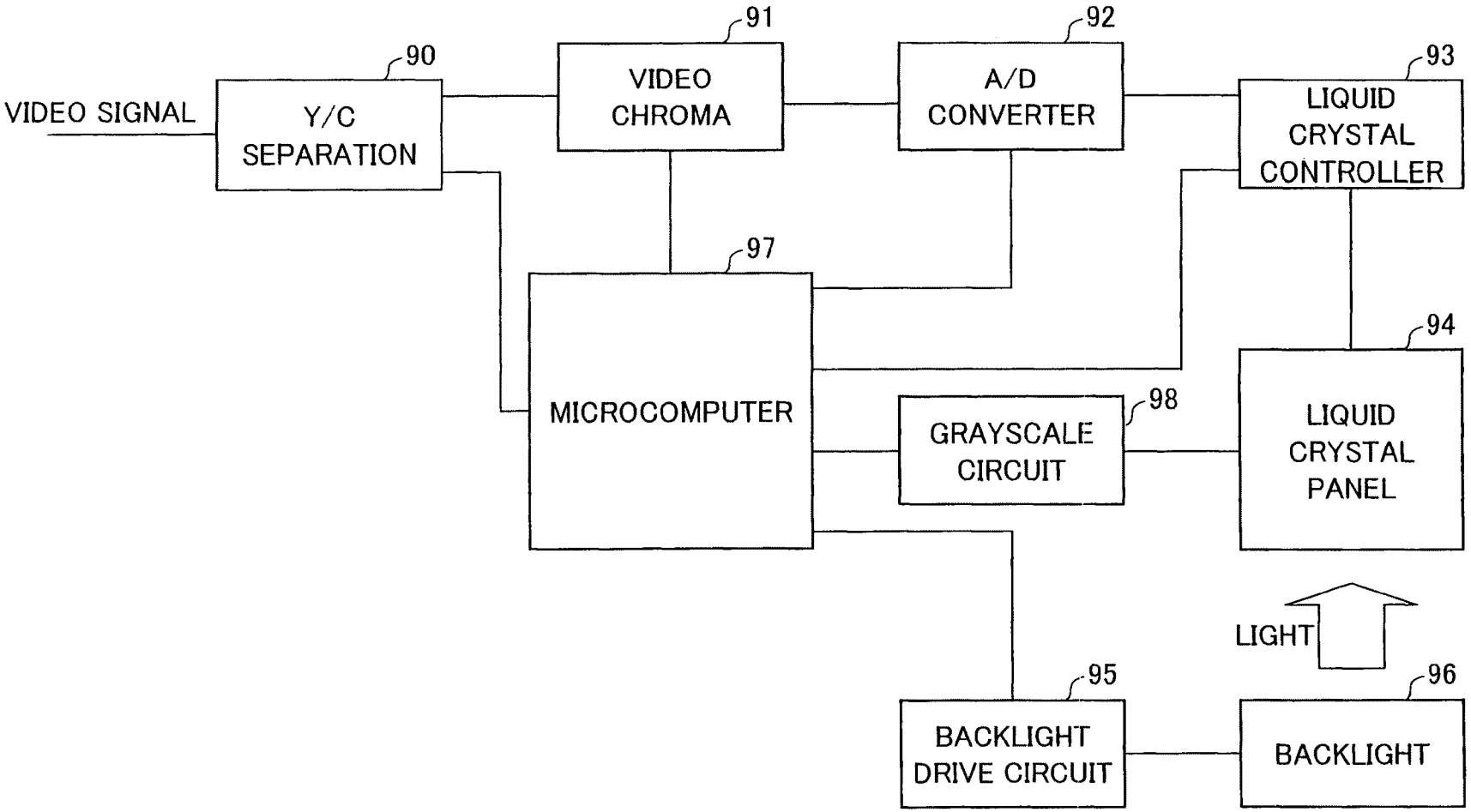
FIG. 35 is a circuit block diagram of a liquid crystal display device for use in a television receiver.

FIG. 35 is a circuit block diagram of a liquid crystal display device for use in a television receiver. As illustrated in FIG. 35, the liquid crystal display device includes a Y/C separation circuit 90, a video chroma circuit 91, an A/D converter 92, a liquid crystal controller 93, a liquid crystal panel 94, a backlight drive circuit 95, a backlight 96, a microcomputer 97, and a grayscale circuit 98.

The liquid crystal panel 94 may be of any of the arrangements in the embodiments described previously. In the above-arranged liquid crystal display device, an input video signal of a television signal is supplied to the Y/C separation circuit 90 to be separated into a luminance signal and a color signal. The luminance signal and the color signal are converted into R, G, B, which are light's three primary colors, by the video chroma circuit 91. Further, the analogue RGB signal is converted into a digital RGB signal by the A/D converter 92, and the digital RGB signal is then supplied to the liquid crystal controller 93.

To the liquid crystal panel 94, the RGB signal from the liquid crystal controller 93 is supplied at a predetermined timing, while grayscale voltages respectively corresponding to R, G, B are supplied from the grayscale circuit 98, whereby an image is displayed. Control of the whole system, including these operations, is performed by the microcomputer 97. Note that displayable video signals are various kinds of video signals including a video signal based on television broadcast, a video signal corresponding to an image captured by a camera, and a video signal supplied via the Internet.

Figure 36:
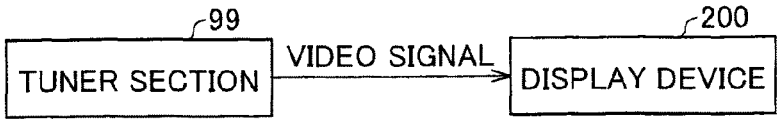
FIG. 36 is a block diagram illustrating signal transmission from a tuner section to a display device.

Further, a tuner section 99 illustrated in FIG. 36 receives a television broadcast and outputs corresponding video signals. On the liquid crystal display device (display device) 200, an image (video image) is displayed in accordance with the video signals outputted from the tuner section 99.

Figure 37:
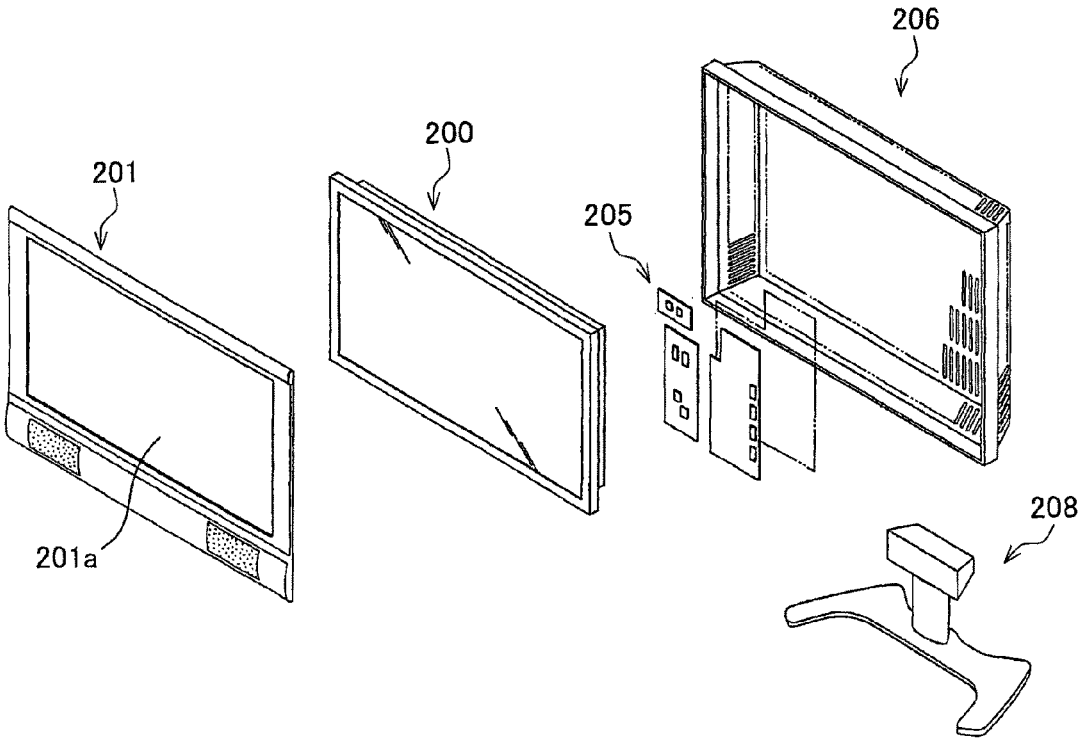
FIG. 37 is an exploded perspective view illustrating a television receiver that includes a liquid crystal display device.

In a case where the liquid crystal display device arranged as above is a television receiver, a liquid crystal display device 200 is sandwiched between a first case 201 and a second case 206 so as to be encased in between the first case 201 and the second case 206, for example, as illustrated in FIG. 37. The first case 201 has an opening 201*a* which transmits a video image to be displayed on the liquid crystal display device 200. The second case 206 is the one with which the rear surface of the liquid crystal display device 200. The second case 206 is provided with an operation circuit 205 for operating the liquid crystal display device 200, and a support member 208 is attached to the lower end of the second case 206.

The gate driver 4 is not limited to the gate driver having the configuration illustrated in FIGS. 5(*a*) and 5(*b*), as long as it generates the scanning signals G(1)-G(m) illustrated in (d) and (e) of FIG. 1. In the above case, three black voltage application pulses Pb are applied to each of the gate line GLj in each frame period, as illustrated in (d) and (e) of FIG. 1. The number of black voltage application pulses Pb in one frame period, i.e. the number of times one gate line becomes in a selected state in the black signal insertion period in each frame period is not limited to three. The number of black voltage application pulses Pb is merely required to be not less than one, on condition of allowing for a black-level display. As is apparent from (f) in FIG. 1, by changing the number of black voltage application pulses Pb in one frame period, it is possible to set black level (display luminance) in the black display period Tbk at a desired value.

Further, in the above embodiment, the black voltage application pulse Pb is applied to each of the gate lines GLj ((d) and (e) of FIG. 1) at a point in time when the pixel data holding period Thd, which is ⅔ frame period long, elapses since the application of the pixel data write pulse Pw, and black insertion of approximately ⅓ frame period is performed in each frame. However, the black display period Tbk is not limited to ⅓ frame period. A longer black display period Tbk brings a profound effect of impulse display and is effective in improving moving image display performance (e.g. suppression of trailing afterimage), but decreases display luminance. Therefore, the black display period Tbk is appropriately set in consideration of the effect of impulse display and display luminance.

In the above embodiment, as illustrated in FIGS. 11 and 12, switching circuit by which the application of the data signals S(1)-S(n) to the source lines SL1-SLn during the charge sharing period Tsh is interrupted and the source lines SL1-SLn (adjacent source lines) are caused to short-circuit to one another are constituted by (i) the first MOS transistors SWa, (ii) either the second MOS transistors SWb and the third MOS transistors SWb2 or the second MOS transistors SWc, and (iii) the inverters 33, and the switching circuits are included in the source driver 3. Alternatively, part or all of the switching circuits may be provided outside the source driver 3, for example, a switching circuit is integrated with a pixel array in the display section 1, by using TFT.

Figure 38:
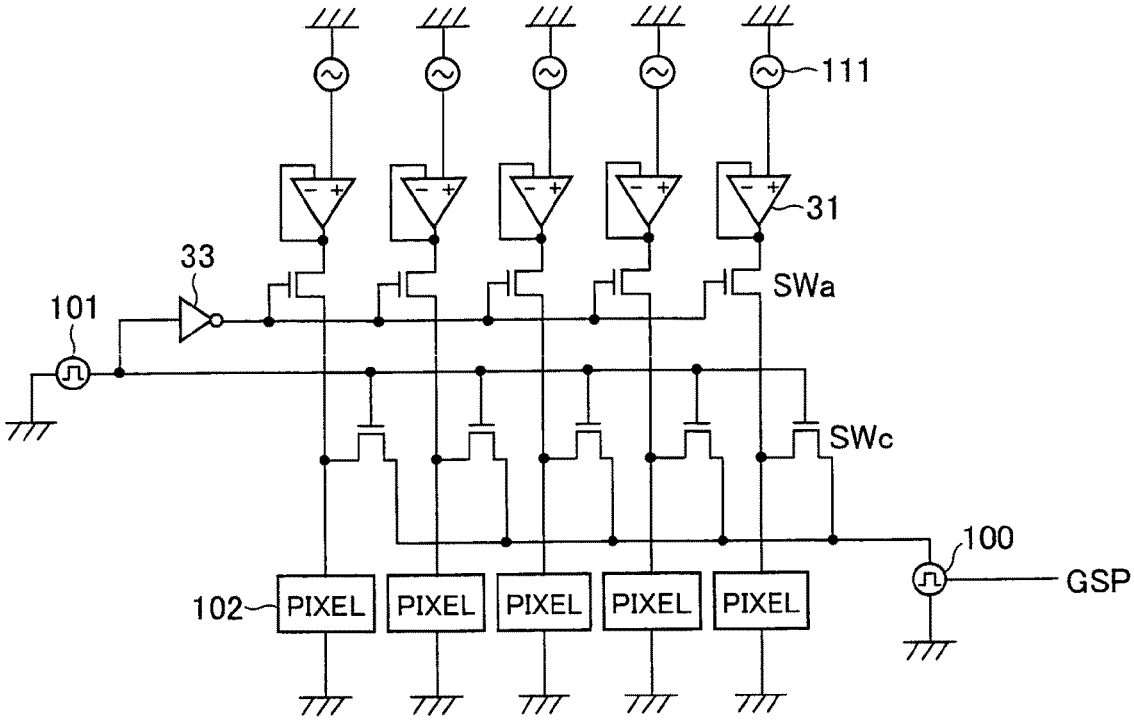
FIG. 38 is a circuit diagram illustrating yet another configuration of the output section of the source driver.

FIG. 38 is a circuit diagram illustrating another configuration of the output section 13 of the source driver 3. (a) through (d) in FIG. 39 are waveform diagrams for explaining a method of driving the source driver 3 that includes the output section 13 illustrated in FIG. 38.

The output section 13 illustrated in FIG. 38 is substantially the same as the output section 13 of the source driver 3 illustrated in FIG. 12. Therefore, only differences from the output section 13 of the source driver 3 illustrated in FIG. 12 will be described. The output section illustrated in FIG. 38 includes a first polarity reversal power source 100 that reverses polarities, instead of the charge share voltage fixing-use power source 35 illustrated in FIG. 12. The output section 13 illustrated in FIG. 38 includes a first charge share control signal source 101 that generates the charge share control signal Csh. The first charge share control signal source 101 is also provided in the output section 13 illustrated in FIGS. 11 and 12. To the source lines SL1-SLn, pixels (picture elements) 102 are provided. At the previous stage of each of the output buffers 31, an input signal source 111 which generates an analogue voltage signal d(i) is provided.

Especially, to the first polarity reversal power source 100 connected to the second MOS transistor SWc, gate start pulse GSP is supplied. The first polarity reversal power source 100 generates a voltage whose polarity reverses in sync with the supplied gate start pulse GSP. "Polarity reversal" means change from positive (+) polarity to negative (−) polarity and vice versa with respect to a common voltage.

Figure 39:
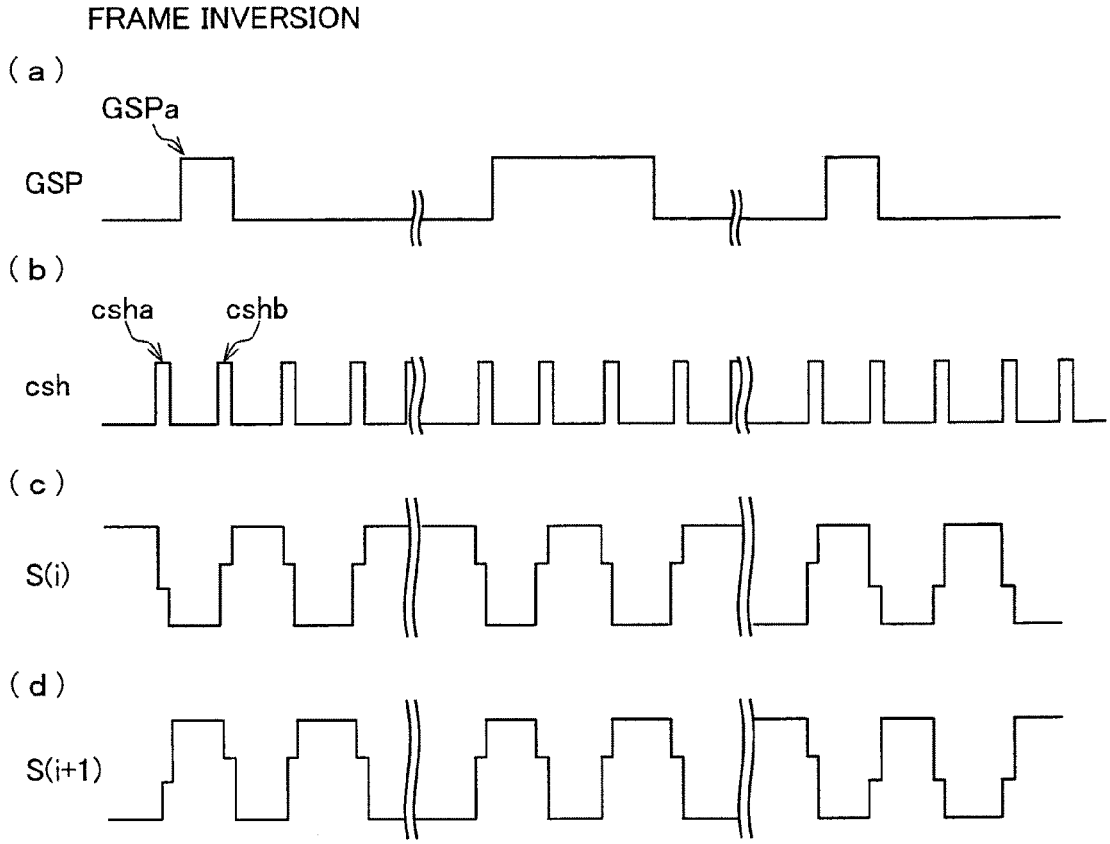
FIG. 39 is waveform diagrams wherein (a) is a waveform diagram showing a gate start pulse signal GSP, (b) is a waveform diagram showing a charge share control signal, (c) is a waveform diagram showing a data signal, and (d) is a waveform diagram showing a data signal.

More specifically, at the short circuit by a charge share control signal csha that is synchronized with GSPa ((a) in FIG. 39) corresponding to the pixel data write pulse and at the short circuit ((b) in FIG. 39) by a charge share control signal cshb, voltages that are opposite in polarity are applied respectively to the source lines SLn and SLn+1 ((c) and (d) in FIG. 39). Such an application of voltages of opposite polarities is performed in each 1V (1 frame; one vertical scanning period).

In the present embodiment, the gate start pulse GSP is also supplied in a period corresponding to the black voltage application pulse (i.e. there is also a gate start pulse GSP for black insertion.). Therefore, the first polarity reversal power source 100 reverses polarities of voltages upon application of the gate start pulse GSP other than the gate start pulse GSP for black insertion. Thus, the first polarity reversal power source 100 reverses the polarities every time two gate start pulses GSP are supplied. This makes it possible to reverse the polarities in each frame, thus preventing the occurrence of screen burn-in caused by application of voltages of one-side polarity.

Figure 40:
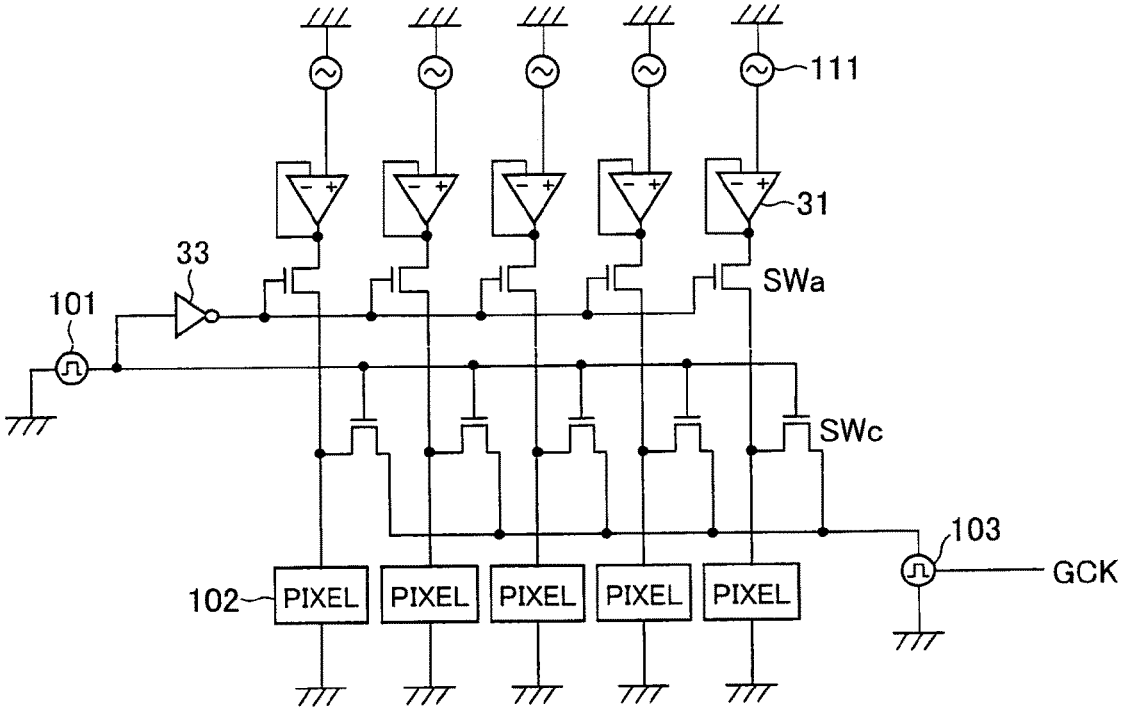
FIG. 40 is a circuit diagram illustrating another configuration of the output section of the source driver.

FIG. 40 is a circuit diagram illustrating still another configuration of the output section 13 of the source driver 3. (a) through (e) in FIG. 41 are waveform diagrams for explaining a method of driving the source driver 3 that includes the output section 13 illustrated in FIG. 40.

The output section 13 illustrated in FIG. 40 includes a second polarity reversal power source 103, instead of the first polarity reversal power source 100 of the output section illustrated in FIG. 38. To the second polarity reversal power source 103, the gate clock signal GCK is supplied from an external entity, as illustrated in FIG. 40. The second polarity reversal power source 103 generates voltages whose polarities are reversed in sync with the supplied gate clock signal GCK.

Figure 41:
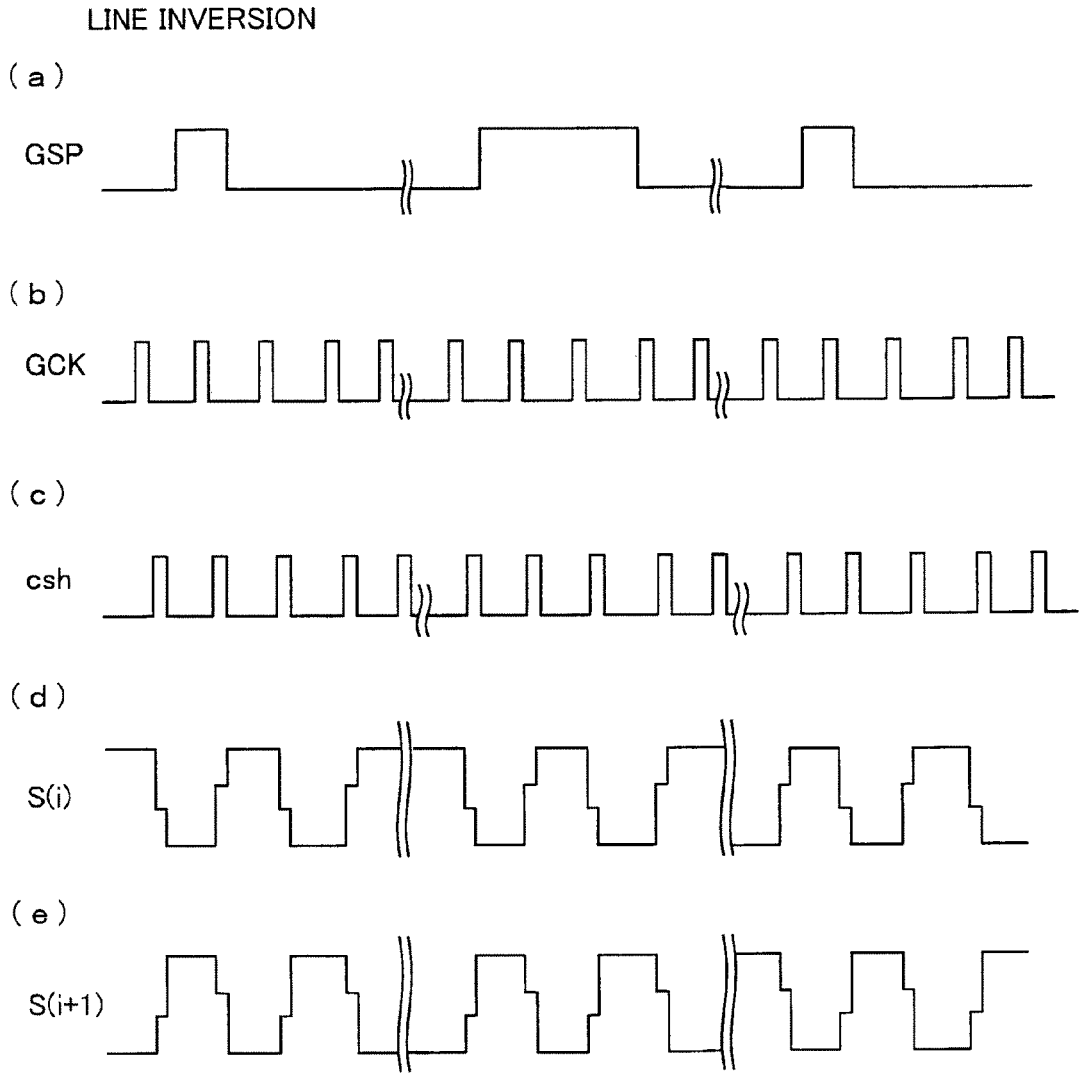
FIG. 41 is waveform diagrams wherein (a) is a waveform diagram showing a gate start pulse signal GSP, (b) is a waveform diagram showing a gate clock signal, (c) is a waveform diagram showing a charge share control signal, (d) is a waveform diagram showing a data signal, and (e) is a waveform diagram showing a data signal.

More specifically, at the short circuit by the charge share control signal csh ((c) in FIG. 41) supplied in sync with the gate clock signal GCK ((b) in FIG. 41), voltages that are opposite in polarity are applied to the source lines SLn and SLn+1 ((d) and (e) in FIG. 41). Such an application of voltages of opposite polarities is performed in each 1H (one horizontal scanning period). Therefore, with the configuration of the output section illustrated in FIG. 39, it is possible to further prevent the occurrence of screen burn-in caused by application of voltages of one-side polarity.

Figure 42:
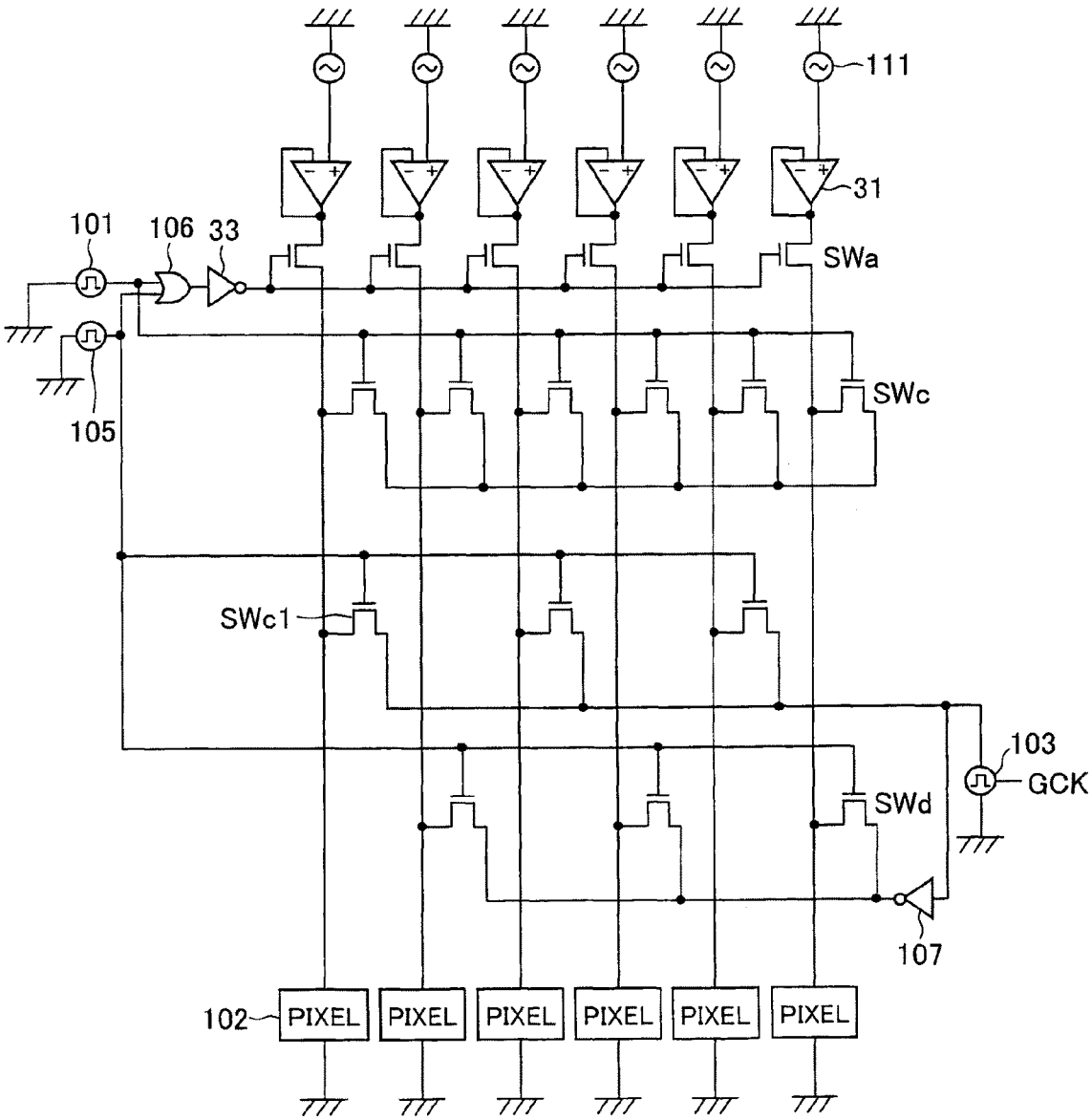
FIG. 42 is a circuit diagram illustrating still another configuration of the output section of the source driver.
Figure 43:
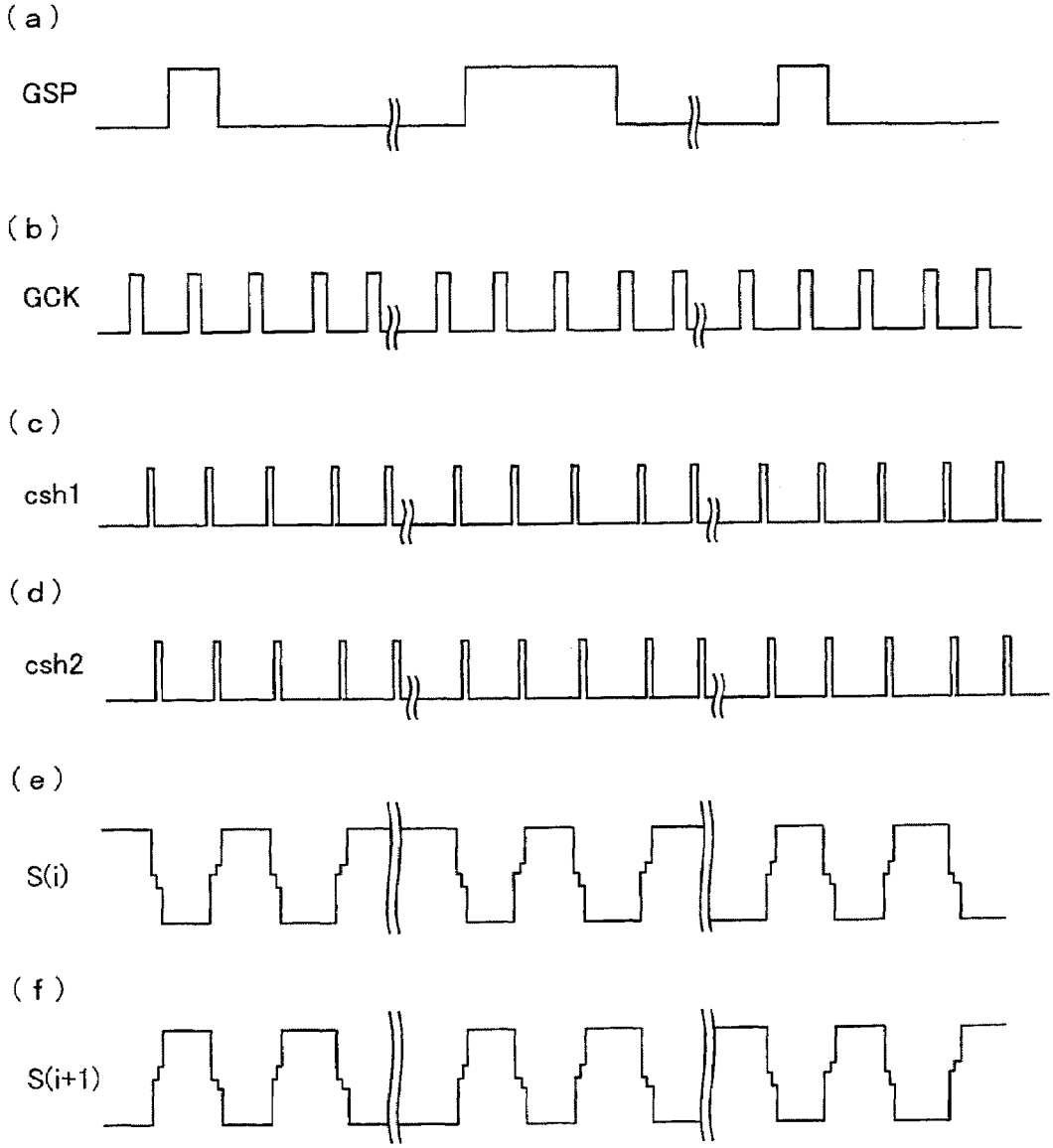
FIG. 43 is waveform diagrams wherein (a) is a waveform diagram showing a gate start pulse signal GSP, (b) is a waveform diagram showing a gate clock signal, (c) is a waveform diagram showing a charge share control signal, (d) is a waveform diagram showing a charge share control signal, (e) is a waveform diagram showing a data signal, and (f) is a waveform diagram showing a data signal.

FIG. 42 is a circuit diagram illustrating yet another configuration of the output section 13 of the source driver 3. (a) through (f) in FIG. 43 are waveforms for explaining a method of driving the source driver 3 that includes the output section 13 illustrated in FIG. 42. The output section 13 illustrated in FIG. 42 includes, in addition to the first charge share control signal source 101, a second charge share control signal source 105 that is provided in parallel to the first charge share control signal source 101.

Further, at the subsequent stage of the first charge share control signal source 101 and the second charge share control signal source 105, an OR gate 106 is provided to which charge share control signals csh1 and chh2 that are generated respectively by the first charge share control signal source 101 and the second charge share control signal source 105, and output of the OR gate 106 is supplied to the inverter 33.

Especially, the output section 13 illustrated in FIG. 42 is provided with fourth MOS transistors SWd on the source lines SLi near the pixels 102 with respect to the second MOS transistors SWc. Each of the fourth MOS transistors SWd is provided between each of pairs of the adjacent source lines of the source lines SL1-SLn. Gate terminals of the fourth MOS transistors SWd are integrated separately on the odd-numbered line and even-numbered line of the source lines SL1-SLn. To the integrated gate terminals on the odd-numbered line and the integrated gate terminals on the even-numbered line, the charge share signal csh2 which is generated by the second charge share control signal source 105 is supplied.

To the odd-numbered source lines SL1, SL3, . . . , voltages generated by the second polarity reversal power source 103 (i.e. voltages whose polarities are reversed in sync with the gate clock signal GCK) are applied. To the even-numbered source lines SL2, SL4, . . . , voltages obtained by the inverter 107 reversing polarities of the voltages generated by the second polarity reversal power source 103 are applied.

More specifically, charge share control signals csh1 and csh2 ((b) and (c) in FIG. 43) shifted in time from each other are generated in sync with the gate clock signal GCK ((b) in FIG. 43). At the point in time when the charge share control signal csh1 is supplied, all of the source lines SL1-SLn are short-circuited so that electric charges on the source lines SL1-SLn are neutralized. Thereafter, at the time when the charge share control signal csh2 is supplied, voltages that are opposite in polarity between the adjacent source lines Sn and Sn+1 are applied ((e) and (f) in FIG. 43). Thus, voltages whose polarities are reversed in each horizontal scanning period, and whose polarities are opposite between the adjacent source lines are applied. Therefore, it is possible to prevent the occurrence of screen burn-in.

As illustrated in (e) and (f) of FIG. 43, the polarity of a non-image signal corresponding to the charge share control signal csh2 is identical with the polarity of a data signal in the subsequent horizontal scanning period. This is advantageous in increasing a charging rate. Details will be described in Second Embodiment below.

Further, it is desirable that the polarity of a data signal supplied to a pixel in the subsequent frame is identical with the polarity of the last pre-tilt signal (non-image signal) supplied to the pixel in the previous frame. This is advantageous in increasing a charging rate of the pixel. Details will be described in Second Embodiment below.

Figure 44:
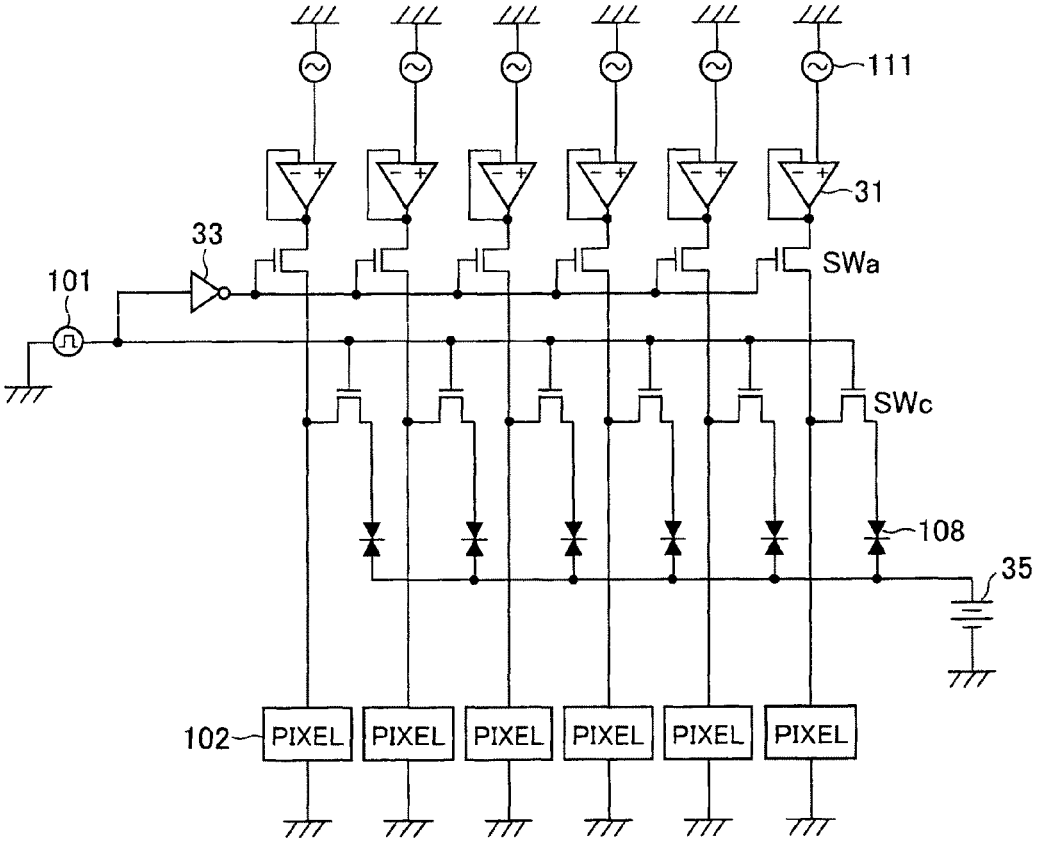
FIG. 44 is a circuit diagram illustrating yet another configuration of the output section of the source driver.

FIG. 44 is a circuit diagram illustrating still another configuration of the output section 13 of the source driver 3. (a) through (e) in FIG. 45 are waveform diagrams for explaining a method of driving the source driver 3 that includes the output section 13 illustrated in FIG. 44.

The output section includes, in addition to the components in the source driver 3 illustrated in FIG. 12, constant-voltage diodes 108 are provided between the second MOS transistors SWc and the charge share voltage fixing-use power source 35. That is, the constant-voltage diodes 108 are connected respectively to the second MOS transistors SWc, and integrated by one line, to which the charge share voltage fixing-use power source 35 is connected. A voltage of the fixed power source is, for example, a medium value between a maximum value and a minimum value of a data signal voltage.

With the constant-voltage diode 108 provided, a voltage is incompletely removed from the source line SLi and a voltage of a given value remains in the source line SLi, even after the supply of the charge share control signal csh, i.e. even after the short circuit of the source line SLi. The voltage of a given value can be adjusted by appropriate selection of a zener voltage of the constant-voltage diode.

Figure 45:
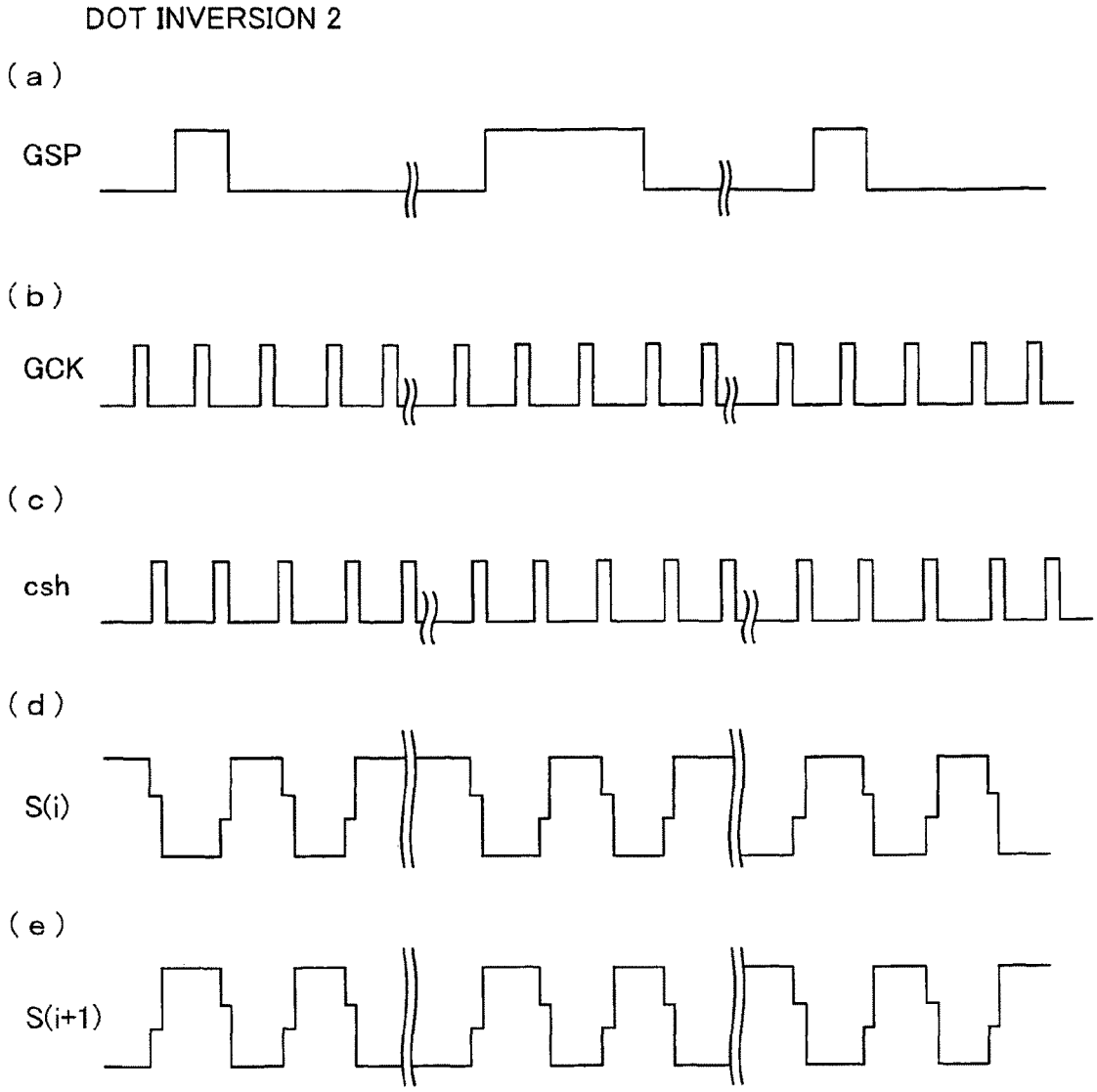
FIG. 45 is waveform diagrams wherein (a) is a waveform diagram showing a gate start pulse signal GSP, (b) is a waveform diagram showing a gate clock signal, (c) is a waveform diagram showing a charge share control signal, (d) is a waveform diagram showing a data signal, and (e) is a waveform diagram showing a data signal.

More specifically, at the point in time when the charge share control signal csh is supplied in sync with the gate clock signal GCK ((b) in FIG. 45), all of the source lines SL1-SLn are short-circuited and voltages from the charge share voltage fixing-use power source 35 are applied to the source lines SL1-SLn. At this time, voltages are held on the source lines SL1-SLn by the constant-voltage diodes 108. Therefore, voltages that are opposite in polarity between the adjacent source lines Sn and Sn+1 are applied ((d) and (e) in FIG. 45). The "voltages that are opposite in polarity" can be determined by a preset voltage of the fixed power source and a zener voltage of the constant-voltage diode.

It is advantageous in increasing a charging rate that the polarity of a non-image signal corresponding to the charge share control signal csh is identical with the polarity of a data signal in the subsequent horizontal scanning period, although the polarities are opposite to each other in (d) and (e) of FIG. 45.

It is desirable that the polarity of a data signal supplied to a pixel in the subsequent frame is identical with the polarity of the last pre-tilt signal (non-image signal) supplied to the pixel in the previous frame. This is advantageous in increasing a charging rate of the pixel. Details will be described in Second Embodiment below.

Further, the descriptions of the above embodiment assume that at the supply of the charge share control signal, the source line SLi is short-circuited and a voltage for writing black is applied to the short-circuited source line SLi, so that black writing is performed. However, this is not the only method for black writing.

Figure 46:
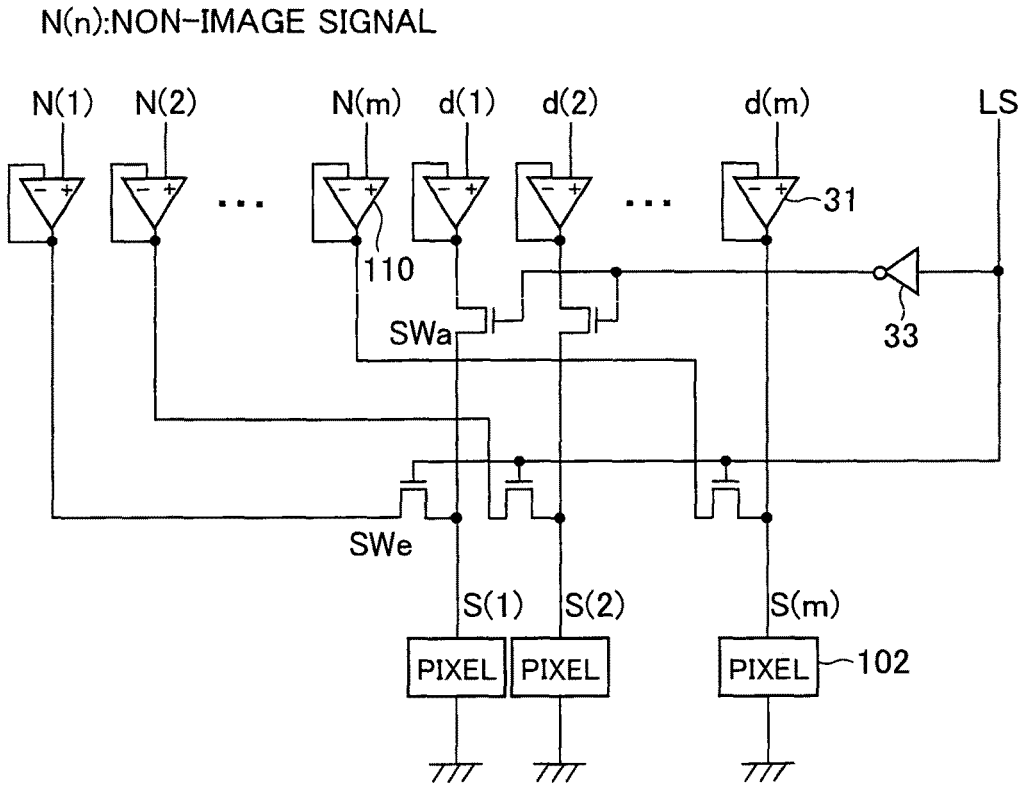
FIG. 46 is a circuit diagram illustrating another configuration of the output section of the source driver.
Figure 47:
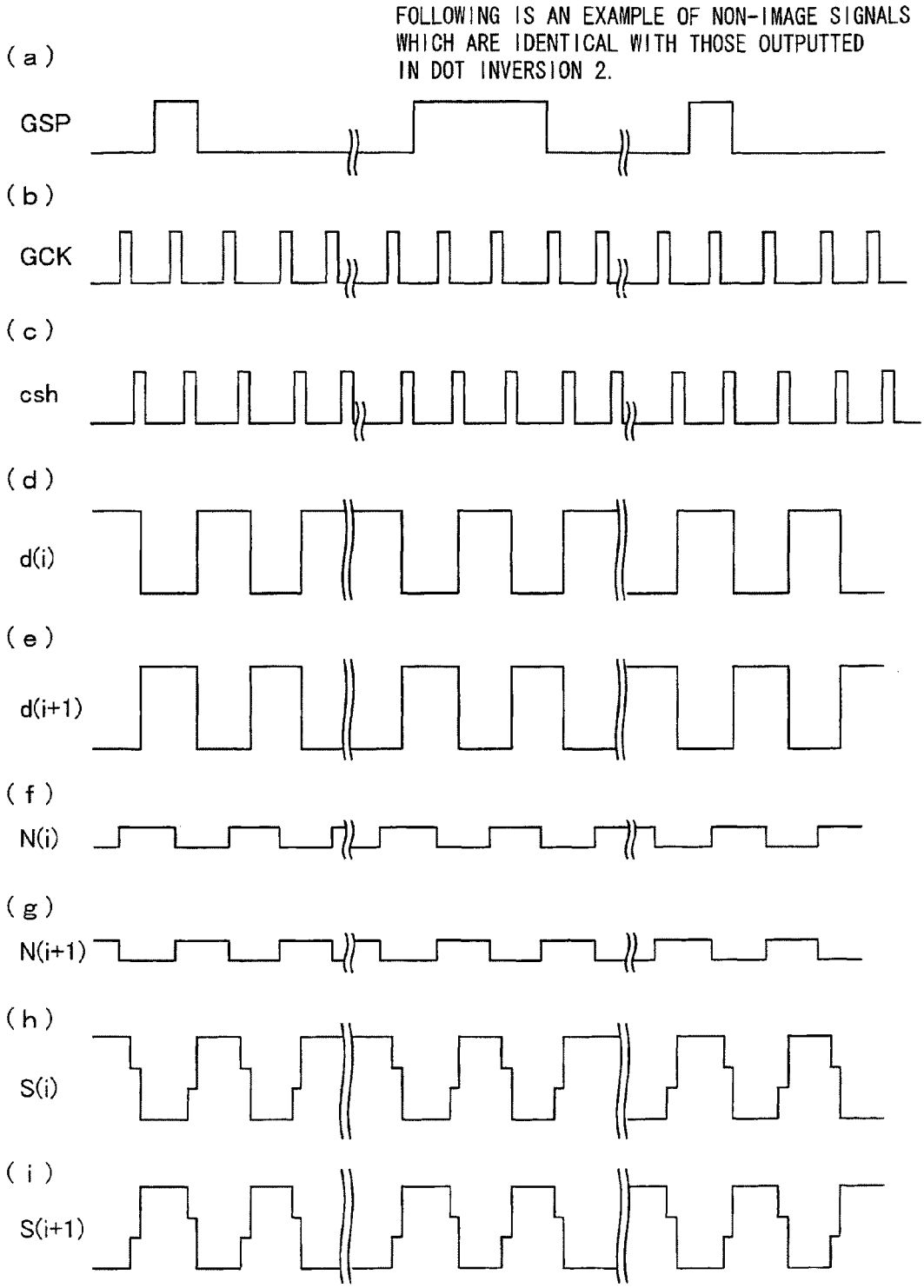
FIG. 47 is waveform diagrams wherein (a) is a waveform diagram showing a gate start pulse signal GSP, (b) is a waveform diagram showing a gate clock signal, (c) is a waveform diagram showing a charge share control signal, (d) is a waveform diagram showing an analogue voltage signal, (e) is a waveform diagram showing an analogue voltage signal, (f) is a waveform diagram showing a non-image signal, (g) is a waveform diagram showing a non-image signal, (h) is a waveform diagram showing a data signal, and (i) is a waveform diagram showing a data signal.

FIG. 46 is a circuit diagram illustrating yet another configuration of the output section of the source driver. (a) through (i) in FIG. 47 are waveform diagrams for explaining a method of driving the source driver 3 that includes the output section illustrated in FIG. 46. In the output section illustrated in FIG. 46, the charge share voltage fixing-use power source 35 as illustrated in FIGS. 11, 12, and 42 are not provided, and the first polarity reversal power source 100 and the second polarity reversal power source 103 illustrated in FIGS. 38, 40, and 42 are also not provided. Rather than provided with the charge share voltage fixing-use power source 35, the first polarity reversal power source 100, and the second polarity reversal power source 103, the output section illustrated in FIG. 46 is arranged such that non-image signals (signals for writing black) N(1)-N(m) are supplied via the fifth MOS transistors SWe to the source lines SLi. To one end of the fifth MOS transistor SWe, the output buffer 110 is connected. To the other end of the fifth Mos transistor SWe, the first MOS transistor Swa is connected via the source line SLi. To the gate terminal of the fifth MOS transistor SWe, the charge share control signal is supplied.

More specifically, as illustrated in (f) and (g) of FIG. 47, non-image signals N(n) and N(n+1) whose polarities are opposite to each other and repeat High level and Low level in each 1H, are applied to the source lines SLn and SLn+1, respectively. A timing of the polarity reversal of these non-image signals N(n) and N(n+1) is shifted by ½H from a timing of the polarity reversal of the analogue voltage signal d(n) applied to the source lines SLn and SLn+1 ((d) and (e) in FIG. 47). According to the above arrangement, the signal for black writing (non-image signal N(n)) is applied directly to each of the source lines SLi, so that black writing is performed ((h) and (i) in FIG. 47).

It is advantageous in increasing a charging rate that the polarity of a non-image signal corresponding to the charge share control signal chs is identical with the polarity of a data signal in the subsequent horizontal scanning period, although the polarities are opposite to each other in (h) and (i) of FIG. 47.

It is desirable that the polarity of a data signal supplied to a pixel in the subsequent frame is identical with the polarity of the last pre-tilt signal (non-image signal) supplied to the pixel in the previous frame. This is advantageous in increasing a charging rate of the pixel. Details will be described in Second Embodiment below.

Finally, blocks of the OS drive circuit illustrated in FIGS. 27 and 30, especially the polarity information processing section 51 and the correction amount calculating section 53, may be constituted by hardware logic, or may be realized by software by means of a CPU as below.

That is, the OS driver circuit includes a CPU (central processing unit) that executes the order of a control program for realizing the aforesaid functions, ROM (Read Only Memory) that stores the control program, RAM (Random Access Memory) that develops the control program, and a storage device (storage medium), such as memory, that stores the control program and various types of data therein. The object of the present invention can be realized by a predetermined storage medium. The storage medium stores, in computer-readable manner, program codes (executable code program, intermediate code program, and source program) of the control program of the OS drive circuit, which is software for realizing the aforesaid functions. The storage medium is provided to the OS drive circuit. With this arrangement, the OS driver circuit (alternatively, CPU or MPU) as a computer reads out and executes program code stored in the storage medium provided.

The storage medium may be tape based, such as a magnetic tape or cassette tape; disc based, such as a magnetic disk including a Floppy® disc and hard disk and optical disk including CD-ROM, MO, MD, DVD, and CD-R; card based, such as an IC card (including a memory card) and an optical card; or a semiconductor memory, such as a mask ROM, EPROM, EEPROM, and a flash ROM.

Further, the OS drive circuit may be arranged so as to be connectable to a communications network so that the program code is supplied to the OS drive circuit through the communications network. The communications network is not to be particularly limited. Examples of the communications network include the Internet, intranet, extranet, LAN, ISDN, VAN, CATV communications network, virtual private network, telephone network, mobile communications network, and satellite communications network. Further, a transmission medium that constitutes the communications network is not particularly limited. Examples of the transmission medium include (i) wired lines such as IEEE 1394, USB, power-line carrier, cable TV lines, telephone lines, and ADSL lines and (ii) wireless connections such as IrDA and remote control using infrared light, Bluetooth®, 802.11, HDR, mobile phone network, satellite connections, and terrestrial digital network. Note that the present invention can be also realized by the program codes in the form of a computer data signal embedded in a carrier wave which is embodied by electronic transmission.

Second Embodiment

Next, the following will describe another embodiment of the present invention. A driving method of a liquid crystal display device according to the present invention may be such that polarities of pixels are reversed every plural horizontal scanning periods. The present embodiment describes a driving method of nH inversion (n is an integer not less than 2) in which the polarity of a data signal is reversed for each group of plural scanning lines.

Although First Embodiment takes as an example driving in which the polarity of a signal is reversed in each horizontal scanning period (i.e. 1H inversion driving), the present Second Embodiment is different from First Embodiment in that 2H inversion is adopted rather than 1H inversion. Explanation of the points that are in common with First Embodiment will be omitted, and only differences therebetween will be explained. Members and signals that are in common with those in First Embodiment are given the same names and reference numerals (or symbols), and explanations thereof are omitted.

First of all, as an example of nH inversion driving, 2H inversion driving in which the polarity of a signal on a data signal line is reversed every two horizontal scanning periods will be described. The 2H inversion driving includes: 2H dot inversion (see FIG. 49(*a*)) in which polarities are reversed for each group of the adjacent source lines (data signal lines); and 2H line inversion (see FIG. 49(*b*)) in which polarities are not reversed for each group of the adjacent source lines (data signal lines). Whether 2H dot inversion or 2H line inversion is adopted does not inherently affect the present embodiment. Therefore, the present embodiment will be described below without specifying whether 2H dot inversion or 2H line inversion is adopted, unless otherwise specified.

In such a 2H inversion driving, it is preferable that a non-image signal is applied to a data signal line both at the point in time between the horizontal scanning periods in which polarities are reversed and at the point in time between the horizontal scanning periods in which polarities are not reversed, so that scanning signal lines are selected concurrently with application of the non-image signal. That is, it is preferable that black insertion (non-image insertion period) is performed by insertion of an intermediate voltage (non-image signal) to the source lines at the point in time between the first and second horizontal scanning periods. This makes it easy to adjust timings and total time of the start and end of application of the non-image signal to a pixel on each of the scanning signal lines. This makes it possible to improve display unevenness that can occur between the scanning lines.

Figure 48:
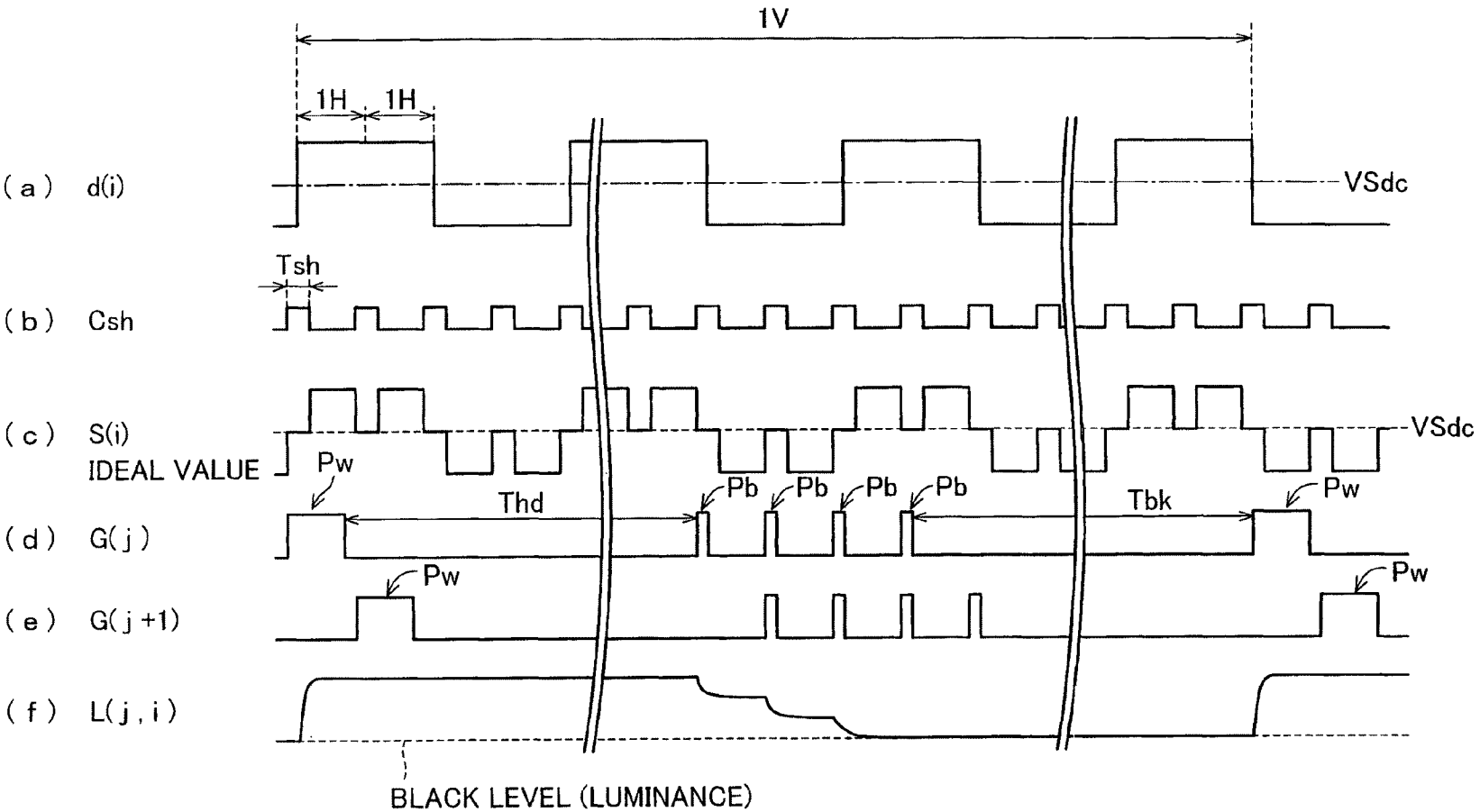
FIG. 48 is waveform diagrams of signals in a liquid crystal display device of Second Embodiment, wherein (a) is a waveform diagram showing an analogue voltage signal, (b) is a waveform diagram showing a charge share control signal, (c) is a waveform diagram showing a data signal, (d) is a waveform diagram showing a scanning signal G(j) applied to a gate line GLj, (e) is a waveform diagram showing a scanning signal G(j+1) applied to a gate line Gj+1, and (f) is a waveform diagram showing luminance of a pixel.

A liquid crystal display device according to the present embodiment is arranged similarly to the liquid crystal display device illustrated in FIG. 2 according to First Embodiment. FIG. 48 shows waveforms of signals in a liquid crystal display device according to the present embodiment. In FIG. 48, (a) is a waveform diagram showing an analogue voltage signal, (b) is a waveform diagram showing a charge share control signal, (c) is a waveform diagram showing a data signal, (d) is a waveform diagram showing a scanning signal G(j) applied to a gate line GLj, (e) is a scanning signal G(j+1) applied to a gate line Gj+1, and (f) shows a waveform diagram showing luminance of a pixel. Explanation of commonalities between the waveforms of the present embodiment illustrated in FIG. 48 and the waveforms of First Embodiment illustrated in FIG. 1 will be omitted, and only differences therebetween will be explained.

In 2H inversion driving, an analogue voltage signal whose polarity is reversed every two horizontal scanning periods (2H) as a video signal d(i) generated by the data generating section 12 of the source driver 3, as illustrated in (a) of FIG. 48. Difference from First Embodiment is in that the charge share control signal Csh goes high level during two consecutive horizontal scanning periods in which polarity reversal is not performed, as shown in (b) of FIG. 48.

With this arrangement, a data signal S(i) applied to a source line is as shown in (c) of FIG. 48, and a non-image signal is applied during periods in which polarity reversal is not performed. (c) in FIG. 48 shows an ideal waveform of the data signal S(i), but an actual waveform thereof is distorted to some extent. In the case of 2H inversion as in the present embodiment, a non-image signal is applied both during consecutive periods in which polarity reversal is performed and during consecutive periods in which polarity reversal is not performed, whereby difference in charging rate occurs between a pixel whose polarity is reversed and a pixel whose polarity is not reversed. This makes it possible to prevent the occurrence of unfavorable streaks every 2H periods.

As illustrated in the scanning signal G(j) in (d) of FIG. 48, a scanning line is made in a selected state (Pb) (Pb is also referred to as black insertion application pulse) with a non-image signal regardless of the presence or absence of polarity reversal. With this, luminance (j,i) determined by a voltage applied to a pixel (j, i) becomes as illustrated in (f) of FIG. 48. In the case of 2H inversion, the number of black insertion application pulses (Pb) is preferably an even number. According to this, between the adjacent scanning lines, the number of black insertion application pulses (Pb) at the time when polarity reversal is performed can be identical with the number of black insertion application pulses (Pb) at the time when polarity reversal is not performed. As a result of this, it is possible to improve display unevenness that occurs on each scanning line.

In the case of 2H inversion, the number of black insertion application pulses (Pb) is more preferably a multiple number of 4 (e.g. 4) since the polarity of a data signal is changed from +(positive) to −(negative) and vice versa.

A preferable method has been described above. In the present invention, in a case where polarity is reversed for each group of plural scanning lines (i.e. nH inversion (n is an integer not less than 2)), a non-image signal is applied to a data signal line during the horizontal scanning periods where polarity reversal is performed so that a scanning signal line is selected concurrently with the application of the non-image signal, and a non-image signal is applied to a data signal line during the horizontal scanning periods where polarity reversal is not performed so that a scanning signal line is selected concurrently with the application of the non-image signal. In the present invention, interlaced scanning may be performed so as to be shifted by 1H, although it is not shown.

Figure 50:
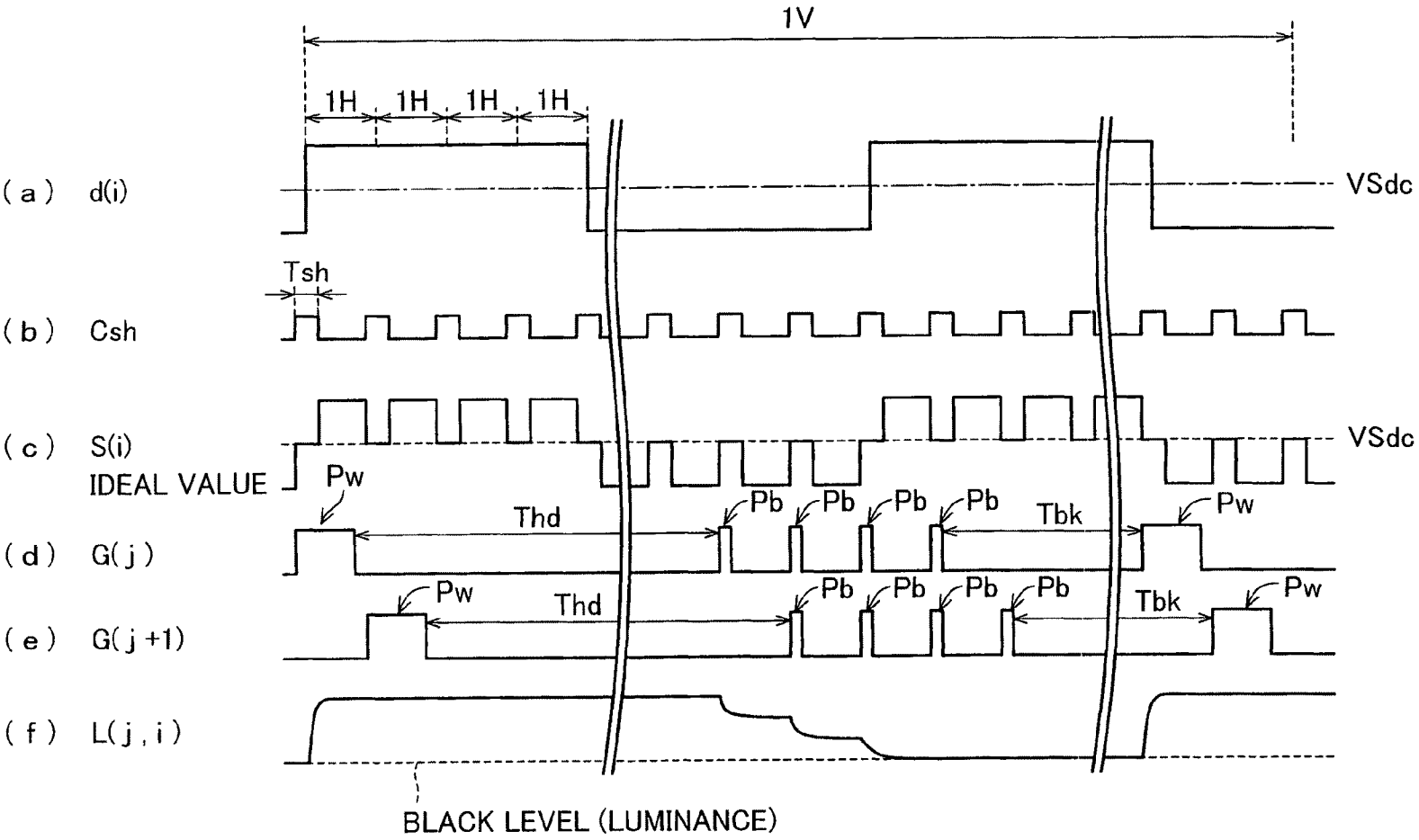
FIG. 50 is another example of waveform diagrams of signals in a liquid crystal display device of Second Embodiment, wherein (a) is a waveform diagram showing an analogue voltage signal, (b) is a waveform diagram showing a charge share control signal, (c) is a waveform diagram showing a data signal, (d) is a waveform diagram showing a scanning signal G(j) applied to a gate line GLj, (e) is a waveform diagram showing a scanning signal G(j+1) applied to a gate line Gj+1, and (f) is a waveform diagram showing luminance of a pixel.

The above description has showed the 2H inversion in which the polarity of a data signal is reversed every two horizontal scanning periods. However, the present invention is not limited to this. Polarity reversal may be performed every three or more horizontal scanning periods. FIG. 50 shows waveforms of the signals in the case of 4H inversion (4H dot inversion) as an example of polarity reversal of the data signal every three or more horizontal scanning periods. As illustrated in FIG. 50, the signal Csh is supplied during the periods in which polarity reversal is not performed, as in the case of 2H inversion. The other arrangements are the same as those in FIG. 48, and explanation thereof is omitted.

In FIG. 50, the number of black insertion application pulses (Pb) is 4. This is because if the number of black insertion application pulses (Pb) is not a multiple number of 4, unevenness can occur due to difference between four scanning lines in the number of black insertion application pulses applied at the timing other than the timing when the polarity of a data signal is reversed. That is, in the case of nH inversion, it is desirable that the number of black insertion application pulses (Pb) is a multiple number of n.

Furthermore, in the case of 4H inversion, the number of black insertion application pulses (Pb) is more preferably 4×2m (m is an integer not less than 1). With this arrangement, in a case where the polarity of a data signal is reversed on each scanning signal line, the number of times the non-image signal is selected during a positive-to-negative reversal can be made identical with the number of times the non-image signal is selected at a negative-to-positive reversal. In addition, in a case where the polarity of a data signal is not reversed on each scanning signal line, the number of times the non-image signal is selected during positive polarity periods can be made identical with the number of times the non-image signal is selected during negative polarity periods. This makes it possible to decrease the difference in charging rate between the adjacent pixels and to further improve unevenness that occurs on each scanning line. That is, in the case of nH inversion, the number of black insertion application pulses (Pb) is preferably a multiple number of 2n.

As in the case of First Embodiment, the non-image signal can be a pre-tilt signal by which liquid crystal molecules are pre-tilted, in Second Embodiment. The following will describe, as an example, the case where the non-image signal is a pre-tilt signal by which liquid crystal molecules are pre-tilted in the 2H inversion.

Figure 51:
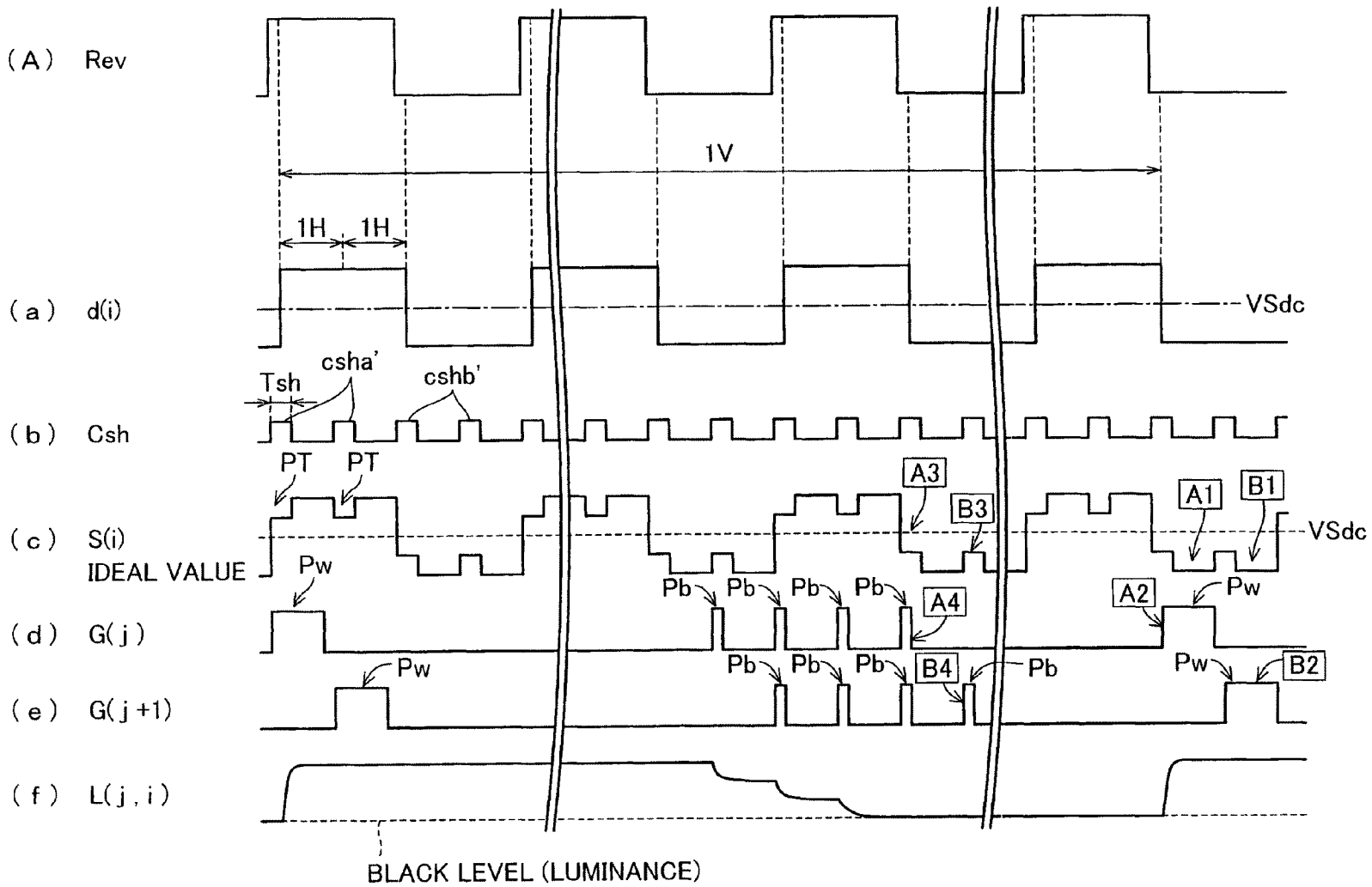
FIG. 51 is still another example of waveform diagrams of signals in a liquid crystal display device of Second Embodiment, wherein (A) is a waveform diagram showing a reverse signal REV, (a) is a waveform diagram showing an analogue voltage signal, (b) is a waveform diagram showing a charge share control signal, (c) is a waveform diagram showing a data signal, (d) is a waveform diagram showing a scanning signal G(j) applied to a gate line GLj, (e) is a waveform diagram showing a scanning signal G(j+1) applied to a gate line Gj+1, and (f) is a waveform diagram showing luminance of a pixel.
Figure 52:
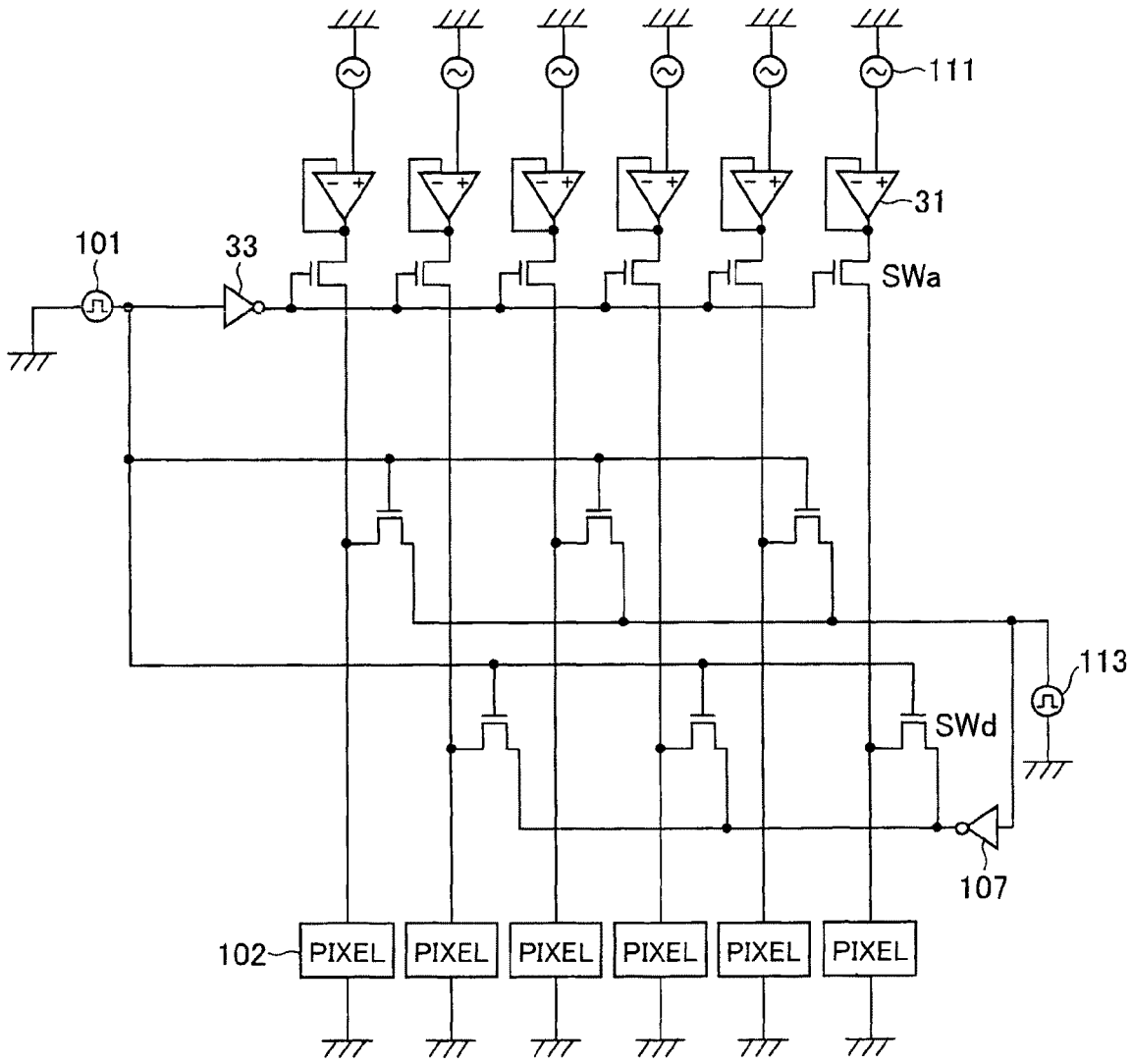
FIG. 52 is a circuit diagram showing an example of the configuration of an output section of a source driver that outputs the signals shown in FIG. 51.
Figure 53:
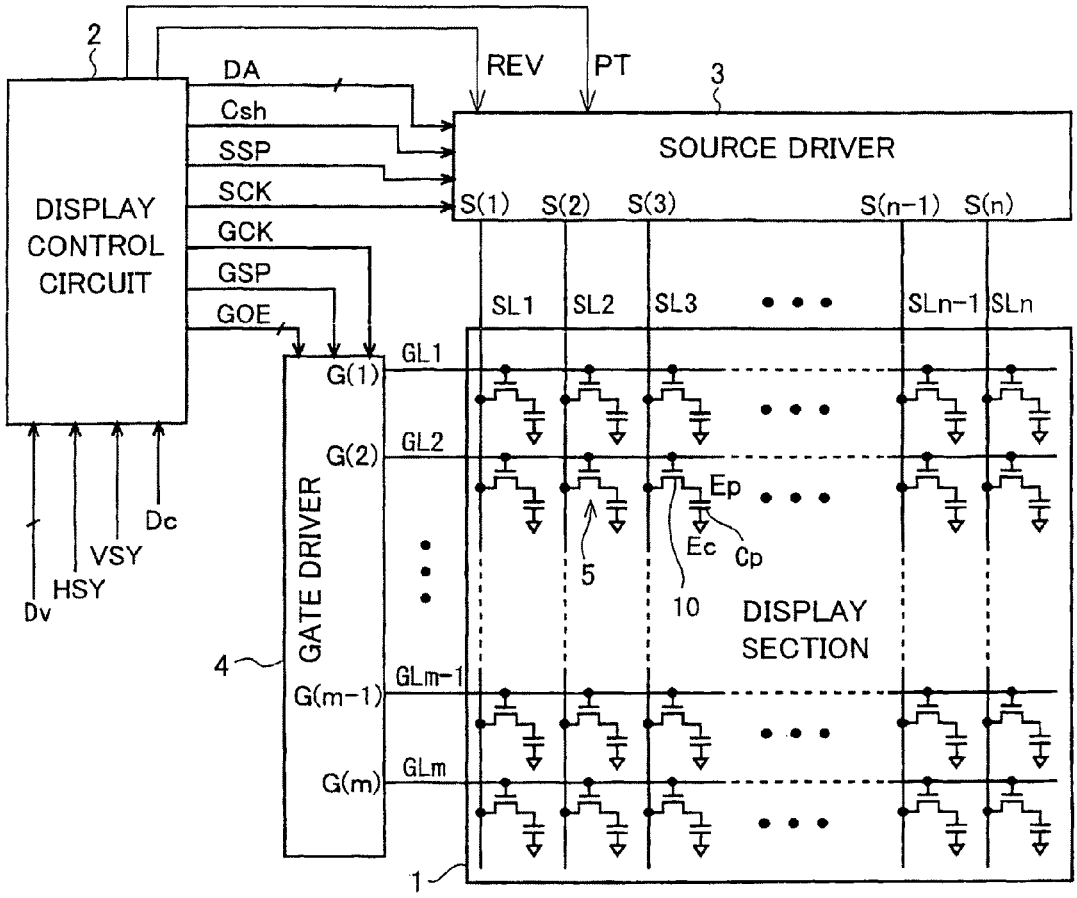
FIG. 53 is a block diagram showing a block diagram illustrating an example of a liquid crystal display device of Second Embodiment together with an equivalent circuit of a display section of the liquid crystal display device.
Figure 54:
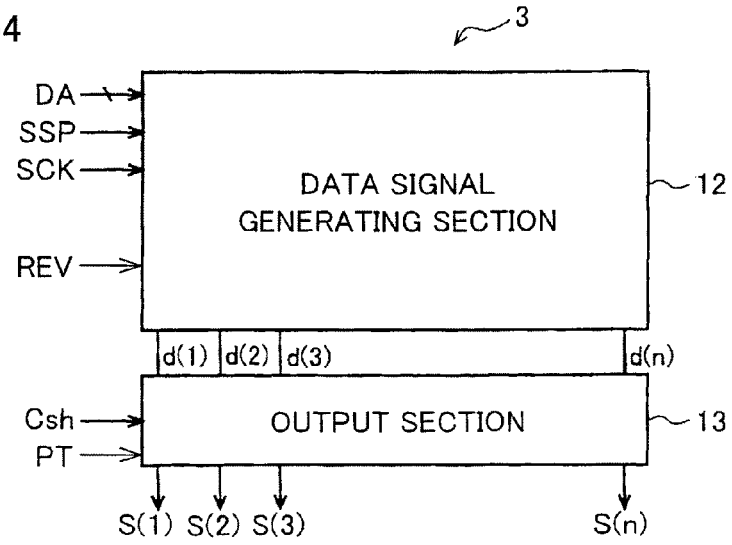
FIG. 54 is a block diagram illustrating the configuration of a source driver illustrated in FIG. 53.

FIGS. 51 and 52 are diagrams for explaining the case where the non-image signal can be a pre-tilt signal by which liquid crystal molecules are pre-tilted in the 2H dot inversion driving. FIG. 51 is a waveform diagram for explaining a driving method in this case. FIG. 52 is a circuit diagram illustrating an exemplary configuration of the output section 13 of the source driver 3 whose outputs are in waveforms illustrated in FIG. 51. FIG. 53 is a block diagram illustrating a liquid crystal display device having the output section 13 illustrated in FIG. 52 together with an equivalent circuit of a display section of the liquid crystal display device. FIG. 54 is a block diagram illustrating the configuration of a source driver illustrated in FIG. 53.

In FIG. 53, (i) a reverse signal REV that determines polarity reversal of a pre-tilt signal and (ii) a pre-tilt signal PT that determines an electric potential are supplied from the display control circuit 2 to the source driver 3. In the source driver 3, the reverse signal REV is supplied to the data signal generating section 12, and the pre-tilt signal PT is supplied to the output section 13, as illustrated in FIG. 54. The other arrangements are the same as those in First Embodiment, and explanation thereof is omitted.

The configuration of the output section 13 illustrated in FIG. 52 is substantially the same as that of the output section 13 of the source driver 3 illustrated in FIG. 40. Therefore, only differences from the output section 13 of the source driver 3 illustrated in FIG. 40 will be described. The output section illustrated in FIG. 52 includes a third polarity reversal power source 113, instead of the second polarity reversal power source 103 illustrated in FIG. 40.

Especially, the output section 13 illustrated in FIG. 52 is provided with fourth MOS transistors SWd on the source lines SLi near the pixels 102 with respect to the second MOS transistors SWc. Each of the fourth MOS transistors SWd is provided between each of pairs of the adjacent source lines of the source lines SL1-SLn. Gate terminals of the fourth MOS transistors SWd are integrated separately on the odd-numbered line and even-numbered line of the source lines SL1-SLn.

To the odd-numbered source lines SL1, SL3, . . . , voltages generated by the third polarity reversal power source 113 are applied. To the even-numbered source lines SL2, SL4, . . . , voltages obtained by the inverter 107 reversing polarities of the voltages generated by the third polarity reversal power source 113 are applied.

The third polarity reversal power source 113 reverses polarities of the pre-tilt signal (non-image signal) and the data signal (image signal) with reference to a charge share control signal Csh ((b) in FIG. 51) and the reverse signal REV ((A) in FIG. 51). "Polarity reversal" means change from positive (+) polarity to negative (−) polarity and vice versa with respect to a common voltage.

More specifically, at the short circuit by a charge share control signal Csha' and at the short circuit ((b) in FIG. 51) by a charge share control signal Cshb', voltages that are opposite in polarity are applied to the source lines SLn and SLn+1, respectively.

Next, the driving of the source driver 3 that includes the output section 13 illustrated in FIG. 52 will be described with reference to FIG. 51. In FIG. 51, (A) is a waveform diagram showing the reverse signal REV. (a) through (f) are waveform diagrams for explaining a method of driving the source driver 3 that includes the output section 13 illustrated in FIG. 52, and correspond to (a) through (f) in FIG. 48, respectively. Explanation of commonalities between the waveforms illustrated in FIG. 51 and the waveforms illustrated in FIG. 48 will be omitted, and only differences therebetween will be explained. Difference from FIG. 48 is in that the pre-tilt signal PT, which has a potential by which liquid crystal molecules are pre-tilted, is used as the non-image signal applied between one horizontal scanning period and one horizontal scanning period. A preferable pre-tilt signal is the same as in the case of 1H reversal, and explanation thereof is omitted.

According to the above arrangement, liquid crystal becomes slightly tilted upon supply of the non-image signal in (f) of FIG. 51, which allows for improvement of trailing. Note that it is desirable that the polarity of the image signal (A1; selection pulse A2) applied to a pixel in the subsequent frame is identical with that of the last pre-tilt signal (A3; selection pulse A4) applied to the pixel in the previous frame, as illustrated in (c) and (d) of FIG. 51. This is advantageous in increasing a charging rate of a pixel. Similarly, also on the subsequent scanning line, it is desirable that the polarity of an image signal B1 (selection pulse B2) is identical with that of a pre-tilt signal B3 (selection pulse B4), as illustrated in (c) and (e) in FIG. 51. It is obvious that such a method is also applicable to First Embodiment, although it is not specifically described below. As illustrated in (c) of FIG. 51, the charge share signal Csh is outputted in each horizontal period. However, the pre-tilt signal is reversed every two horizontal scanning periods in the third polarity reversal power source 113 of FIG. 52. This causes the polarities of the pre-title signal and the image signal to be reversed every two scanning periods as illustrated in (c) of FIG. 51, thus preventing the occurrence of screen burn-in.

Figure 57:
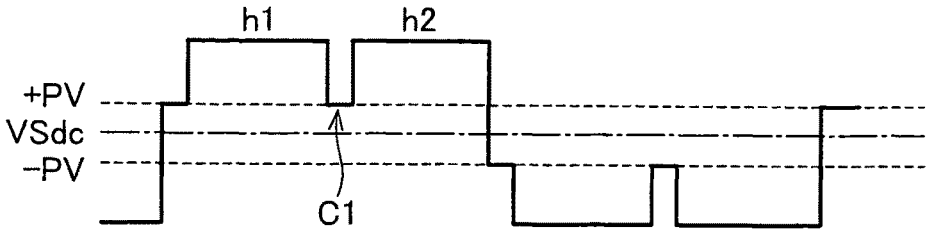
FIG. 57(*a*) is a waveform diagram showing waveforms of data signals in a case where the polarity of a non-image signal is identical with the polarity of a subsequent data signal and in a case where the polarity of the non-image signal is different from the polarity of the subsequent data signal.
Figure 57:
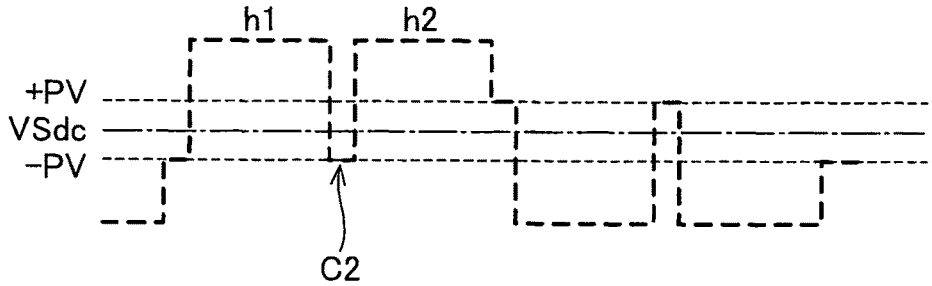
Figure 57:
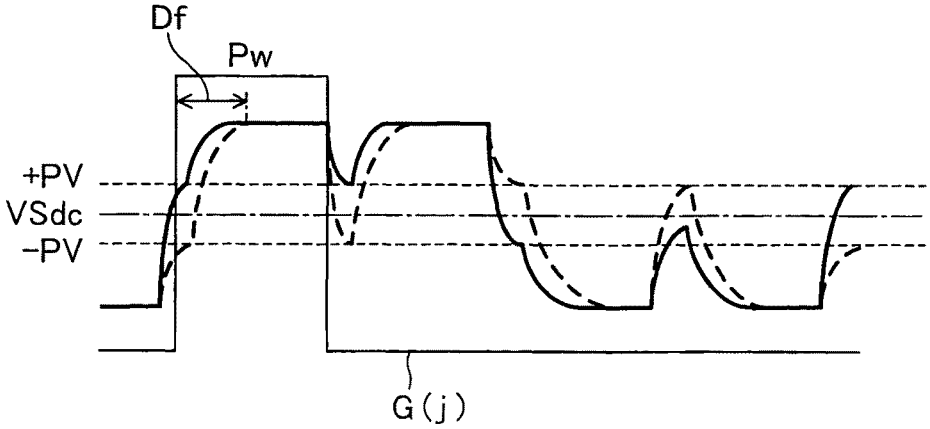

It is advantageous in increasing a charging rate that the polarity of the non-image signal corresponding to the charge share control signal Csh is identical with the polarity of the non-image signal in the subsequent horizontal scanning period. This is described with reference to FIGS. 57(*a*) through 57(*c*). FIG. 57(*a*) shows an ideal waveform of the data signal in a case where the polarity of a non-image signal C1 is identical with the polarity of the data signal in the subsequent horizontal scanning period h2, and the ideal waveform is indicated by a solid line. FIG. 57(*b*) shows an ideal waveform of the data signal in a case where the polarity of a non-image signal C2 is different from the polarity of the data signal in the subsequent horizontal scanning period h2, and the ideal waveform is indicated by a broken line. FIG. 57(*c*) shows an actual waveform (solid line) of the data signal in a case where the polarity of a non-image signal is identical with the polarity of the data signal in the subsequent horizontal scanning period and an actual waveform (broken line) of the data signal in a case where the polarity of a non-image signal is different from the polarity of the data signal in the subsequent horizontal scanning period. In FIG. 57(*c*), Pw is pixel data write pulse applied to a scanning signal line. In FIGS. 57(*a*) through 57(*c*), VSdc is a DC level of the data signal, +PV is a positive pre-charge potential, and −PV is a negative pre-charge potential.

As illustrated in FIG. 57(*c*), the waveform is distorted due to the existence of various capacitances on the data signal line. In FIG. 57(*c*), waveforms corresponding to the cases in FIGS. 57(*a*) and 57(*b*) are distorted. For example, at a section represented by Df, the data signal in a case where a polarity of the non-image signal is identical (solid line) is higher in potential than the data signal in a case where a polarity of the non-image signal is different (broken line), and the former reaches a preset potential more quickly.

Figure 58:
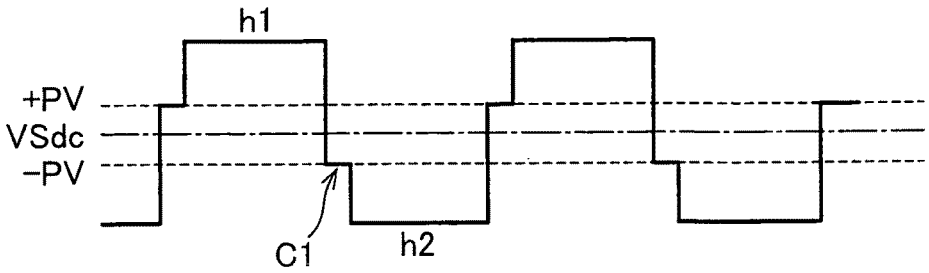
FIG. 58(*a*) is a waveform diagram showing waveforms of data signals in a case where the polarity of a non-image signal is identical with the polarity of a subsequent data signal and in a case where the polarity of the non-image signal is different from the polarity of the subsequent data signal, in First Embodiment.
Figure 58:
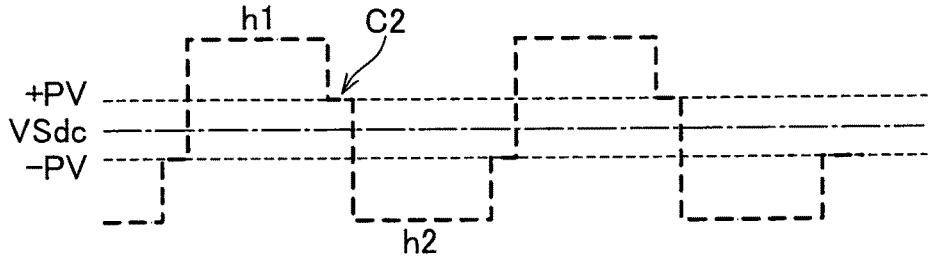
Figure 58:
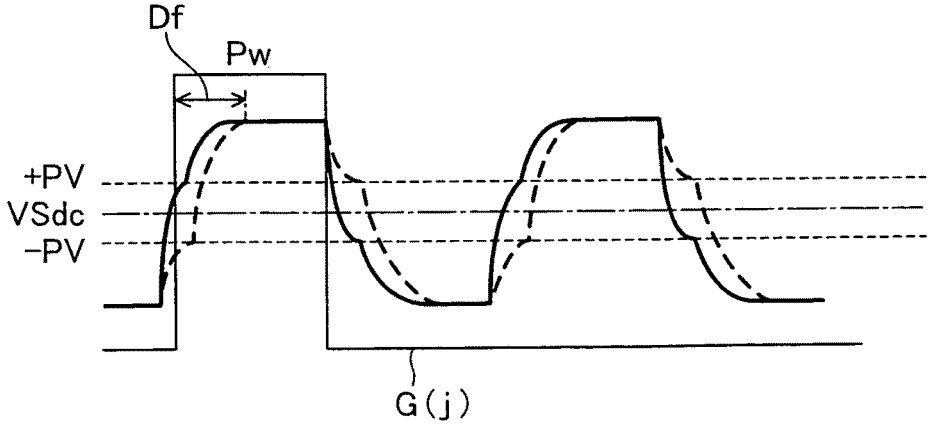
Figure 59:
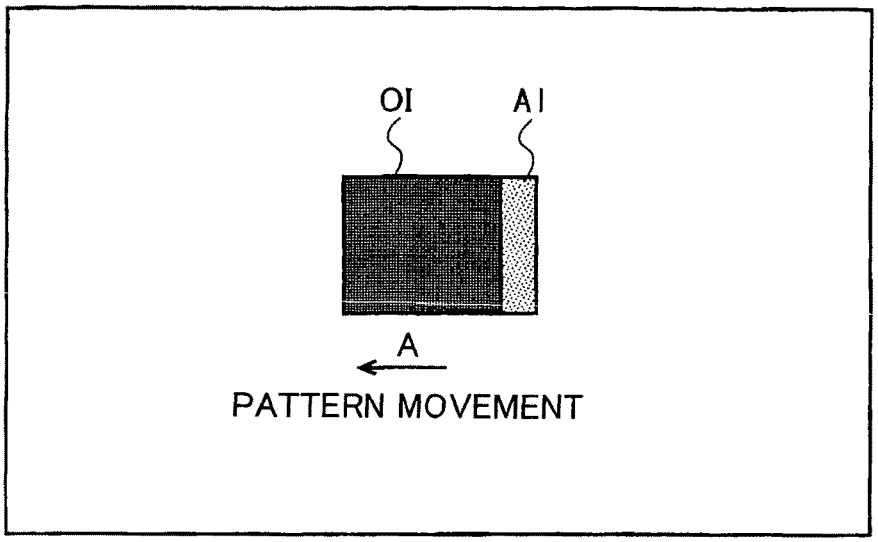
FIG. 59 is a view for explaining the conventional art and illustrating a trailing afterimage.

Therefore, it is advantageous in increasing a charging rate of a pixel that the polarities are identical. This method is also applicable to First Embodiment, as illustrated in FIGS. 58(*a*) through 58(*c*). That is, it is also advantageous in terms of a charging rate even when a non-image signal is not selected and applied to a pixel.

Note that a boundary point between the adjacent horizontal scanning periods in the present invention refers to a point between the horizontal scanning period h1 and the horizontal scanning period h2, i.e. a point at which the non-image signal C1 or C2 is applied, for example, in FIGS. 57(*a*) and 57(*b*) and FIGS. 58(*a*) and 58(*b*). For example, in the case of the non-image signal C1 or C2, a horizontal scanning period immediately after the non-image signal is applied refers to the horizontal scanning period h1.

As described above, the third polarity reversal power source 113 reverses a polarity every two horizontal scanning periods, and applies voltages that are opposite in polarity to each other between the adjacent data signal lines commonly to all the source lines (data signal lines). Therefore, it is possible to prevent the occurrence of screen burn-in caused by application of voltages of one-side polarity, and to prevent the occurrence of flicker since driving can be performed by the so-called dot inversion driving.

In the above descriptions, as an example of the third polarity reversal power source is taken a power source that reverses a polarity every two horizontal scanning periods and applies voltages that are opposite in polarity to each other between the adjacent data signal lines commonly to all the source lines (data signal lines). However, in the present invention, the third polarity reversal power source may be any power source as long as it applies a fixed voltage whose polarity is reversed every plural horizontal scanning periods commonly to all the data signal lines. This makes it possible to prevent the occurrence of screen burn-in that is caused by application of voltages of a one-side polarity.

Figure 55:
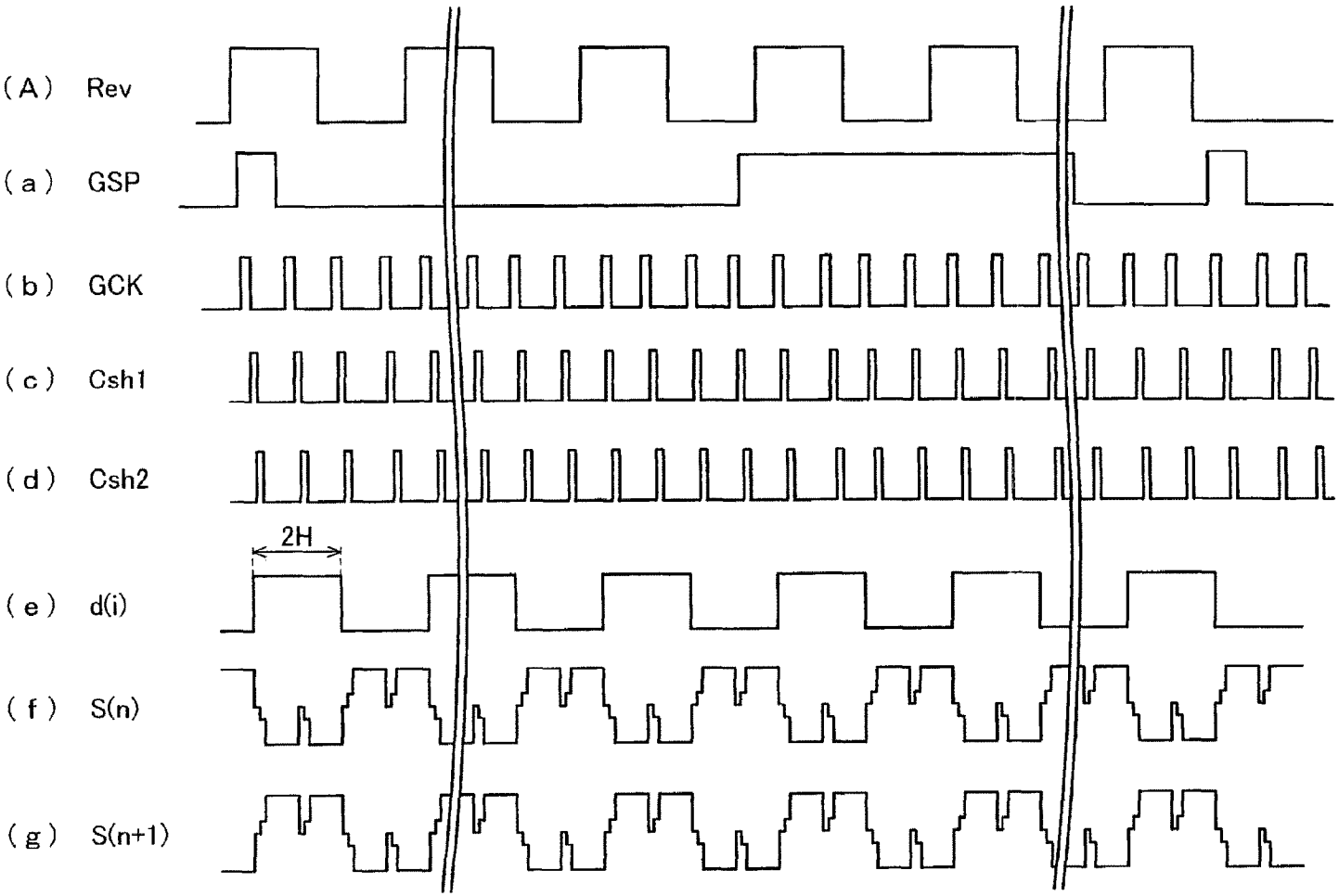
FIG. 55 is yet another example of waveform diagrams of signals in a liquid crystal display device of Second Embodiment, wherein (A) is a waveform diagram showing a reverse signal REV, (a) is a waveform diagram showing a gate start pulse signal GSP, (b) is a waveform diagram showing a gate clock signal, (c) is a waveform diagram showing a charge share control signal, (d) is a waveform diagram showing a charge share control signal, (e) is a waveform diagram showing an analogue voltage signal, (f) is a waveform diagram showing a data signal, and (g) is a waveform diagram showing a data signal.
Figure 56:
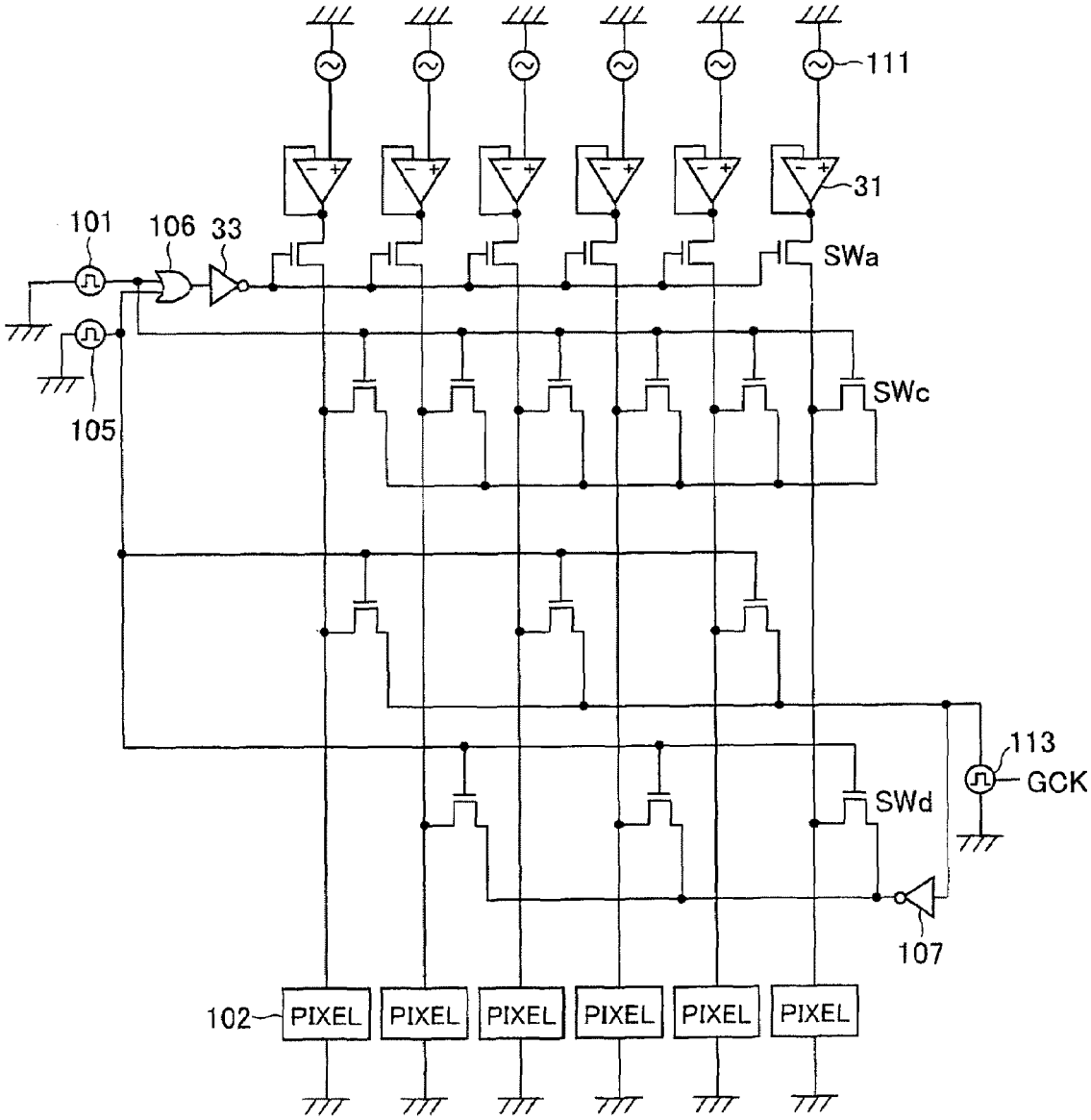
FIG. 56 is a circuit diagram showing an example of the configuration of an output section of a source driver that outputs the signals shown in FIG. 55.

Next, still another embodiment of the output section 13 of the source driver 3 will be described. FIG. 56 is a diagram illustrating another configuration of the output section 13 of the source driver 3. In FIG. 55, (A) and (a) through (g) are waveform diagrams for explaining a method of driving the source driver 3 that includes the output section 13 illustrated in FIG. 56.

The configuration of the output section 13 illustrated in FIG. 56 is substantially the same as that in FIG. 42. The waveforms in FIG. 55 are substantially the same as those in FIG. 43. Therefore, only difference therefrom will be described. The difference therefrom is in that the charge share signal is outputted in each horizontal scanning period as illustrated in (c) and (d) of FIG. 55, and the third polarity reversal power source 113 illustrated in FIG. 56 reverses the pre-tilt signal every two horizontal scanning periods. That is, the polarities of the pre-tilt signal (non-image signal) and the data signal (image signal) are reversed with reference to the charge share control signal Csh ((b) in FIG. 51) and the reverse signal REV ((A) in FIG. 51) both of which are supplied to the third polarity reversal power source 113. When polarity reversal is performed in this manner, polarities are reversed on the source lines SLn and SLn+1 as illustrated in (f) and (g) of FIG. 55 (i.e. dot inversion), and the polarities of the pre-tilt signal and the image signal are reversed every two horizontal scanning periods. This makes it possible to prevent the occurrence of flicker and screen burn-in.

Note that explanation of commonalities between First Embodiment and the present embodiment are omitted in the present embodiment. Arrangements other than the arrangement in which the polarity is reversed in each horizontal scanning period can be performed with the arrangement explained in First embodiment in combination with the arrangement explained in Second Embodiment. That is, the present invention can be practiced by a combination of the arrangement explained in First embodiment and the arrangement explained in Second Embodiment, which is encompassed in the present invention.

The present invention can be practiced in other various forms without departing from the above-described primary features. Therefore, the foregoing embodiments are merely examples in all respects and should not be narrowly interpreted. The scope of the present invention is limited by the scope of the appended claims and is not limited to the descriptions herein. Further, variations, modifications, and processes within a scope equivalent to the scope of the appended claims are all within the scope of the present invention.

INDUSTRIAL APPLICABILITY

A liquid crystal display device of the present invention can be used in products including a liquid crystal display. particularly, a liquid crystal display device of the present invention is suitably used in a television set.

The invention claimed is:

1. A driving method of an active matrix type liquid crystal display device comprising:

a plurality of data signal lines;

a plurality of scanning signal lines that intersect the data signal lines; and a plurality of pixel sections being disposed in a matrix manner at the respective intersections of the data signal lines and the scanning signal lines, each of the pixel sections receiving as a pixel value a voltage applied to the data signal line that passes through the corresponding intersection when the scanning signal line that passes through the corresponding intersection is selected, wherein non-image signals are applied to the data signal lines at a boundary point between the adjacent horizontal scanning periods, the scanning signal lines are selected in an effective scanning period, and thereafter the scanning signal lines are selected, in sync with a timing of application of the non-image signals to the data signal lines, before the subsequent effective scanning period comes after a point in time when the scanning signal lines have been brought into non-selected state, application of the non-image signals to the data signal lines is performed with adjacent data signal lines short-circuited to each other, application of the non-image signals to the data signal lines is performed by use of a fixed voltage power source which applies a fixed voltage to each of the data signal lines, each of the non-image signals is a voltage that exists between voltages whose polarities are opposite to each other, application of the non-image signal to the data signal lines is performed at polarity reversal of a data signal, and at a time when a polarity of a signal on the data signal line is reversed in each horizontal scanning period, the number of times the scanning signal line is selected in sync with the timing of application of the non-image signal to the data signal line is an even-number.

2. The driving method according to claim 1, wherein the liquid crystal display device is a liquid crystal display device of vertical alignment mode in which a direction where liquid crystal molecules are aligned is controlled by an electric field, and the non-image signal is a pre-tilt signal by which the liquid crystal molecules are pre-tilted.

3. The driving method according to claim 1, wherein a polarity of a voltage corresponding to the non-image signal is identical with a polarity of a voltage corresponding to an image signal in a horizontal scanning period immediately after application of the non-image signal.

4. The driving method according to claim 1, wherein a polarity of a non-image signal selected at the end of one vertical scanning period and applied to the pixel section is identical with a polarity of an image signal selected in a subsequent vertical scanning period.

5. The driving method according to claim 2, wherein in a case where display luminance T when white luminance level is 1 and black luminance level is 0 is nearly close to $T=(L/Lw)^{\gamma}$ where L is display grayscale level, Lw is white display grayscale, and $\gamma$ is $\gamma$ characteristics, the pre-tilt signal is a signal indicating $Lw\times10^{(-3/\gamma)}$ or greater.

6. The driving method according to claim 2, wherein regarding $\gamma$ indicating $\gamma$ characteristics, display grayscale L is defined as:

$L=255\times T^{(1/2.2)}$ where T is display luminance when white luminance level is 1 and black luminance level is 0, and the pre-tilt signal is a signal that generates a grayscale voltage higher than a grayscale voltage obtained when L=12.

7. The driving method according to claim 5, wherein the pre-tilt signal is a signal indicating $\gamma$ characteristics of 2.2 and 12th grayscale level or higher level out of 256 display grayscale levels.

8. The driving method according to claim 5, wherein the pre-tilt signal is a signal indicating $\gamma$ characteristics of 2.2 and 45th grayscale level or higher level out of 1024 grayscale levels for display.

9. The driving method according to claim 2, wherein when luminance level of white display is 100% and luminance level of black display is 0%, luminance level of the pre-tilt signal is not less than 0.1%.

10. The driving method according to claim 1, wherein application of the non-image signals to the data signal lines is performed by application of a voltage whose polarity is reversed in each vertical scanning period commonly to the data signal lines.

11. The driving method according to claim 1, wherein application of the non-image signals to the data signal lines is performed by application of a voltage whose polarity is reversed in each horizontal scanning period.

12. The driving method according to claim 1, wherein application of the non-image signals to the data signal lines is performed by application of voltages whose polarities are reversed in each horizontal scanning period, the voltages on the adjacent data signal lines being opposite in polarity to each other.

13. The driving method according to claim 1, wherein a polarity of a signal on the data signal line is reversed every plural horizontal scanning periods.

14. The driving method according to claim 13, wherein the non-image signal is applied to the data signal line when a polarity of a data signal is not reversed in between adjacent horizontal periods.

15. The driving method according to claim 13, wherein at a time when the polarity of the signal on the data signal line is reversed every n-number (n is an integer not less than 2) of horizontal scanning periods, the number of times the scanning signal line is selected in sync with the timing of application of the non-image signal to the data signal line is a multiple number of n.

16. The driving method according to claim 15, wherein the number of times the scanning signal line is selected in sync with the timing of application of the non-image signal to the data signal line is a multiple number of 2n.

17. The driving method according to claim 13, wherein application of the non-image signals to the data signal lines is performed by application of fixed voltages to each of the data signal lines, and polarities of the fixed voltages are reversed every plural horizontal scanning periods.

18. The driving method according to claim 17, wherein the fixed voltages are voltages whose polarities are reversed every plural horizontal scanning periods, and the fixed voltages applied on the adjacent data signal lines are opposite in polarity to each other.

19. The driving method according to claim 1, wherein the liquid crystal display device performs overshoot driving, and amounts of grayscale correction in the overshoot driving are found in accordance with polarities of pixels and video signals obtained from an external entity.

20. The driving method according to claim 19, wherein the amounts of grayscale correction for use in the overshoot driving are found by using a lookup table in which the polarities of the pixels and the video signals obtained from the external entity are associated with each other.

21. The driving method according to claim 1, wherein the liquid crystal display device performs overshoot driving, and after amounts of overshoot correction in the overshoot driving are found in relation to video signals obtained from an external entity, amounts of grayscale correction are found by using a lookup table in which polarities of pixels and the amounts of overshoot correction are associated with each other.

22. The driving method according to claim 1 wherein the liquid crystal display device has a backlight, and the backlight is turned off in sync with the timing of application of the non-image signal to the data signal line.

23. The driving method according to claim 1 wherein a duration of application of the non-image signal to the data signal line is shorter than a duration of application of an image signal for image display which signal is applied to the data signal lines.

24. The driving method according to claim 1 wherein the liquid crystal display device is a liquid crystal display device of normally black mode in which black display is performed in a state where no voltage is applied.

25. An active matrix type liquid crystal display device comprising:

a plurality of data signal lines;

a plurality of scanning signal lines that intersect the data signal lines;

a plurality of pixel sections being disposed in a matrix manner at the respective intersections of the data signal lines and the scanning signal lines, each of the pixel sections receiving as a pixel value a voltage applied to the data signal line that passes through the corresponding intersection when the scanning signal line that passes through the corresponding intersection is selected, wherein non-image signals are applied to the data signal lines at a boundary point between the adjacent horizontal scanning periods, the scanning signal lines are selected in an effective scanning period, and thereafter the scanning signal lines are selected, in sync with a timing of application of the non-image signals to the data signal lines, before the subsequent effective scanning period comes after a point in time when the scanning signal lines have been brought into non-selected state, adjacent data signal lines are connected and capable of being short-circuited to each other, and application of the non-image signals to the data signal lines is performed with the data signal lines short-circuited; and a fixed voltage power source that applies the non-image signals to the data signal lines by applying a common fixed voltage to the data signal lines, each of the non-image signals is a voltage that exists between voltages whose polarities are opposite to each other, application of the non-image signal to the data signal lines is performed at polarity reversal of a data signal, and at a time when a polarity of a signal on the data signal line is reversed in each horizontal scanning period, the number of times the scanning signal line is selected in sync with the timing of application of the non-image signal to the data signal line is an even-number.

26. The liquid crystal display device according to claim 25, wherein the liquid crystal display device is a liquid crystal display device of vertical alignment mode in which a direction where liquid crystal molecules are aligned is controlled by an electric field, and the non-image signal is a pre-tilt signal by which the liquid crystal molecules are pre-tilted.

27. The liquid crystal display device according to claim 25, wherein a polarity of a voltage corresponding to the non-image signal is identical with a polarity of a voltage corresponding to an image signal in a horizontal scanning period immediately after application of the non-image signal.

28. The liquid crystal display device according to claim 25, wherein a polarity of a non-image signal selected at the end of one vertical scanning period and applied to the pixel section is identical with a polarity of an image signal selected in a subsequent vertical scanning period.

29. The liquid crystal display device according to claim 26, wherein in a case where display luminance T when white luminance level is 1 and black luminance level is 0 is nearly close to $T=(L/Lw)^{\gamma}$ where L is display grayscale level, Lw is white display grayscale, and γ is γ characteristics, the pre-tilt signal is a signal indicating $Lw\times10^{(-3/\gamma)}$ or greater.

30. The liquid crystal display device according to claim 26, wherein regarding γ indicating γ characteristics, display grayscale L is defined as:

$L=255\times T^{(1/2.2)}$ where T is display luminance when white luminance level is 1 and black luminance level is 0, and the pre-tilt signal is a signal that generates a grayscale voltage higher than a grayscale voltage obtained when L=12.

31. The liquid crystal display device according to claim 29, wherein the pre-tilt signal is a signal indicating γ characteristics of 2.2 and 12th grayscale level or higher level out of 256 display grayscale levels.

32. The liquid crystal display device according to claim 29, wherein the pre-tilt signal is a signal indicating γ characteristics of 2.2 and 45th grayscale level or higher level out of 1024 grayscale levels for display.

33. The liquid crystal display device according to claim 26, wherein when luminance level of white display is 100% and luminance level of black display is 0%, luminance level of the pre-tilt signal is not less than 0.1%.

34. The liquid crystal display device according to claim 25, further comprising:

a first polarity reversal power source that applies the non-image signals to the data signal lines by applying a voltage whose polarity is reversed in each vertical scanning period commonly to the data signal lines.

35. The liquid crystal display device according to claim 25, further comprising:

a second polarity reversal power source that applies the non-image signals to the data signal lines by applying a voltage whose polarity is reversed in each horizontal scanning period commonly to the data signal lines.

36. The liquid crystal display device according to claim 35, wherein the second polarity reversal power source applies the non-image signals commonly to the data signal lines by applying voltages whose polarities are reversed in each horizontal scanning period, the voltages on the adjacent data signal lines being opposite in polarity to each other.

37. The liquid crystal display device according to claim 25, wherein a polarity of a signal on the data signal line is reversed every plural horizontal scanning periods.

38. The liquid crystal display device according to claim 37, wherein the non-image signal is applied to the data signal line when a polarity of a data signal is not reversed in between adjacent horizontal periods.

39. The liquid crystal display device according to claim 37, wherein at a time when the polarity of the signal on the data signal line is reversed every n-number (n is an integer not less than 2) of horizontal scanning periods, the number of times the scanning signal line is selected in sync with the timing of application of the non-image signal to the data signal line is a multiple number of n.

40. The liquid crystal display device according to claim 39, wherein the number of times the scanning signal line is selected in sync with the timing of application of the non-image signal to the data signal line is a multiple number of 2n.

41. The liquid crystal display device according to claim 37, further comprising:

a third polarity reversal power source that applies the non-image signals to the data signal lines by applying a voltage whose polarity is reversed every plural horizontal scanning periods to the data signal lines.

42. The liquid crystal display device according to claim 41, wherein the third polarity reversal power source applies the non-image signals to the data signal lines by applying to the data signal lines voltages whose polarities are reversed every plural horizontal scanning periods, the voltages on the adjacent data signal lines being opposite in polarity to each other.

43. The liquid crystal display device according to claim 25, wherein a duration of application of the non-image signal to the data signal line is shorter than a duration of application of an image signal for image display which signal is applied to the data signal lines.

44. The liquid crystal display device according to claim 25, wherein the liquid crystal display device is a liquid crystal display device of normally black mode in which black display is performed in a state where no voltage is applied.

45. The liquid crystal display device according to claim 25, further comprising:

polarity information detecting means that detects pieces of polarity information of the pixels; and correction amount calculating means that finds the amounts of grayscale correction in overshoot driving in accordance with the polarity information and video signals obtained from an external entity.

46. The liquid crystal display device according to claim 45, further comprising:

a lookup table in which the polarities of the pixels and the video signals obtained from the external entity are associated with each other.

47. A non-transitory computer-readable storage medium storing a liquid crystal display program, the program, when executed, causing a computer to function as a polarity information detecting means, a correction amount calculating means, and to implement a driving method of an active matrix type liquid crystal display device comprising:

a plurality of data signal lines;

a plurality of scanning signal lines that intersect the data signal lines; and a plurality of pixel sections being disposed in a matrix manner at the respective intersections of the data signal lines and the scanning signal lines, each of the pixel sections receiving as a pixel value a voltage applied to the data signal line that passes through the corresponding intersection when the scanning signal line that passes through the corresponding intersection is selected, wherein non-image signals are applied to the data signal lines at a boundary point between the adjacent horizontal scanning periods, the scanning signal lines are selected in an effective scanning period, and thereafter the scanning signal lines are selected, in sync with a timing of application of the non-image signals to the data signal lines, before the subsequent effective scanning period comes after a point in time when the scanning signal lines have been brought into non-selected state, application of the non-image signals to the data signal lines is performed with adjacent data signal lines short-circuited to each other, application of the non-image signals to the data signal lines is performed by application of a fixed voltage to each of the data signal lines, the polarity information detecting means that detects pieces of polarity information of the pixels, the correction amount calculating means that finds the amounts of grayscale correction in overshoot driving in accordance with the polarity information and video signals obtained from an external entity, each of the non-image signals is a voltage that exists between voltages whose polarities are opposite to each other, application of the non-image signal to the data signal lines is performed at polarity reversal of a data signal, and at a time when a polarity of a signal on the data signal line is reversed in each horizontal scanning period, the number of times the scanning signal line is selected in sync with the timing of application of the non-image signal to the data signal line is an even-number.

48. A television receiver comprising:

a liquid crystal display device according to claim 25; and a tuner section that receives a television broadcast.

49. The driving method according to claim 6, wherein the pre-tilt signal is a signal indicating y characteristics of 2.2 and 12th grayscale level or higher level out of 256 display grayscale levels.

50. The driving method according to claim 6, wherein the pre-tilt signal is a signal indicating γ characteristics of 2.2 and 45th grayscale level or higher level out of 1024 grayscale levels for display.

51. The liquid crystal display device according to claim 30, wherein the pre-tilt signal is a signal indicating γ characteristics of 2.2 and 12th grayscale level or higher level out of 256 display grayscale levels.

52. The liquid crystal display device according to claim 30, wherein the pre-tilt signal is a signal indicating γ characteristics of 2.2 and 45th grayscale level or higher level out of 1024 grayscale levels for display.

* * * * *